US010510507B2

(12) United States Patent
Kitano et al.

(10) Patent No.: US 10,510,507 B2
(45) Date of Patent: Dec. 17, 2019

(54) FUSE UNIT

(71) Applicant: Yazaki Corporation, Tokyo (JP)

(72) Inventors: Yoshinori Kitano, Shizuoka (JP); Takahiro Shiohama, Shizuoka (JP); Shinya Onoda, Shizuoka (JP); Tatsuya Aoki, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/622,508

(22) Filed: Jun. 14, 2017

(65) Prior Publication Data

US 2017/0278662 A1 Sep. 28, 2017

Related U.S. Application Data

(63) Continuation of application No. PCT/JP2015/085387, filed on Dec. 17, 2015.

(30) Foreign Application Priority Data

Jan. 14, 2015 (JP) ..... 2015-004869

(51) Int. Cl.
*H01H 85/02* (2006.01)
*H01H 85/20* (2006.01)

(52) U.S. Cl.
CPC ..... *H01H 85/0241* (2013.01); *H01H 85/20* (2013.01); *H01H 2085/025* (2013.01); *H01H 2231/026* (2013.01)

(58) Field of Classification Search
CPC ..... H01H 85/20; H01H 85/0241; H01H 2085/025; H01H 2231/026
(Continued)

(56) References Cited

U.S. PATENT DOCUMENTS 6,341,990 B1 * 1/2002 Fukuda ..... H01R 11/282 439/341
2002/0163416 A1 * 11/2002 Matsumura ..... H01H 85/044 337/112
(Continued)

FOREIGN PATENT DOCUMENTS

CN 202004047 U 10/2011
CN 102362374 A 2/2012
(Continued)

OTHER PUBLICATIONS

EPO machine translation of Otsuka JP 2005116309 A (Year: 2005).*
(Continued)

*Primary Examiner* — Jacob R Crum
(74) *Attorney, Agent, or Firm* — Sughrue Mion, PLLC

(57) ABSTRACT

A fuse unit includes a fusible link, a holding mechanism, and a locking mechanism. The fusible link is connected to a battery terminal and includes a fusible element that melts when an overcurrent flows through the fusible link. The holding mechanism includes a base portion disposed between a post standing surface of a battery housing and the battery terminal in a state where the battery terminal is fastened to a battery post provided on the post standing surface, and a holding portion that is formed next to the base portion and that holds the fusible link above the post standing surface. The locking mechanism locks the holding mechanism onto the post standing surface. With this configuration, the fuse unit can suppress a load acting on the battery post.

2 Claims, 38 Drawing Sheets

(58) Field of Classification Search
USPC ..... 337/168
See application file for complete search history.

(56) References Cited

U.S. PATENT DOCUMENTS

| | | | | |
|---|---|---|---|---|
| 2009/0108981 | A1* | 4/2009 | Iwata | G01R 1/0408 337/186 |
| 2010/0019572 | A1* | 1/2010 | Kudo | H01H 85/044 307/10.7 |
| 2011/0306243 | A1* | 12/2011 | Shiraki | H01R 11/287 439/620.29 |
| 2012/0020036 | A1 | 1/2012 | Matsumoto | |
| 2012/0302098 | A1 | 11/2012 | Matsumoto et al. | |
| 2014/0183310 | A1 | 7/2014 | Shimizu | |

FOREIGN PATENT DOCUMENTS

| | | | | |
|---|---|---|---|---|
| CN | 102696160 | A | 9/2012 | |
| CN | 102754178 | A | 10/2012 | |
| JP | 60-193227 | A | 10/1985 | |
| JP | 06-026141 | U | 4/1994 | |
| JP | 3435444 | B2 * | 8/2003 | H01H 85/20 |
| JP | 2005116309 | A * | 4/2005 | H01H 85/175 |
| JP | 2006-236693 | A | 9/2006 | |
| JP | 2011-258487 | A | 12/2011 | |
| JP | 2013-037949 | A | 2/2013 | |

OTHER PUBLICATIONS

EPO machine translation of Toshiharu JPH1140041 corresponding to JP 3435444 B2 (Year: 2003).*

Communication dated Jul. 4, 2018, from the State Intellectual Property Office of People's Republic of China in counterpart Application No. 201580068212.6.

Notification of Reason for Refusal for JP 2015-004869 dated Apr. 28, 2017.

International Search Report for PCT/JP2015/085387 filed Mar. 8, 2016.

Communication dated Apr. 15, 2019, from the State Intellectual Property Office of the People's Republic of China in counterpart Application No. 201580068212.6.

* cited by examiner

FUSE UNIT

CROSS-REFERENCE TO RELATED APPLICATION

This application is a continuation of PCT International Application No. PCT/JP2015/085387 filed on Dec. 17, 2015 which claims the benefit of priority from Japanese Patent Application No. 2015-004869 filed on Jan. 14, 2015, the entire contents of which are incorporated herein by reference.

BACKGROUND OF THE INVENTION

1. Field of the Invention

The present invention relates to a fuse unit.

2. Description of the Related Art

There have been developed conventional fuse units mounted on a vehicle or the like, including a fuse unit disclosed in Japanese Patent Application Laid-open No. 2013-037949, for example. The fuse unit disclosed in Japanese Patent Application Laid-open No. 2013-037949 includes: a power source side terminal connected to a bolt standing on a battery terminal; load side terminals connected to load terminals; a conductor, in which the power source side terminal and a fusible element provided across the load side terminals are integrally formed in a flat plate shape; and a resin cover exposing connection parts of the power source side terminal and the load side terminals to other terminals and covering the conductor.

The fuse unit disclosed in Japanese Patent Application Laid-open No. 2013-037949 is directly connected to the battery terminal, for example. In fastening the battery terminal to a battery post, there is room for improvement in suppressing a load acting on the battery post.

SUMMARY OF THE INVENTION

The present invention has been made in view of the above circumstances, and an object thereof is to provide a fuse unit capable of suppressing a load acting on a battery post.

In order to achieve the above mentioned object, a fuse unit according to one aspect of the present invention includes a fusible link connected to a battery terminal and including a fusible element that melts when an overcurrent flows through the fusible link; a holding mechanism that includes a base portion disposed between a post standing surface of a battery housing and the battery terminal in a state where the battery terminal is fastened to a battery post provided in a recess on the post standing surface, and a holding portion that is formed next to the base portion and that holds the fusible link above the post standing surface; and a locking mechanism that locks the holding mechanism onto the post standing surface, wherein the holding portion has a side wall on the base portion side extending toward a lower side in a vertical direction in a manner corresponding to a difference in level formed by the recess on the post standing surface and is connected to the base portion at a lower end of the side wall.

According to another aspect of the present invention, in the fuse unit, it is possible to configure that the holding mechanism includes an attachment portion that attaches the battery terminal to a position where the battery terminal is capable of being fastened to the battery post on the base portion.

In order to achieve the above mentioned object, a fuse unit according to still another aspect of the present invention includes a fusible link connected to a battery terminal and including a fusible element that melts when an overcurrent flows through the fusible link; a holding mechanism that includes a base portion disposed between a post standing surface of a battery housing and the battery terminal in a state where the battery terminal is fastened to a battery post provided on the post standing surface and a holding portion that is formed next to the base portion and that holds the fusible link above the post standing surface; and a locking mechanism that locks the holding mechanism onto the post standing surface, wherein the holding mechanism includes an attachment portion that attaches the battery terminal to a position where the battery terminal is capable of being fastened to the battery post on the base portion.

According to still another aspect of the present invention, in the fuse unit, it is possible to configure that the locking mechanism includes a locking claw that engages with the battery housing to lock the holding mechanism onto the post standing surface.

According to still another aspect of the present invention, in the fuse unit, it is possible to configure that the locking claw is provided in plurality and engages with a plurality of surfaces of the battery housing.

According to still another aspect of the present invention, in the fuse unit, it is possible to further include a locking force adjustment mechanism capable of adjusting locking force of the locking claw locking the holding mechanism onto the post standing surface.

According to still another aspect of the present invention, in the fuse unit, it is possible to configure that the locking claw is formed separately from the holding mechanism and supported by the holding mechanism in a manner capable of moving closer to and away from the battery housing, and the locking force adjustment mechanism has a first cog formed on one of the holding mechanism side and the locking claw side and a plurality of second cogs formed on the other of the holding mechanism side and the locking claw side in a manner aligned in a direction closer to or away from the battery housing, and the locking force adjustment mechanism causes the first cog to engage with one of the second cogs to restrict movement of the locking claw toward a side away from the battery housing and relatively increase the locking force.

According to still another aspect of the present invention, in the fuse unit, it is possible to configure that the locking claw is formed separately from the holding mechanism and supported by the holding mechanism in a manner capable of moving closer to and away from the battery housing, and the locking force adjustment mechanism has a first cog formed on one of the battery housing side and the locking claw side and a plurality of second cogs formed on the other of the battery housing side and the locking claw side in a manner aligned in a direction closer to or away from the battery housing, and the locking force adjustment mechanism causes the first cog to engage with one of the second cogs to restrict movement of the locking claw toward a side away from the battery housing and relatively increase the locking force.

According to still another aspect of the present invention, in the fuse unit, it is possible to configure that the locking claw is formed integrally with the holding mechanism, and the locking force adjustment mechanism includes a wedge member interposed between the holding mechanism or a member formed integrally with the holding mechanism and the battery housing, and the locking force adjustment mechanism causes the wedge member to be interposed between the holding mechanism or the member formed integrally with the holding mechanism and the battery housing to relatively increase the locking force.

According to still another aspect of the present invention, in the fuse unit, it is possible to configure that the locking claw is formed integrally with the holding mechanism, and the locking force adjustment mechanism includes a screw member that is screwed into the holding mechanism, that has a distal end coming into contact with the battery housing along with a screwing motion, and that presses the battery housing such that the holding mechanism moves away from the battery housing, and the locking force adjustment mechanism causes the screw member to press the battery housing such that the holding mechanism moves away from the battery housing to relatively increase the locking force.

According to still another aspect of the present invention, in the fuse unit, it is possible to configure that the locking claw is formed separately from the holding mechanism, and the locking force adjustment mechanism includes a coupling member that couples the holding mechanism to the locking claw and that is capable of changing a gap between the holding mechanism and the locking claw along with rotation about an axis, and the locking force adjustment mechanism causes the coupling member to make the gap between the holding mechanism and the locking claw relatively small to relatively increase the locking force.

According to still another aspect of the present invention, in the fuse unit, it is possible to configure that the locking claw is formed separately from the holding mechanism, and the locking force adjustment mechanism includes a flat lever that is coupled to a shaft provided to the locking claw side in a manner rotatable about the shaft, that has an outer surface in contact with the holding mechanism, and that changes a distance from a contact position with the holding mechanism to the shaft along with rotation about the shaft, and the locking force adjustment mechanism makes the distance from the contact position to the shaft relatively long along with the rotation of the flat lever about the shaft to make the locking claw closer to the holding mechanism and relatively increases the locking force.

According to still another aspect of the present invention, in the fuse unit, it is possible to configure that the locking claw includes a first locking claw formed integrally with the holding mechanism and a second locking claw that is formed separately from the holding mechanism and that engages with a surface opposite to a surface with which the first locking claw engages in the battery housing, and the locking force adjustment mechanism has a first cog formed on one of the first locking claw side and the second locking claw side and a plurality of second cogs formed on the other of the first locking claw side and the second locking claw side in a manner aligned in a direction in which the first locking claw and the second locking claw are opposite to each other, the locking force adjustment mechanism causes the first cog to engage with one of the second cogs to restrict movement of the first locking claw and the second locking claw toward sides away from each other, and relatively increase the locking force.

According to still another aspect of the present invention, in the fuse unit, it is possible to configure that the locking mechanism includes a coupler that couples a member to be coupled other than the battery housing to the holding mechanism to lock the holding mechanism onto the post standing surface.

According to still another aspect of the present invention, in the fuse unit, it is possible to further include a holding mechanism positioning mechanism that has a recess formed on one of the post standing surface and the holding mechanism and a protrusion provided on the other of the post standing surface and the holding mechanism and fit into the recess, the holding mechanism positioning mechanism positioning the holding mechanism on the post standing surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments according to the present invention are described below in greater detail with reference to the accompanying drawings. The embodiments are not intended to limit the invention. Components according to the embodiments below include ones that can be readily replaced by those skilled in the art and ones substantially identical therewith.

First Embodiment

Figure 1:
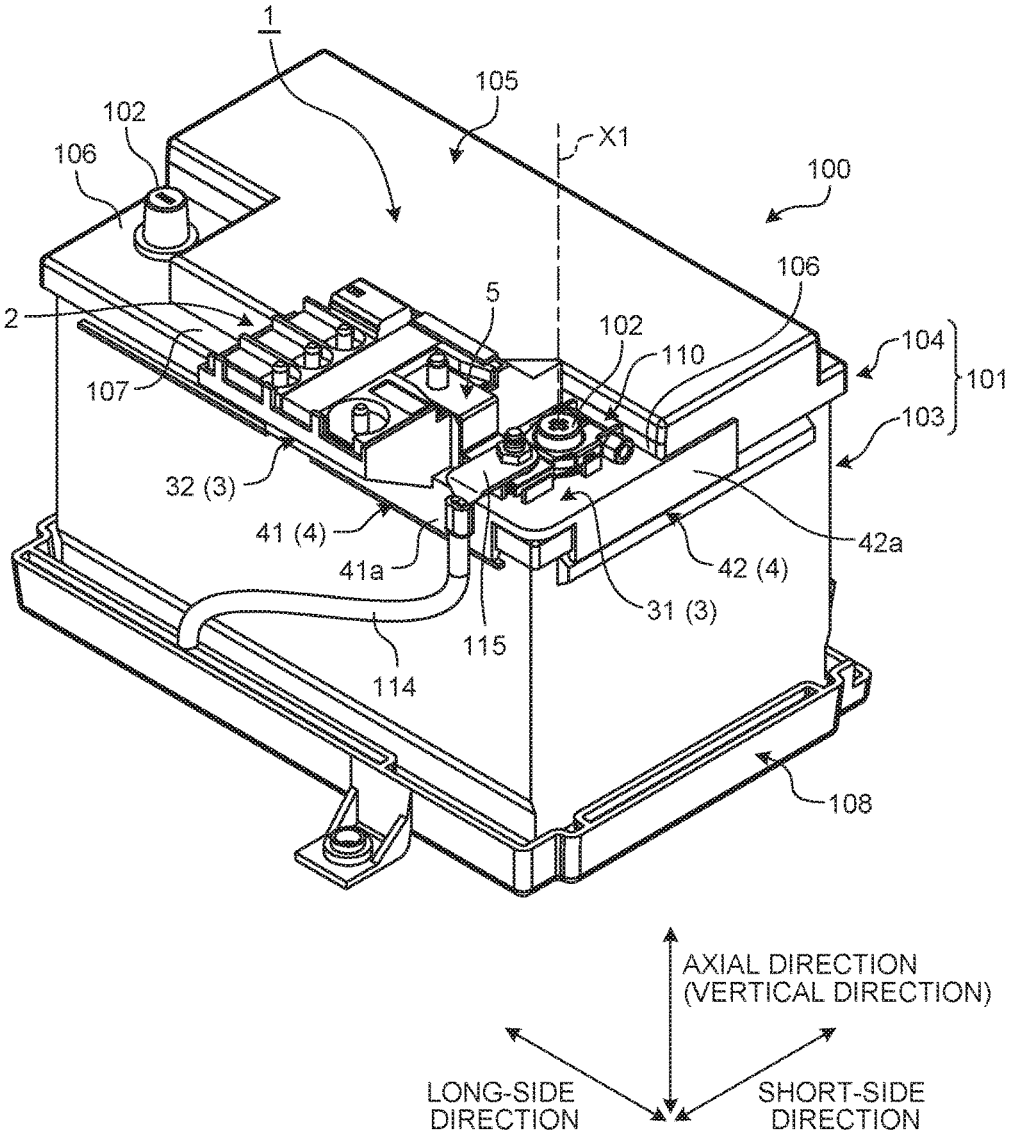
FIG. 1 is a perspective view illustrating a schematic configuration of a battery in which a fuse unit according to a first embodiment is used.
Figure 2:
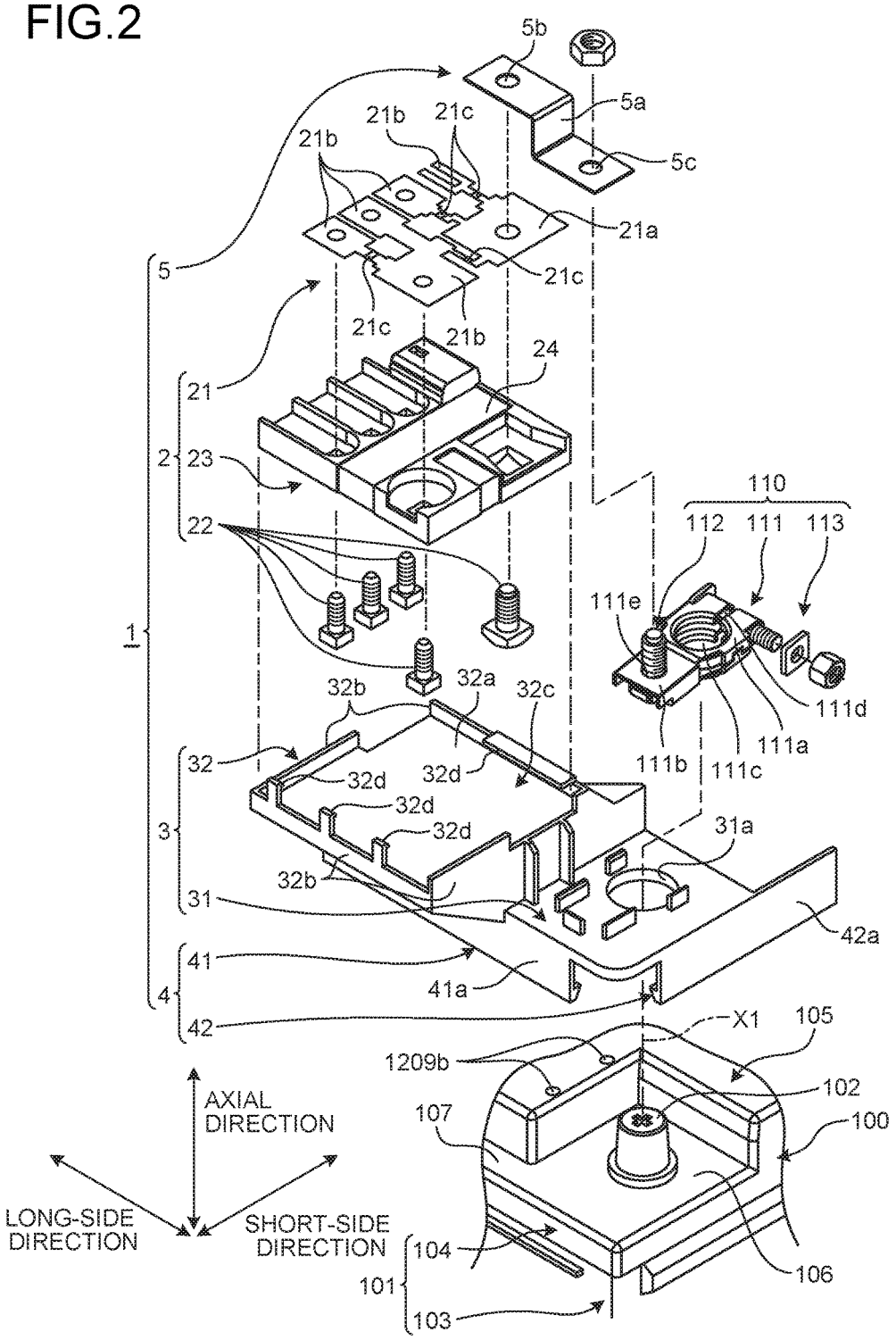
FIG. 2 is an exploded perspective view illustrating a schematic configuration of the fuse unit according to the first embodiment.
Figure 3:
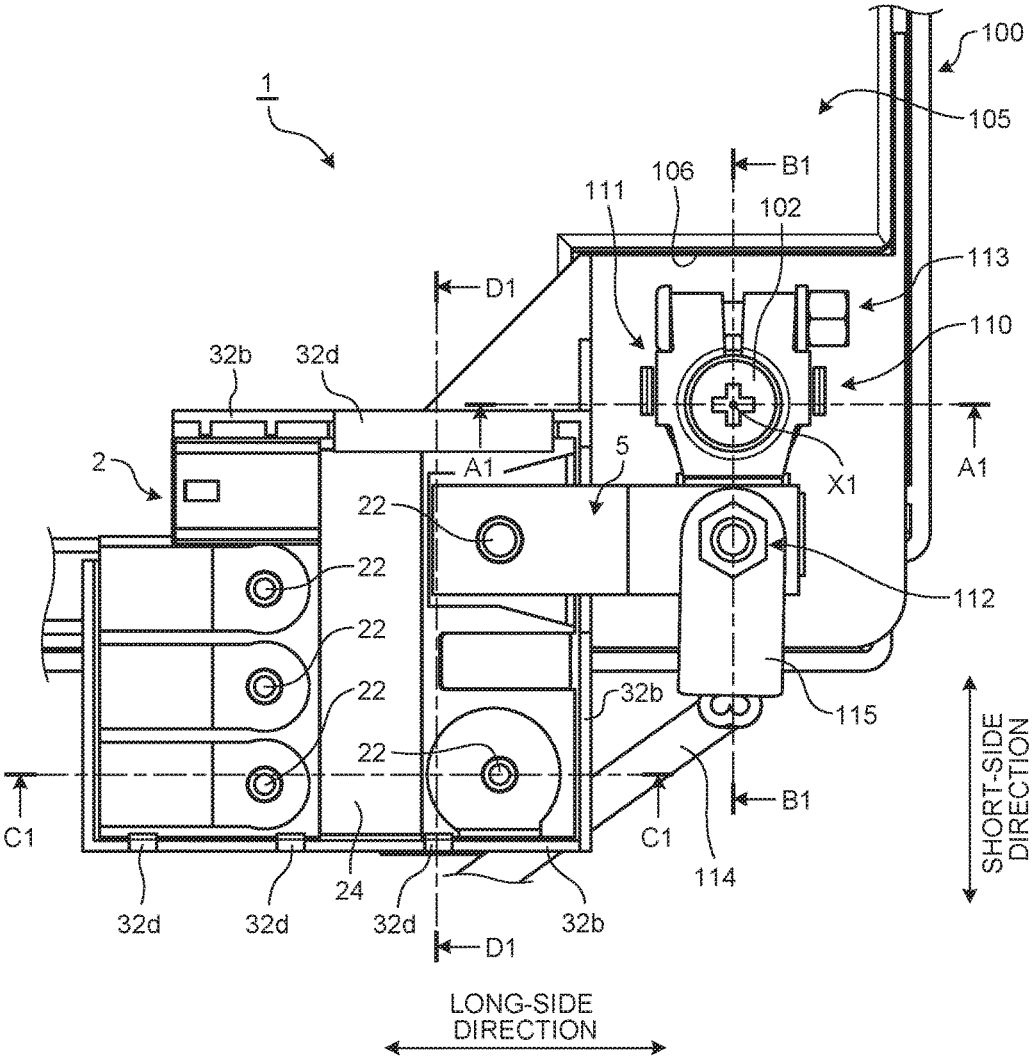
FIG. 3 is a plan view illustrating the schematic configuration of the fuse unit according to the first embodiment.
Figure 4:
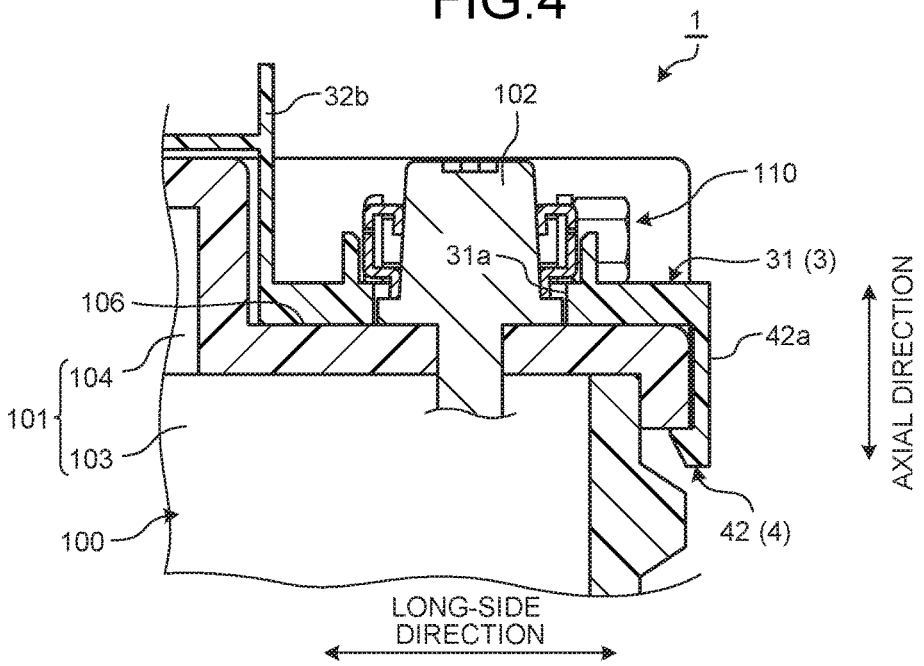
FIG. 4 is a sectional view along A1-A1 in FIG. 3.
Figure 5:
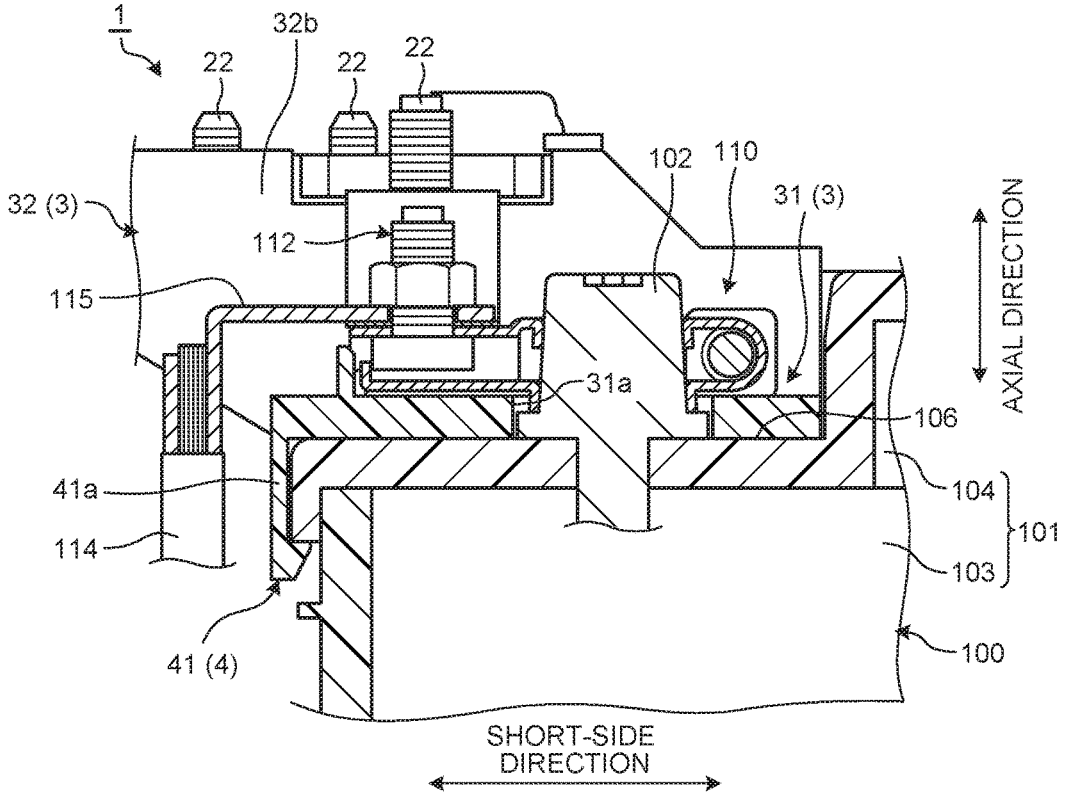
FIG. 5 is a sectional view along B1-B1 in FIG. 3.
Figure 6:
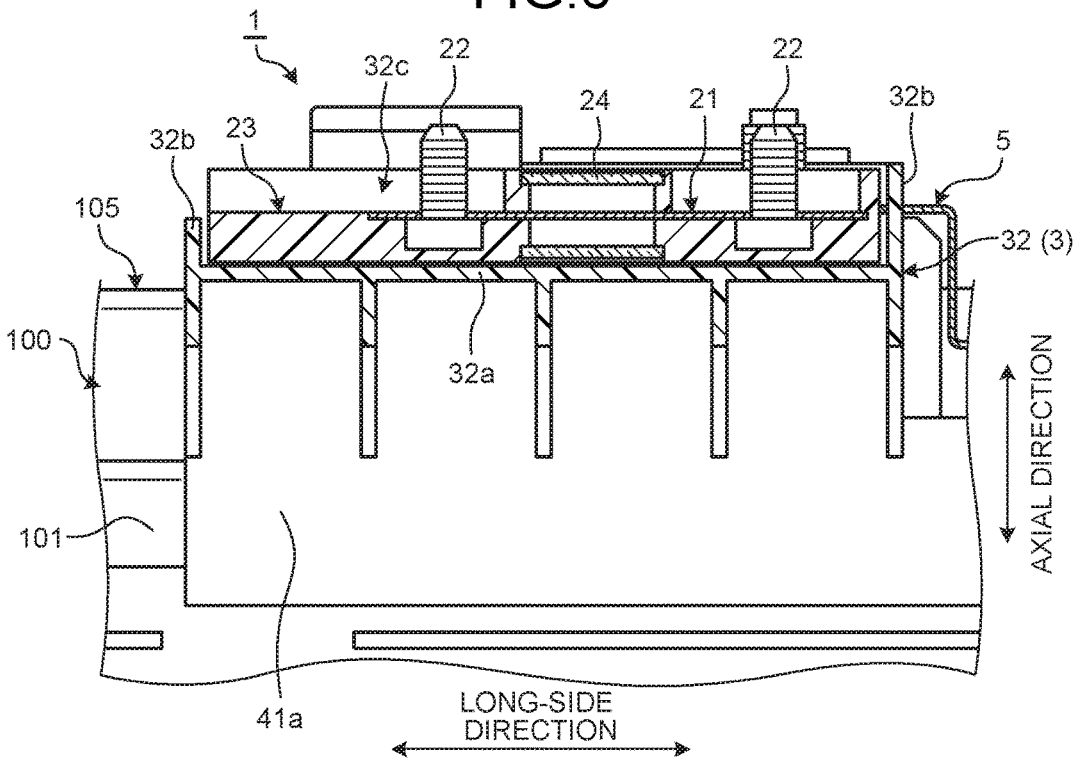
FIG. 6 is a sectional view along C1-C1 in FIG. 3.
Figure 7:
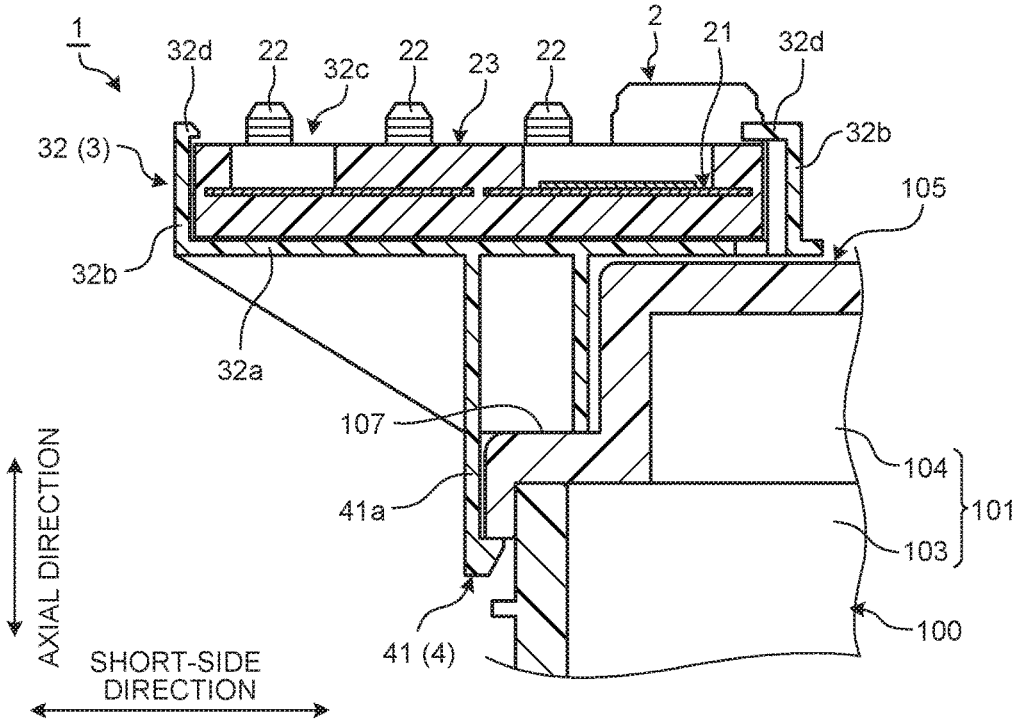
FIG. 7 is a sectional view along D1-D1 in FIG. 3.

FIG. 1 is a perspective view illustrating a schematic configuration of a battery in which a fuse unit according to a first embodiment is used. FIG. 2 is an exploded perspective view illustrating a schematic configuration of the fuse unit according to the first embodiment. FIG. 3 is a plan view illustrating the schematic configuration of the fuse unit according to the first embodiment. FIG. 4 is a sectional view along A1-A1 in FIG. 3. FIG. 5 is a sectional view along B1-B1 in FIG. 3. FIG. 6 is a sectional view along C1-C1 in FIG. 3. FIG. 7 is a sectional view along D1-D1 in FIG. 3. To simplify the explanation, FIG. 2 schematically illustrates fuse elements and stud bolts, which are actually buried in a housing by insert molding, in an exploded manner.

In the following description, a direction along a central axis X1 of a battery post 102 is referred to as an axial direction. Typically, the axial direction is a direction along the vertical direction when a battery 100 is mounted on a vehicle or the like. A post standing surface 105 of a battery housing 101, which will be described later, typically corresponds to an upper surface in the vertical direction of the battery housing 101. To simplify the following description, one of two directions orthogonal to the axial direction is referred to as a long-side direction (first width direction), and the other thereof is referred to as a short-side direction (second width direction) for descriptive purposes. The axial direction, the long-side direction, and the short-side direction are orthogonal to one another.

As illustrated in FIGS. 1, 2, 3, 4, 5, 6, and 7, a fuse unit 1 according to the present embodiment is used in a battery terminal 110 connected to the battery 100 mounted on a vehicle or the like and used to protect an electric circuit from an overcurrent.

The battery 100 and the battery terminal 110 in which the fuse unit 1 is used are described first with reference to FIGS. 1, 2, and 3.

The battery 100 is mounted on a vehicle or the like as an electricity storage device, for example. The battery 100 includes the battery housing 101, the battery post 102, and other components. The battery housing 101 accommodates a battery fluid and various parts constituting the battery 100. The battery post 102 is provided to the battery housing 101. The battery housing 101 includes a housing body 103 and a lid member 104. The housing body 103 has a substantially rectangular box shape one surface of which is opened. The lid member 104 covers the opening surface. The battery housing 101 is formed into a substantially rectangular parallelepiped shape as a whole. While the battery housing 101 has its long side along the long-side direction and its short side along the short-side direction, the present embodiment is not limited thereto. The battery post 102 is made of electrically conductive lead or the like and vertically arranged on the post standing surface 105 of the lid member 104. The post standing surface 105 is a surface on which the battery post 102 is vertically arranged in the battery housing 101. The post standing surface 105, for example, is a surface on the upper side in the vertical direction (upper surface in the vertical direction) of the lid member 104 in the battery housing 101 when the battery 100 is mounted on a vehicle or the like. The post standing surface 105 is the entire upper surface in the vertical direction of the lid member 104 including a bottom surface of a recess 106, which will be described later. The battery post 102 has a substantially cylindrical shape and is vertically arranged in a manner protruding on the post standing surface 105 with the central axis X1 extending orthogonally to the post standing surface 105. More specifically, the battery post 102 according to the present embodiment is vertically arranged in the recess 106 formed near a corner of the post standing surface 105. The recess 106 is a portion recessed in a substantially rectangular shape near the corner of the post standing surface 105. The battery post 102 is vertically arranged in the recess 106. The battery post 102 typically tapers such that the diameter decreases toward the distal end in the axial direction. In other words, the battery post 102 has a tapered shape having the outer diameter of the distal end smaller than that of the proximal end.

The battery posts 102 and the recesses 106 are provided in pair in the long-side direction to serve as an anode and a cathode. The pair of recesses 106 communicates via a communicating recess 107 (also refer to FIG. 7 and other figures). The communicating recess 107 is formed along an edge extending in the long-side direction of the lid member 104. While the following describes a case where the fuse unit 1 is used in the battery terminal 110 provided to the battery post 102 on the anode side, the present embodiment is not limited thereto. The battery 100 is fixed at a predetermined position in a vehicle with a mounting tray 108 or the like provided on the lower side in the vertical direction.

The battery terminal 110 is a part attached to the battery post 102 to electrically connect the battery 100 to a metal fitting, such as a terminal 115, provided to the distal end of an electric wire 114 on the body side of a vehicle or the like on which the battery 100 is mounted. The battery terminal 110 includes a body 111, a stud bolt 112, and a fastening portion 113. In the body 111, an annular portion 111*a* and a bolt holding portion 111*b* are integrally formed by pressing and folding an electrically conductive metal plate, for example. The annular portion 111*a* has a post insertion hole 111*c* into which the battery post 102 is inserted and a slit 111*d* communicating with the post insertion hole 111*c*. The post insertion hole 111*c* is formed into a substantially circular shape and has a tapered shape corresponding to the tapered shape of the battery post 102 on the inner peripheral wall surface such that the inner peripheral surface comes into contact with the battery post 102 when the battery post 102 is inserted into the post insertion hole 111*c*. The bolt holding portion 111*b* is a portion that holds the stud bolt 112 by being folded when the stud bolt 112 is inserted into a bolt insertion hole 111*e*, for example. The stud bolt 112 has electric conductivity. The shaft of the stud bolt 112 protruding from the bolt insertion hole 111*e* is electrically connected to the metal fitting, such as the terminal 115, provided to the distal end of the electric wire 114 when the stud bolt 112 is held by the bolt holding portion 111*b* (refer to FIGS. 1 and 3 and other figures). The fastening portion 113 fastens the annular portion 111*a* to the battery post 102 when the battery post 102 is inserted into the post insertion hole 111*c*. The fastening portion 113 includes a bolt and a nut, for example, and the bolt is attached to the body 111 in a manner crossing over the slit 111*d*. By screwing the nut on the distal end of the bolt, the fastening portion 113 fastens the annular portion 111*a* to fix the battery terminal 110 to the battery post 102.

In the battery 100 where the battery terminal 110 is fastened to the battery post 102 as described above, a protector 3 serves as a holding mechanism having a base portion 31 and a holding portion 32 integrally formed and holds a fusible link 2 above the post standing surface 105, that is, the upper surface in the vertical direction of the battery housing 101 in the present embodiment. As a result, the fuse unit 1 according to the present embodiment suppresses a load acting on the battery post 102.

Specifically, as illustrated in FIGS. 1, 2, 3, 4, 5, 6, and 7, the fuse unit 1 includes the fusible link 2 and the protector 3 serving as the holding mechanism. The fuse unit 1 according to the present embodiment further includes a locking mechanism 4 and a coupling bus bar 5.

The fusible link 2 is connected to the battery terminal 110 and includes fusible elements (fuse) 21*c* that melt when an overcurrent flows therethrough. The fusible link 2 includes a fuse element 21, stud bolts 22, and a resin housing 23. The fuse element 21 includes the fusible elements 21*c*. The stud bolts 22 are connected to the fuse element 21. The housing 23 supports the fuse element 21.

The fuse element 21 is a plate-like conductor having electric conductivity and is a metal bus bar. The fuse element 21 includes a power source side terminal 21*a*, a plurality of load side terminals 21*b*, and the fusible elements 21*c* integrally formed in a flat plate shape. The power source side terminal 21*a* is connected to the battery terminal 110 via the coupling bus bar 5 and other components. The load side terminals 21*b* are connected to load terminals. The fusible elements 21*c* are provided across the power source side terminal 21*a* and the load side terminals 21*b*. The load side terminals 21*b* have various shapes depending on the shapes of the respective load terminals, for example. The fusible elements 21*c* electrically connect the power source side terminal 21*a* and the respective load side terminals 21*b*. The fusible elements 21*c* include a strip-like conductive portion having a smaller width onto which a low melting metal chip is welded, for example. The fusible elements 21*c* melt when an overcurrent flows therethrough to interrupt the corresponding electric current path. The overcurrent in the fusible elements 21*c* is an electric current equal to or larger than a predetermined rated current, for example. In other words, the fusible elements 21*c* melt when an electric current equal to or larger than the predetermined rated current flows therethrough. The rated currents of the respective fusible elements 21*c* are determined depending on the electric current of the circuit to be protected. The power source side terminal 21*a* and the load side terminals 21*b* each have a bolt attachment hole and a connector connection shape. The stud bolts 22 are inserted into the respective bolt attachment holes, for example.

The stud bolts 22 have electric conductivity and are electrically connected to load terminals of an external circuit.

The housing 23 is made of an insulating resin material and is a block-like body supporting and covering the fuse element 21 and the stud bolts 22. In the fusible link 2 according to the present embodiment, the fuse elements 21 and the stud bolts 22 are buried and integrally formed in the housing 23 by insert molding, for example (refer to FIGS. 6 and 7 and other figures). The fusible link 2 is formed into a substantially rectangular box shape as a whole.

In the fusible link 2, the positions corresponding to the respective fusible elements 21*c* are covered with a resin transparent cover member 24. The fusible elements 21*c* can be visually checked through the transparent cover member 24.

The protector 3 holds the fusible link 2 above the post standing surface 105. The protector 3 has the base portion 31 and the holding portion 32. The base portion 31 and the holding portion 32 are made of an insulating resin material and integrally formed.

The base portion 31 is a portion disposed between the post standing surface 105 and the battery terminal 110 when the battery terminal 110 is fastened to the battery post 102 provided on the post standing surface 105 of the battery housing 101. The base portion 31 is provided around the battery post 102. The base portion 31 is formed into a rectangular plate shape and has a post insertion hole 31*a* into which the battery post 102 is inserted. The post insertion hole 31*a* is formed sufficiently larger than the battery post 102 in consideration of a tolerance allowable in the battery 100, for example. The base portion 31 has a size and a shape that allow the base portion 31 to be arranged in the recess 106 of the post standing surface 105 when the battery post 102 is inserted into the post insertion hole 31*a*. The base portion 31 may have a post insertion cutout through which the battery post 102 can penetrate instead of the post insertion hole 31*a*.

The holding portion 32 is formed next to the base portion 31 and holds the fusible link 2 above the post standing surface 105. The holding portion 32 has a bottom surface 32*a* and side walls 32*b*. The bottom surface 32*a* is formed into a substantially rectangular plate shape. The side walls 32*b* are vertically arranged in a manner surrounding the periphery of the bottom surface 32*a*. The bottom surface 32*a* and the side walls 32*b* are integrally formed into a tray shape (dish shape). The side walls 32*b* are vertically arranged in a manner protruding toward one side in the vertical direction so as to surround four sides of the bottom surface 32*a*, that is, toward the upper side in the vertical direction when the protector 3 is attached onto the post standing surface 105 of the battery 100 (which may be hereinafter simply referred to as an "attached state") in the present embodiment. The side walls 32*b* may have a cutout at a predetermined position depending on the shape of a terminal and a connector connected to the fusible link 2, for example. The holding portion 32 has an accommodation space 32*c* formed by the bottom surface 32*a* and the side walls 32*b* to accommodate and hold the fusible link 2. The accommodation space 32*c* opens toward the upper side in the vertical direction when the protector 3 is attached onto the post standing surface 105 of the battery 100. The accommodation space 32*c* has a size and a shape that allow the fusible link 2 to be fit into it. The holding portion 32 has a plurality of locking claws 32*d* at the distal ends (ends on the upper side in the vertical direction in the attached state) of the side walls 32*b*. The locking claws 32*d* have a hook shape or a curved shape formed by bending the distal ends of the side walls 32*b* (refer to FIG. 7 and other figures). The locking claws 32*d* of the holding portion 32 engage with the outer periphery of the housing 23 of the fusible link 2 at predetermined positions when the fusible link 2 is fit into the accommodation space 32*c*. As a result, the holding portion 32 can fix and lock the fusible link 2 in the accommodation space 32*c*.

The holding portion 32 according to the present embodiment having the structure described above is formed integrally with the base portion 31 next to the base portion 31 in the long-side direction. In the holding portion 32, the side wall 32*b* on the base portion 31 side extends toward the lower side in the vertical direction in a manner corresponding to the difference in level formed by the recess 106 on the post standing surface 105. The holding portion 32 is connected to the base portion 31 at the lower end of the side wall 32*b*. When the protector 3 is attached to the battery 100 in a positional relation where the battery post 102 is inserted into the post insertion hole 31*a* of the base portion 31 and where the base portion 31 is positioned in the recess 106, at least part of the holding portion 32 is positioned on the post standing surface 105 and places and holds the fusible link 2 above the post standing surface 105. In the attached state, the holding portion 32 is placed with the back surface (surface opposite to the accommodation space 32*c*) of the bottom surface 32*a* in contact with the post standing surface 105. As a result, the protector 3 receives the load of the fusible link 2 on the post standing surface 105 via the holding portion 32.

The locking mechanism 4 locks the protector 3 having the structure described above onto the post standing surface 105. The locking mechanism 4 according to the present embodiment includes locking claws 41 and 42 that engage with the battery housing 101 to lock the protector 3 onto the post standing surface 105. The locking claws 41 and 42 are provided in plurality, that is, two in the present embodiment. The locking claws 41 and 42 engage with a plurality of surfaces of the battery housing 101, that is, two surfaces orthogonal to each other in the battery housing 101 in the present embodiment. The locking claws 41 and 42 are formed integrally with the base portion 31 and the holding portion 32 of the protector 3 via plate-like portions (arm portions) 41*a* and 42*a*, respectively, extending in the vertical direction in the attached state. The plate-like portions 41*a* and 42*a* extend toward the lower side in the vertical direction from the base portion 31 and the holding portion 32 in the attached state to be formed integrally with the base portion 31 and the holding portion 32.

In the attached state, the locking claw 41 and the plate-like portion 41*a* are formed at a position facing the side surface along the long-side direction of the lid member 104 of the battery housing 101, that is, a position facing the side surface along the long-side direction near the recess 106 formed on the post standing surface 105 of the lid member 104 in the present embodiment. The locking claw 41 and the plate-like portion 41*a* are formed in a manner extending in the long-side direction across the base portion 31 and the holding portion 32. In the attached state, the locking claw 42 and the plate-like portion 42*a* are formed at a position facing the side surface along the short-side direction of the lid member 104 of the battery housing 101, that is, a position facing the side surface along the short-side direction near the recess 106 formed on the post standing surface 105 of the lid member 104 in the present embodiment. The locking claw 42 and the plate-like portion 42*a* are formed in a manner extending in the short-side direction on the base portion 31.

The locking claws 41 and 42 have a hook shape or a curved shape formed by bending the distal ends (ends on the lower side in the vertical direction when the protector 3 is attached onto the post standing surface 105 of the battery 100) of the plate-like portions 41*a* and 42*a*, respectively (refer to FIGS. 4, 5, and 7 and other figures). The locking claws 41 and 42 engage with the lower end surfaces in the vertical direction of the edges of the lid member 104 in the battery housing 101. The locking mechanism 4 causes the locking claws 41 and 42 to engage with the lower end surfaces in the vertical direction of the lid member 104 at predetermined positions when the protector 3 is attached onto the post standing surface 105 of the battery 100. As a result, the locking mechanism 4 can fix and lock the protector 3 onto the post standing surface 105.

The coupling bus bar 5 is a plate-like conductor having electrical conductivity and electrically connects the fuse element 21 to the battery terminal 110. The coupling bus bar 5 is a plate-like metal bus bar and has a step 5*a* and bolt holes 5*b* and 5*c*. The step 5*a* is formed in a manner corresponding to the difference in level formed by the recess 106 on the post standing surface 105. The bolt holes 5*b* and 5*c* are formed at both ends of the coupling bus bar 5. In the coupling bus bar 5, a nut is screwed on the stud bolt 22 of the power source side terminal 21*a* inserted into the bolt hole 5*b*, and a nut is screwed on the stud bolt 112 of the battery terminal 110 inserted into the bolt hole 5*c*. As a result, the coupling bus bar 5 electrically connects the stud bolt 22 of the power source side terminal 21*a* to the shaft of the stud bolt 112 of the battery terminal 110.

In the fuse unit 1 having the structure described above, the fusible link 2 is fit into the accommodation space 32*c* of the holding portion 32 of the protector 3, and the locking claws 32*d* engage with the housing 23 of the fusible link 2. As a result, the fusible link 2 is fixed and locked in the accommodation space 32*c*. In the fuse unit 1, the protector 3 is attached onto the post standing surface 105 of the battery 100 together with the fusible link 2 in a positional relation where the battery post 102 is inserted into the post insertion hole 31*a* of the base portion 31 of the protector 3 and where the base portion 31 is positioned in the recess 106. At this time, the fuse unit 1 causes the locking claws 41 and 42 of the locking mechanism 4 to engage with the lower end surfaces in the vertical direction of the lid member 104, thereby fixing and locking the protector 3 on the post standing surface 105 together with the fusible link 2.

As described above, the fuse unit 1 can position at least part of the protector 3 on the post standing surface 105 of the battery 100 and place and hold the fusible link 2 above the post standing surface 105. In the fuse unit 1, after the battery terminal 110 is attached to the battery post 102, the coupling bus bar 5 is arranged so as to connect the stud bolt 22 of the power source side terminal 21*a* in the fuse element 21 to the battery terminal 110. Subsequently, bolts, nuts, and the like in the portions are fastened. As a result, the battery terminal 110 is fastened to the battery post 102 and connected to the fusible link 2. At this time, the coupling bus bar 5 also serves as a regulating member that regulates the attachment angle of the battery terminal 110 with respect to the battery post 102.

While the fusible link 2 is attached to the protector 3 before the protector 3 is attached onto the post standing surface 105 together with the fusible link 2 in the description above, the present embodiment is not limited thereto. Alternatively, the protector 3 may be attached to the post standing surface 105 before the fusible link 2 is attached to the protector 3. The stud bolt 112 of the battery terminal 110 is connected not only to the coupling bus bar 5 but also to the terminal 115 or the like provided to the distal end of the electric wire 114.

As described above, the fuse unit 1 includes the fusible link 2, the protector 3, and the locking mechanism 4. The fusible link 2 is connected to the battery terminal 110 and includes the fusible elements 21*c* that melt when an overcurrent flows therethrough. The protector 3 has the base portion 31 and the holding portion 32. The base portion 31 is disposed between the post standing surface 105 and the battery terminal 110 when the battery terminal 110 is fastened to the battery post 102 provided on the post standing surface 105 of the battery housing 101. The holding portion 32 is formed next to the base portion 31 to hold the fusible link 2 above the post standing surface 105. The locking mechanism 4 locks the protector 3 onto the post standing surface 105.

In the fuse unit 1, the holding portion 32 formed next to the base portion 31 of the protector 3 holds the fusible link 2 above the post standing surface 105 of the battery housing 101. As a result, the fuse unit 1 receives the load of the fusible link 2 on the post standing surface 105. This structure can suppress the load acting on the battery terminal 110 from the fuse unit 1, thereby suppressing the load acting on the battery post 102. At this time, the fuse unit 1 can cause the locking mechanism 4 to reliably attach the protector 3 onto the post standing surface 105 together with the fusible link 2. Even if there is no space for the fuse unit 1 around the side surfaces of the battery housing 101, the fuse unit 1 can secure its installation space on the post standing surface 105 (upper surface in the vertical direction) of the battery housing 101 and arrange the fusible link 2 thereon. Consequently, the fuse unit 1 can appropriately provide the fusible link 2.

The fuse unit 1 can attach the protector 3 and the battery terminal 110 separately to the battery 100. Consequently, the fuse unit 1 can appropriately fasten the battery terminal 110 to the battery post 102 independently of the tolerance allowable in the battery 100, for example.

In the fuse unit 1, the locking mechanism 4 includes the locking claws 41 and 42 that engage with the battery housing 101 to lock the protector 3 onto the post standing surface 105. Consequently, the fuse unit 1 causes the locking claws 41 and 42 to engage with the battery housing 101, thereby locking the protector 3 onto the post standing surface 105 together with the fusible link 2.

In the fuse unit 1, the locking claws 41 and 42 are provided in plurality and engage with a plurality of surfaces of the battery housing 101. With this structure, the fuse unit 1 can cause the locking claws 41 and 42 to engage with the surfaces of the battery housing 101, thereby locking the protector 3 onto the post standing surface 105. Consequently, the fuse unit 1 can attach the protector 3 onto the post standing surface 105 more reliably.

Second Embodiment

Figure 8:
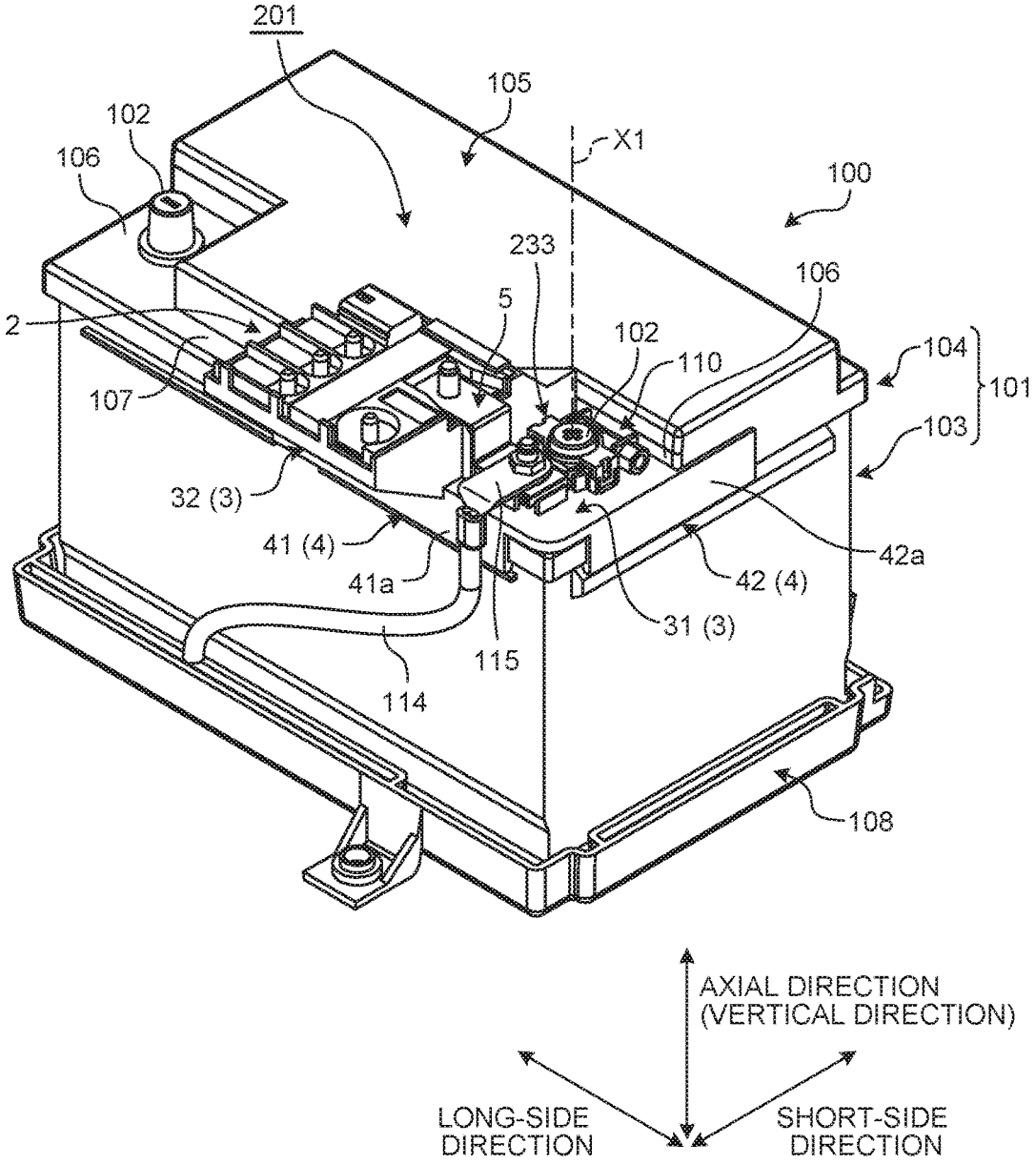
FIG. 8 is a perspective view illustrating a schematic configuration of the battery in which a fuse unit according to a second embodiment is used.
Figure 9:
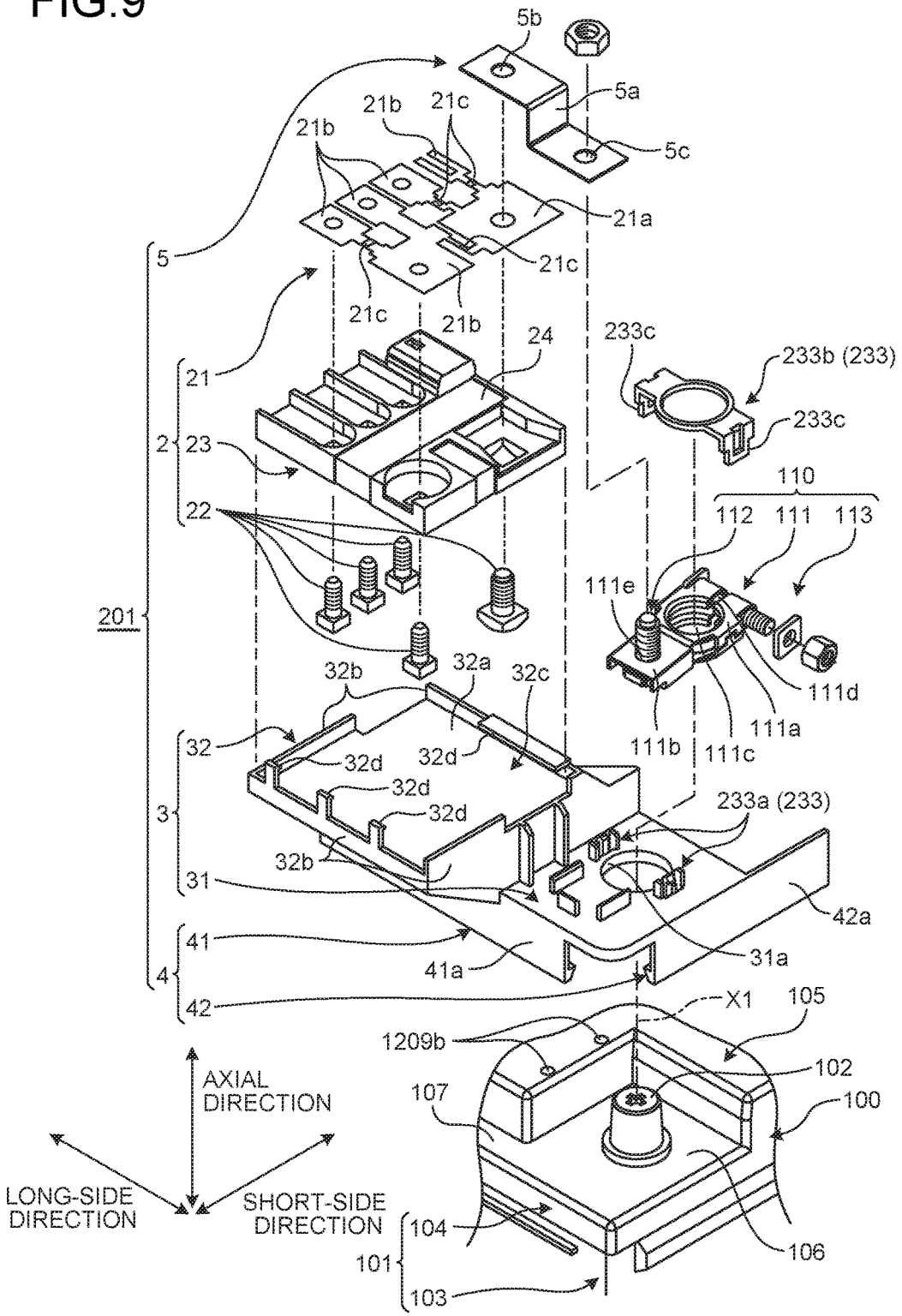
FIG. 9 is an exploded perspective view illustrating a schematic configuration of the fuse unit according to the second embodiment.
Figure 10:
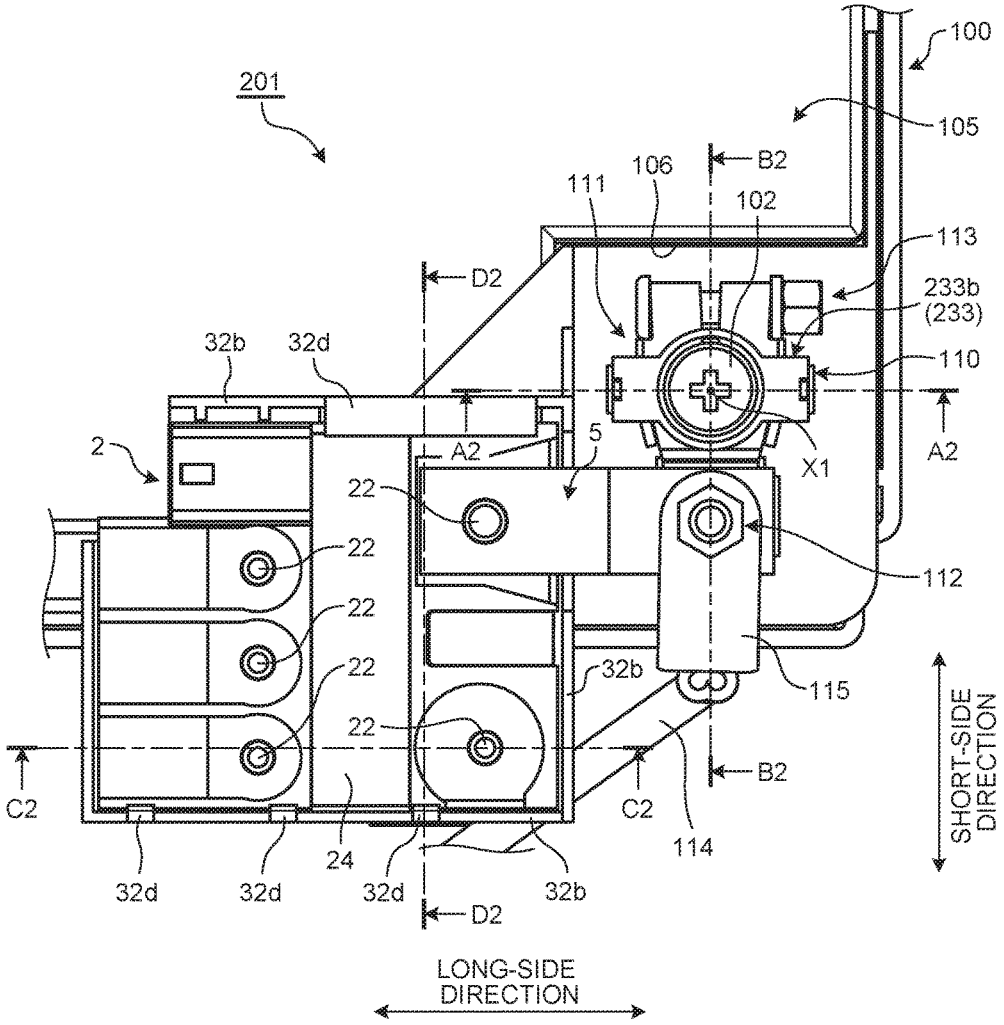
FIG. 10 is a plan view illustrating the schematic configuration of the fuse unit according to the second embodiment.
Figure 11:
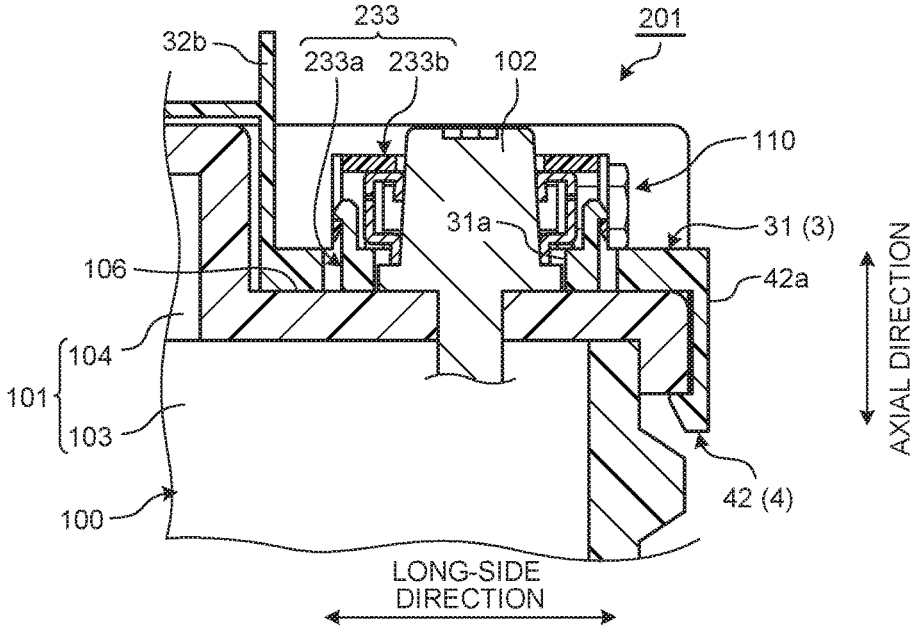
FIG. 11 is a sectional view along A2-A2 in FIG. 10.
Figure 12:
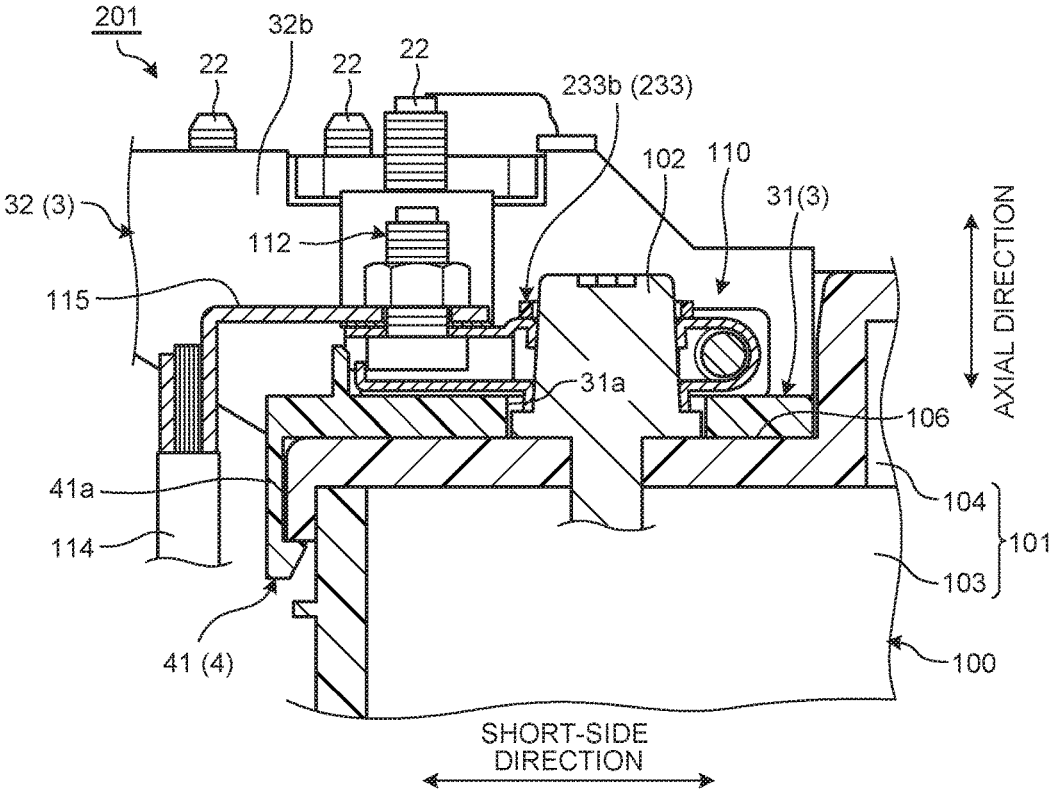
FIG. 12 is a sectional view along B2-B2 in FIG. 10.
Figure 13:
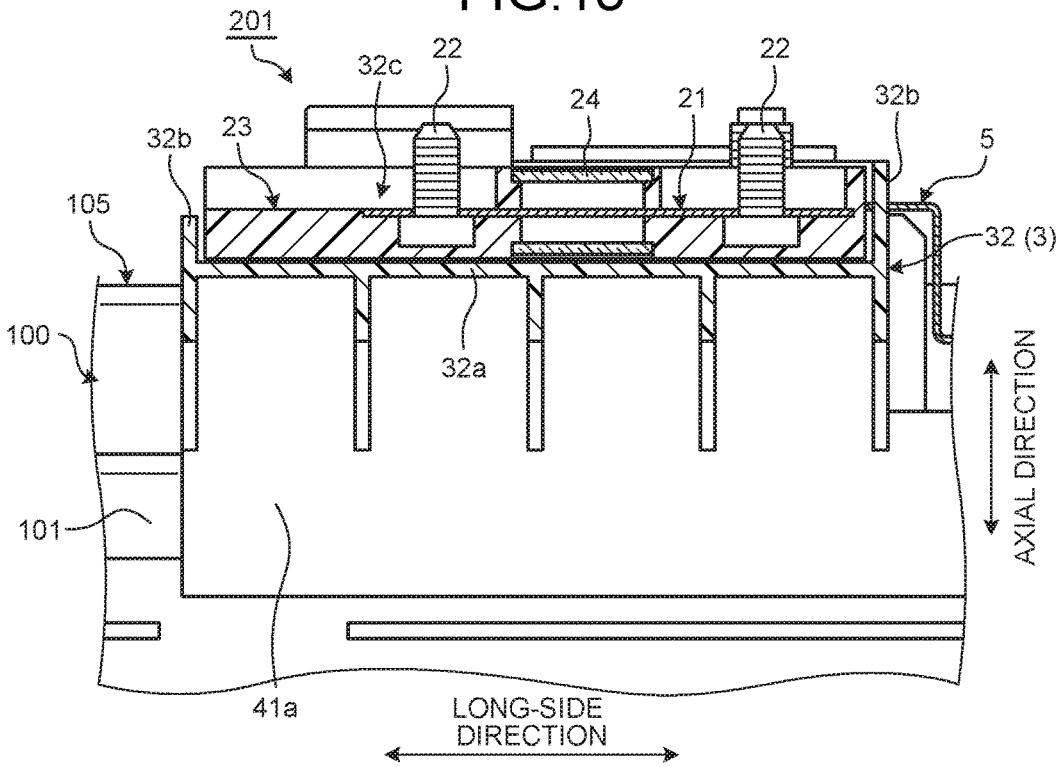
FIG. 13 is a sectional view along C2-C2 in FIG. 10.
Figure 14:
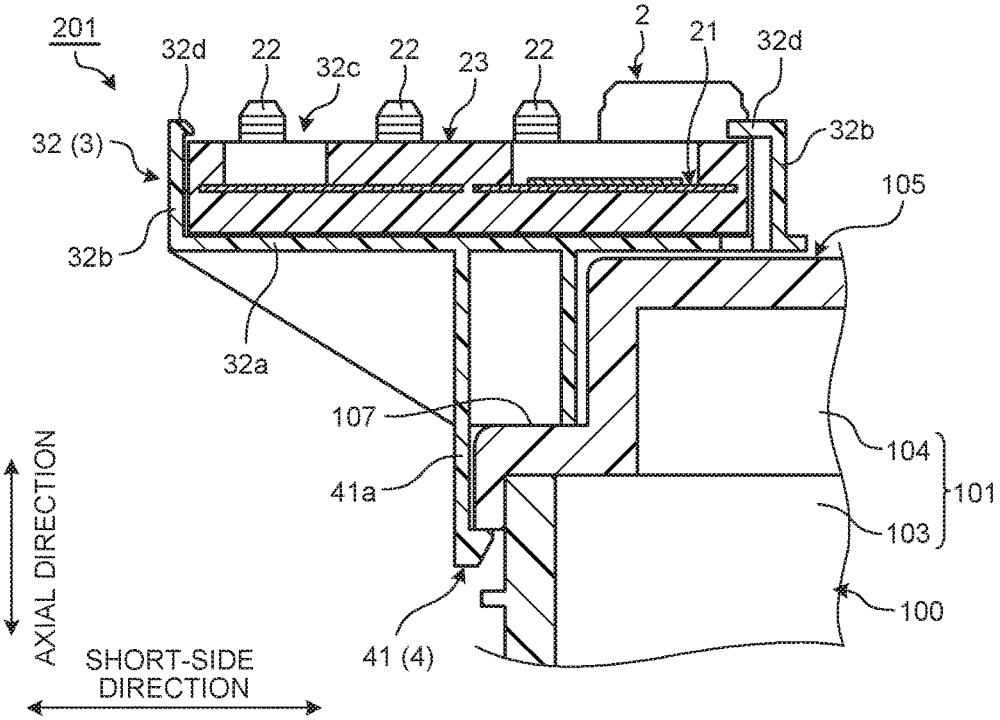
FIG. 14 is a sectional view along D2-D2 in FIG. 10.

FIG. 8 is a perspective view illustrating a schematic configuration of the battery in which a fuse unit according to a second embodiment is used. FIG. 9 is an exploded perspective view illustrating a schematic configuration of the fuse unit according to the second embodiment. FIG. 10 is a plan view illustrating the schematic configuration of the fuse unit according to the second embodiment. FIG. 11 is a sectional view along A2-A2 in FIG. 10. FIG. 12 is a sectional view along B2-B2 in FIG. 10. FIG. 13 is a sectional view along C2-C2 in FIG. 10. FIG. 14 is a sectional view along D2-D2 in FIG. 10. To simplify the explanation, FIG. 9 schematically illustrates fuse elements and stud bolts, which are actually buried in a housing by insert molding, in an exploded manner. The fuse unit according to the second embodiment is different from the first embodiment in that it further includes an attachment portion. Overlapping explanation of other components, actions, and effects common to the embodiment above will be omitted as much as possible.

As illustrated in FIGS. 8, 9, 10, 11, 12, 13, and 14, a fuse unit 201 according to the present embodiment includes the fusible link 2, the protector 3 serving as the holding mechanism, the locking mechanism 4, and the coupling bus bar 5.

The protector 3 according to the present embodiment further includes an attachment portion 233 to which the battery terminal 110 is attached in the base portion 31. The attachment portion 233 attaches the battery terminal 110 to a position where the battery terminal 110 can be fastened to the battery post 102 on the base portion 31. The attachment portion 233 according to the present embodiment includes engaging claws 233*a* and a lid 233*b* that engages with the engaging claws 233*a* (refer to FIGS. 9 and 11 and other figures). The engaging claws 233*a* are provided in pair in a manner sandwiching the post insertion hole 31*a* in the long-side direction on the base portion 31. The lid 233*b* covers a part near the annular portion 111*a* of the battery terminal 110. The lid 233*b* has a through hole having substantially the same shape as that of the post insertion hole 111*c* of the battery terminal 110. The lid 233*b* also has locking portions 233*c* that are formed on both sides of the through hole and that can engage with the respective engaging claws 233*a* (refer to FIG. 9 and other figures). The attachment portion 233 causes the locking portions 233*c* of the lid 233*b* to engage with the respective engaging claws 233*a* on the base portion 31 with the battery terminal 110 disposed between the base portion 31 and the lid 233*b*, thereby attaching and locking the battery terminal 110 at a predetermined position on the base portion 31. The attachment portion 233 includes the engaging claws 233*a* and the lid 233*b* such that they have a positional relation where the battery post 102 is inserted into the post insertion hole 111*c* of the battery terminal 110 with the battery post 102 inserted into the post insertion hole 31*a* of the base portion 31.

In the fuse unit 201 having the structure described above, the fusible link 2 is fit into the accommodation space 32*c* of the holding portion 32 of the protector 3, and the locking claws 32*d* engage with the housing 23 of the fusible link 2. As a result, the fusible link 2 is fixed and locked in the accommodation space 32*c*. In the fuse unit 201, the protector 3 is attached onto the post standing surface 105 of the battery 100 together with the fusible link 2 in a positional relation where the battery terminal 110 is attached to the attachment portion 233 provided to the base portion 31, where the battery post 102 is inserted into the post insertion hole 31*a* of the base portion 31 of the protector 3 and the post insertion hole 111*c* of the battery terminal 110, and where the base portion 31 is positioned in the recess 106. At this time, the fuse unit 201 causes the locking claws 41 and 42 of the locking mechanism 4 to engage with the lower end surfaces in the vertical direction of the lid member 104, thereby fixing and locking the protector 3 on the post standing surface 105 together with the fusible link 2.

As described above, the fuse unit 201 can position at least part of the protector 3 on the post standing surface 105 of the battery 100 and place and hold the fusible link 2 above the post standing surface 105. In the fuse unit 201, the coupling bus bar 5 is arranged so as to connect the stud bolt 22 of the power source side terminal 21*a* in the fuse element 21 to the battery terminal 110. Subsequently, bolts, nuts, and the like in the portions are fastened. As a result, the battery terminal 110 is fastened to the battery post 102 and connected to the fusible link 2.

In the fuse unit 201, the holding portion 32 formed next to the base portion 31 of the protector 3 holds the fusible link 2 above the post standing surface 105 of the battery housing 101. As a result, the fuse unit 201 receives the load of the fusible link 2 on the post standing surface 105. This structure can suppress the load acting on the battery terminal 110 from the fuse unit 201, thereby suppressing the load acting on the battery post 102. At this time, the fuse unit 201 can cause the locking mechanism 4 to reliably attach the protector 3 onto the post standing surface 105 together with the fusible link 2. Even if there is no space for the fuse unit 201 around the side surfaces of the battery housing 101, the fuse unit 201 can secure its installation space on the post standing surface 105 (upper surface in the vertical direction) of the battery housing 101 and arrange the fusible link 2 thereon. Consequently, the fuse unit 201 can appropriately provide the fusible link 2.

In the fuse unit 201, the protector 3 further includes the attachment portion 233 that attaches the battery terminal 110 to a position where the battery terminal 110 can be fastened to the battery post 102 on the base portion 31. Consequently, the fuse unit 201 can attach the battery terminal 110 to the attachment portion 233 and thus attach the protector 3 and the battery terminal 110 integrally to the battery 100. This structure can reduce the number of processes in assembly, thereby improving the assembly workability.

The fuse unit 201 can attach the protector 3 and the battery terminal 110 integrally to the battery 100. Consequently, the locking claws 41 and 42 and the plate-like portions 41*a* and 42*a* formed integrally with the protector 3 can also be used as a regulating member that regulates the attachment angle of the battery terminal 110 with respect to the battery post 102. In other words, in the fuse unit 201, the locking claws 41 and 42 and the plate-like portions 41*a* and 42*a* also serve as a stopper that prevents rotation of the battery terminal 110 about the battery post 102 within a predetermined range. This structure can limit the allowable range of the attachment angle of the battery terminal 110 with respect to the battery post 102 to a relatively narrow range, thereby improving the attachment accuracy of the battery terminal 110 to the battery post 102.

The attachment portion 233 is not limited to the form described above. While the attachment portion 233 includes two pairs of the engaging claw 233*a* and the locking portion 233*c*, for example, the base portion 31 and the lid 233*b* may be integrally formed via a hinge instead of one of the pairs. In this case, in the attachment portion 233, the locking portion 233*c* engages with the engaging claw 233*a* with the battery terminal 110 held between the base portion 31 and the lid 233*b*, that is, in the closed state, thereby preventing the lid 233*b* from opening. As a result, the attachment portion 233 can attach and lock the battery terminal 110 at the predetermined position on the base portion 31. Alternatively, the attachment portion 233 does not necessarily include the lid 233*b*, for example. In this case, the attachment portion 233 may attach and lock the battery terminal 110 at the predetermined position on the base portion 31 by fitting and locking a protrusion having a lock shape formed in one of the battery terminal 110 and the base portion 31 into a recess formed in the other thereof, for example.

Third Embodiment

Figure 15:
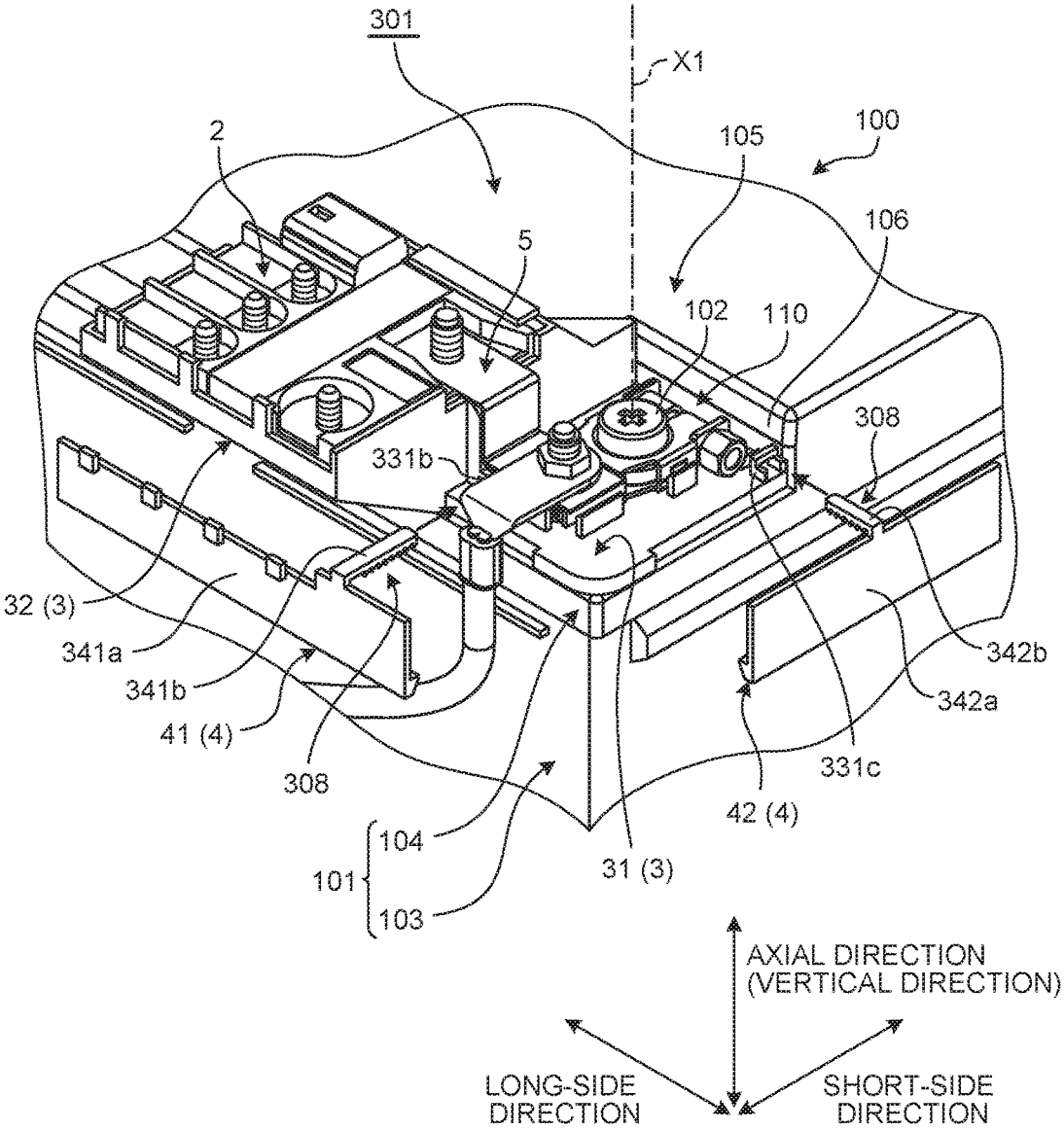
FIG. 15 is an exploded perspective view illustrating a part near a locking force adjustment mechanism of a fuse unit according to a third embodiment.
Figure 16:
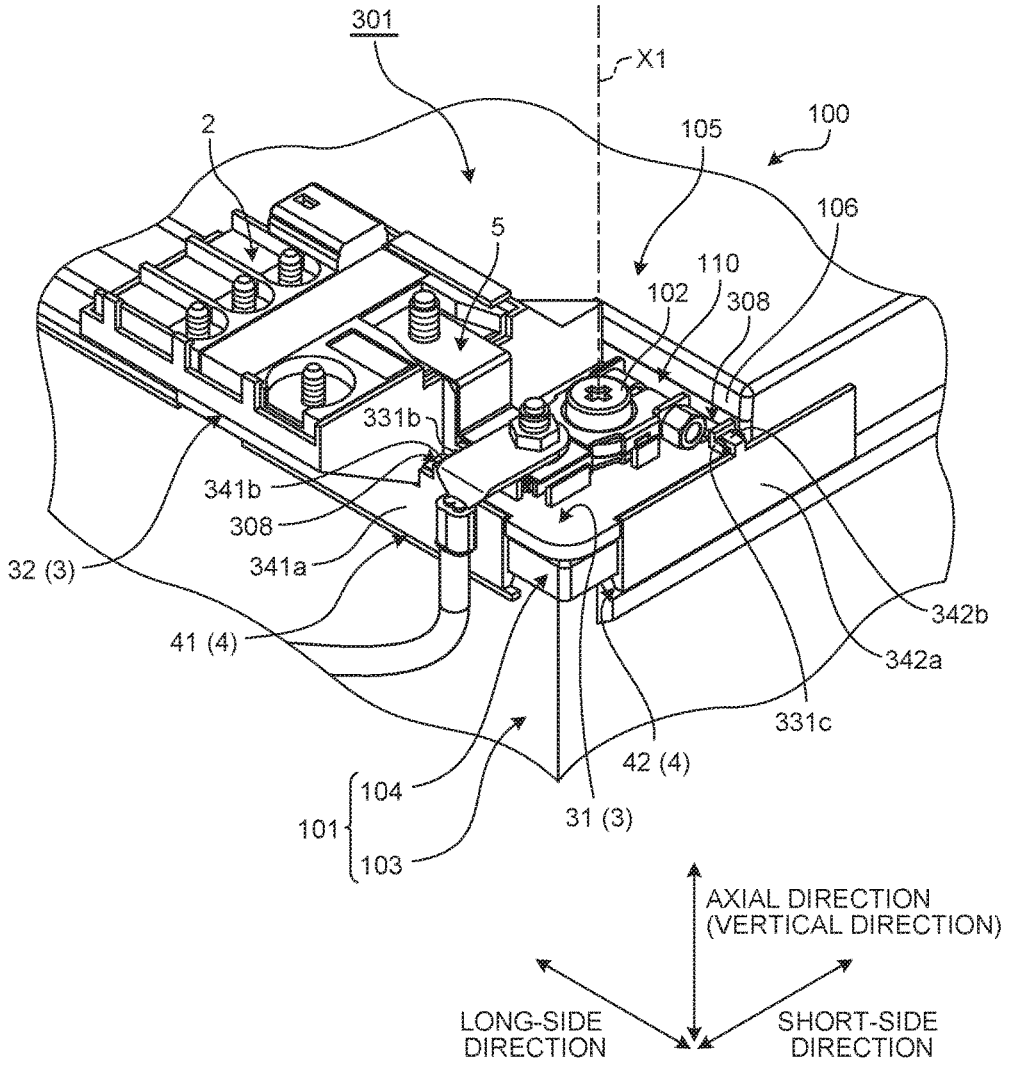
FIG. 16 is a partial perspective view illustrating the part near the locking force adjustment mechanism of the fuse unit according to the third embodiment.
Figure 17:
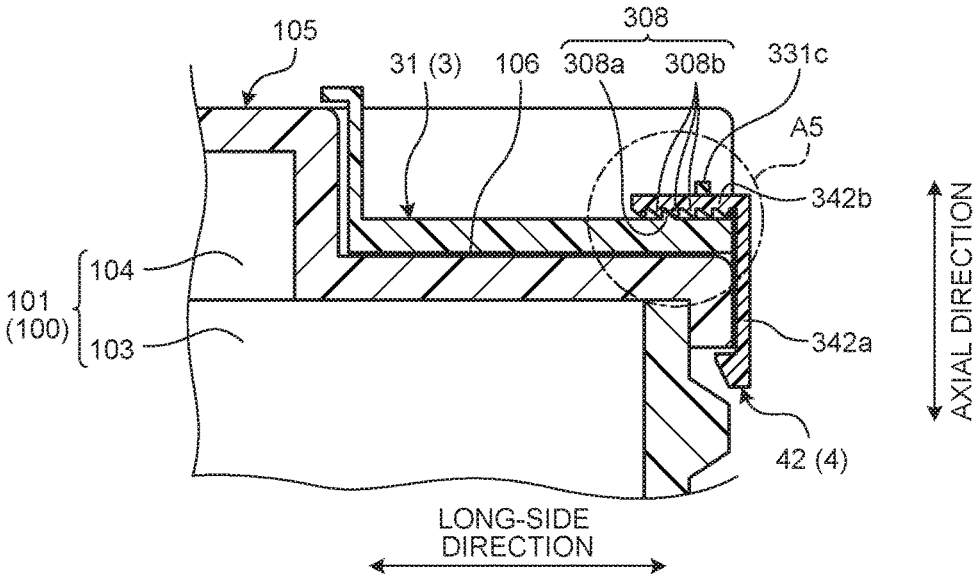
FIG. 17 is a partial sectional view along a long-side direction including a locking claw of the fuse unit according to the third embodiment.
Figure 18:
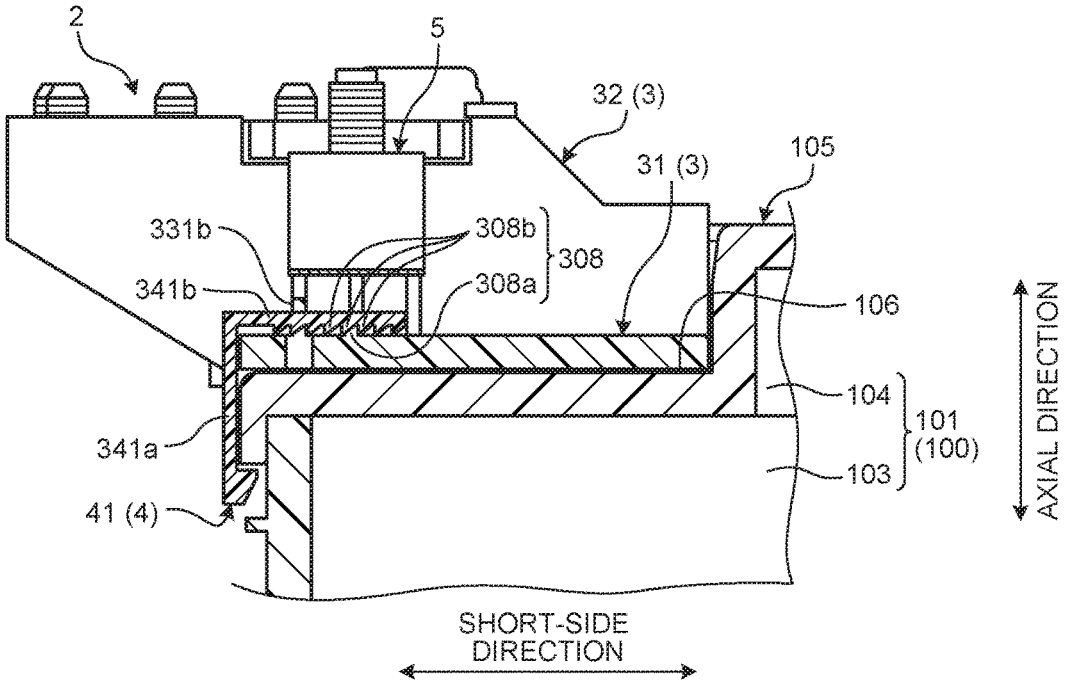
FIG. 18 is a partial sectional view along a short-side direction including a locking claw of the fuse unit according to the third embodiment.
Figure 19:
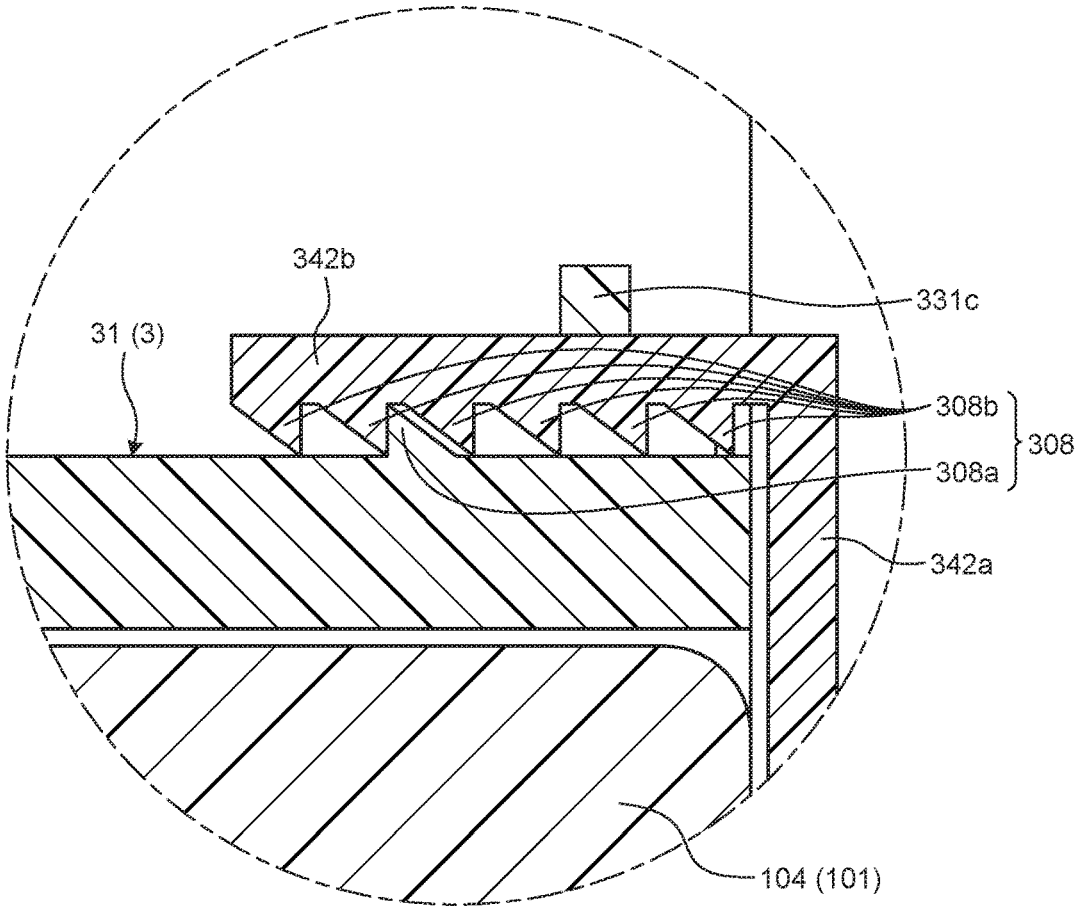
FIG. 19 is an enlarged partial sectional view of a part in the surrounding line A5 in FIG. 17.
Figure 20:
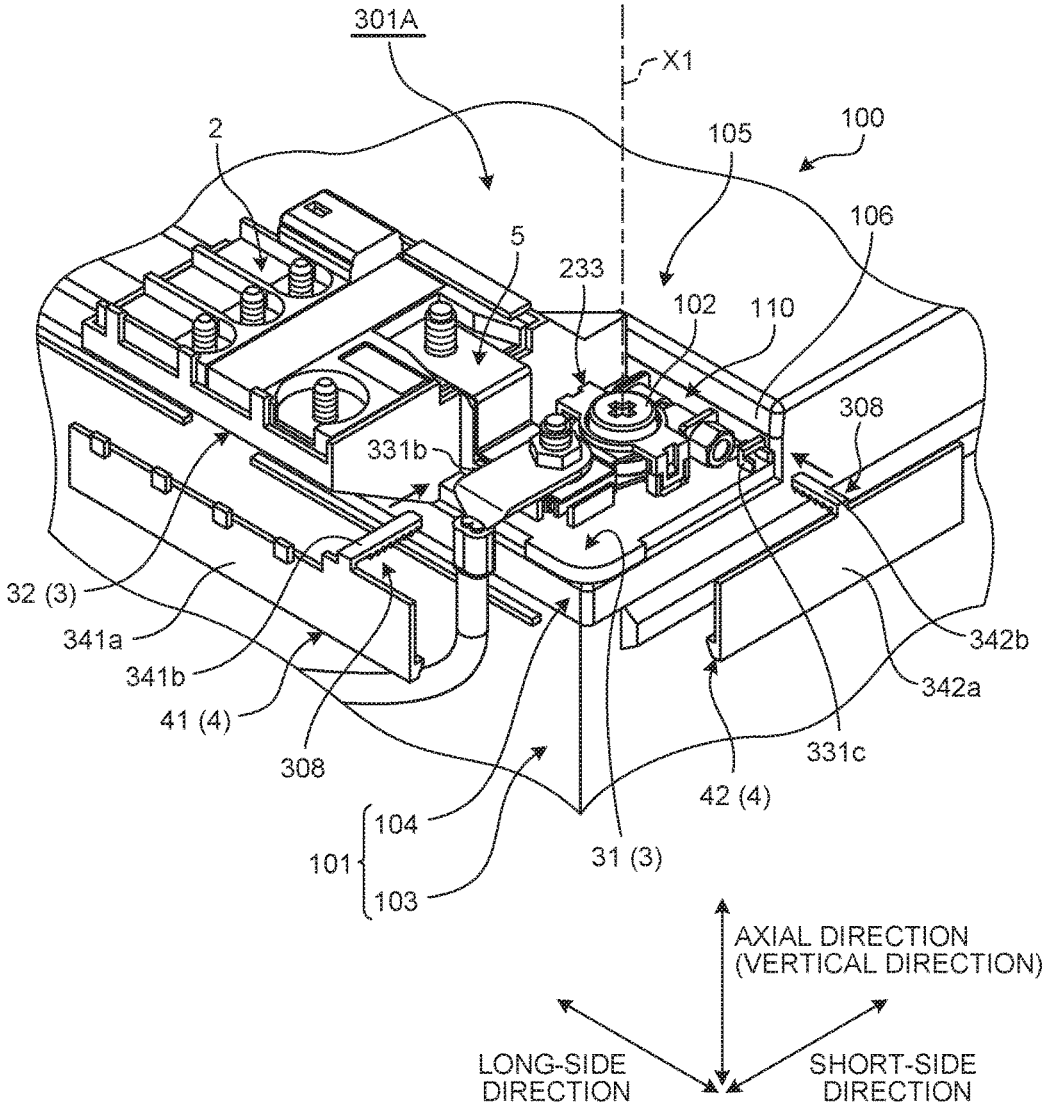
FIG. 20 is an exploded perspective view illustrating the part near the locking force adjustment mechanism of a fuse unit according to a modification.

FIG. 15 is an exploded perspective view illustrating a part near a locking force adjustment mechanism of a fuse unit according to a third embodiment. FIG. 16 is a partial perspective view illustrating the part near the locking force adjustment mechanism of the fuse unit according to the third embodiment. FIG. 17 is a partial sectional view along the long-side direction including the locking claw of the fuse unit according to the third embodiment. FIG. 18 is a partial sectional view along the short-side direction including the locking claw of the fuse unit according to the third embodiment. FIG. 19 is an enlarged partial sectional view of a part in the surrounding line A5 in FIG. 17. FIG. 20 is an exploded perspective view illustrating the part near the locking force adjustment mechanism of a fuse unit according to a modification. The fuse unit according to the third embodiment is different from the first embodiment in that it further includes locking force adjustment mechanisms. Overlapping explanation of other components, actions, and effects common to the embodiments above will be omitted as much as possible. The schematic configuration will be described with reference to other figures as appropriate.

As illustrated in FIGS. 15, 16, 17, 18, and 19, a fuse unit 301 according to the present embodiment includes, in addition to the fusible link 2, the protector 3 serving as the holding mechanism, the locking mechanism 4, and the coupling bus bar 5, locking force adjustment mechanisms 308. The locking force adjustment mechanisms 308 can adjust the locking force of the locking claws 41 and 42 in the locking mechanism 4 locking the protector 3 onto the post standing surface 105.

As illustrated in FIGS. 15 and 16 and other figures, the locking claws 41 and 42 according to the present embodiment are formed separately from the protector 3. The locking claws 41 and 42 are supported by the protector 3 in a manner capable of moving closer to and away from the battery housing 101. More specifically, the locking claws 41 and 42 according to the present embodiment are formed integrally with plate-like portions (arm portions) 341*a* and 342*a*, respectively, at the distal ends of the plate-like portions 341*a* and 342*a*. The plate-like portions 341*a* and 342*a* according to the present embodiment are formed separately from the base portion 31 and the holding portion 32 of the protector 3. The locking claws 41 and 42 have a hook shape or a curved shape formed by bending the distal ends (ends on the lower side in the vertical direction when the protector 3 is attached onto the post standing surface 105 of the battery 100) of the plate-like portions 341*a* and 342*a*, respectively (refer to FIGS. 17 and 18 and other figures).

Supported structures 341*b* and 342*b* supported by the protector 3 are formed integrally with the plate-like portions 341*a* and 342*a*, respectively, at the ends (ends on the upper side in the vertical direction when the protector 3 is attached onto the post standing surface 105 of the battery 100) opposite to the ends provided with the locking claws 41 and 42. The supported structure 341*b* and 342*b* according to the present embodiment are formed into a square pillar shape and extend in a direction intersecting with (substantially orthogonal to) the main surface of the plate-like portions 341*a* and 342*a*, respectively. In the protector 3 according to the present embodiment, supporting portions 331*b* and 331*c* are formed integrally with the base portion 31. The supporting portions 331*b* and 331*c* are portions into which the supported structures 341*b* and 342*b*, respectively, are inserted and that support the supported structures 341*b* and 342*b*. In the attached state, the supporting portion 331*b* is formed at the edge along the long-side direction of the base portion 31, and the supporting portion 331*c* is formed at the edge along the short-side direction of the base portion 31. The supported structure 341*b* is inserted into and supported by the supporting portion 331*b*. As a result, the locking claw 41 and the plate-like portion 341*a* are supported by the base portion 31 of the protector 3 in a manner capable of moving closer to and away from the battery housing 101 in the short-side direction. The supported structure 342*b* is inserted into and supported by the supporting portion 331*c*. As a result, the locking claw 42 and the plate-like portion 342*a* are supported by the base portion 31 of the protector 3 in a manner capable of moving closer to and away from the battery housing 101 in the long-side direction.

In the attached state and the state where the supported structure 341*b* is supported by the supporting portion 331*b*, the locking claw 41 and the plate-like portion 341*a* are provided at a position facing the side surface along the long-side direction of the lid member 104 of the battery housing 101, that is, a position facing the side surface along the long-side direction near the recess 106 formed on the post standing surface 105 of the lid member 104 in the present embodiment. In this state, the locking claw 41 and the plate-like portion 341*a* extend in the long-side direction, and the supported structure 341*b* extends in the short-side direction. In the attached state and the state where the supported structure 342*b* is supported by the supporting portion 331*c*, the locking claw 42 and the plate-like portion 342*a* are provided at a position facing the side surface along the short-side direction of the lid member 104 of the battery housing 101, that is, a position facing the side surface along the short-side direction near the recess 106 formed on the post standing surface 105 of the lid member 104 in the present embodiment. In this state, the locking claw 42 and the plate-like portion 342*a* extend in the short-side direction, and the supported structure 342*b* extends in the long-side direction.

As illustrated in FIGS. 15, 17, 18, and 19, the locking force adjustment mechanisms 308 according to the present embodiment are provided to a support portion between the supported structure 341*b* and the supporting portion 331*b* and a support portion between the supported structure 342*b* and the supporting portion 331*c*. The enlarged partial sectional view in FIG. 19 illustrates the locking force adjustment mechanism 308 on the supported structure 342*b* side. Because the locking force adjustment mechanism 308 on the supported structure 341*b* side has substantially the same structure as that on the supported structure 342*b* side, illustration thereof is omitted.

The locking force adjustment mechanisms 308 each have a first cog 308*a* and a plurality of second cogs 308*b*. The first cog 308*a* is formed on one of the protector 3 side and the locking claws 41 and 42 side. The second cogs 308*b* are formed on the other of the protector 3 side and the locking claws 41 and 42 side in a manner aligned in a direction in which the locking claws 41 and 42 move closer to or away from the battery housing 101.

In the locking force adjustment mechanism 308 on the supported structure 342*b* side, as illustrated in FIGS. 17 and 19 and other figures, the first cog 308*a* is formed on the upper surface in the vertical direction of the base portion 31 of the protector 3 (that is, the surface facing the supported structure 342*b*). The first cog 308*a* is formed as a protruding cog protruding from the base portion 31, and one first cog 308*a* is provided in the present embodiment. In the locking force adjustment mechanism 308, the second cogs 308*b* are formed on the lower end surface in the vertical direction of the supported structure 342*b* formed integrally with the locking claw 42 (that is, the surface facing the base portion 31). The second cogs 308*b* are formed as protruding cogs protruding from the lower end surface in the vertical direction of the supported structure 342*b*. The second cogs 308*b* are aligned in the direction in which the locking claw 42 moves closer to or away from the battery housing 101, that is, in the long-side direction. The first cog 308*a* and the second cogs 308*b* are formed into the following sectional shape: when the locking claw 42 and the plate-like portion 342*a* are moved in the direction closer to the battery housing 101, and the supported structure 342*b* is moved and thrusted into the supporting portion 331*c* in the long-side direction, the second cogs 308*b* climb over the first cog 308*a*; and when the locking claw 42 and the plate-like portion 342*a* are moved in the direction away from the battery housing 101, and the supported structure 342*b* is tried to be pulled out from the supporting portion 331*c* in the long-side direction, one of the second cogs 308*b* comes into contact with the first cog 308*a*, thereby restricting the movement of the supported structure 342*b*.

Similarly, in the locking force adjustment mechanism 308 on the supported structure 341*b* side, as illustrated in FIG. 18 and other figures, the first cog 308*a* is formed on the upper surface in the vertical direction of the base portion 31 of the protector 3 (that is, the surface facing the supported structure 341*b*). The first cog 308*a* is formed as a protruding cog protruding from the base portion 31, and one first cog 308*a* is provided in the present embodiment. In the locking force adjustment mechanism 308, the second cogs 308*b* are formed on the lower end surface in the vertical direction of the supported structure 341*b* formed integrally with the locking claw 41 (that is, the surface facing the base portion 31). The second cogs 308*b* are formed as protruding cogs protruding from the lower end surface in the vertical direction of the supported structure 341*b*. The second cogs 308*b* are aligned in the direction in which the locking claw 41 moves closer to or away from the battery housing 101, that is, in the short-side direction. The first cog 308*a* and the second cogs 308*b* are formed into the following sectional shape: when the locking claw 41 and the plate-like portion 341*a* are moved in the direction closer to the battery housing 101, and the supported structure 341*b* is moved and thrusted into the supporting portion 331*b* in the short-side direction, the second cogs 308*b* climb over the first cog 308*a*; and when the locking claw 41 and the plate-like portion 341*a* are moved in the direction away from the battery housing 101, and the supported structure 341*b* is tried to be pulled out from the supporting portion 331*b* in the short-side direction, one of the second cogs 308*b* comes into contact with the first cog 308*a*, thereby restricting the movement of the supported structure 341*b*.

The locking force adjustment mechanisms 308 having the structure described above cause the first cog 308*a* to engage with one of the second cogs 308*b*, thereby restricting the movement of the locking claws 41 and 42 toward the side away from the battery housing 101. By using the mechanism described above, the locking force adjustment mechanism 308 on the supported structure 341*b* side moves the locking claw 41 and the plate-like portion 341*a* in the direction closer to the battery housing 101 and thrusts the supported structure 341*b* toward the supporting portion 331*b* as much as possible. The locking force adjustment mechanism 308 thus relatively increases the force of the locking claw 41 engaging with the lid member 104 of the battery housing 101. As a result, the locking force adjustment mechanism 308 can relatively increase the locking force of the locking claw 41 locking the protector 3 onto the post standing surface 105 and maintain this state. Similarly, the locking force adjustment mechanism 308 on the supported structure 342*b* side moves the locking claw 42 and the plate-like portion 342*a* in the direction closer to the battery housing 101 and thrusts the supported structure 342*b* toward the supporting portion 331*c* as much as possible. The locking force adjustment mechanism 308 thus relatively increases the force of the locking claw 42 engaging with the lid member 104 of the battery housing 101. As a result, the locking force adjustment mechanism 308 can relatively increase the locking force of the locking claw 42 locking the protector 3 onto the post standing surface 105 and maintain this state.

In the fuse unit 301, the holding portion 32 formed next to the base portion 31 of the protector 3 holds the fusible link 2 above the post standing surface 105 of the battery housing 101. As a result, the fuse unit 301 receives the load of the fusible link 2 on the post standing surface 105. This structure can suppress the load acting on the battery terminal 110 from the fuse unit 301, thereby suppressing the load acting on the battery post 102. At this time, the fuse unit 301 can cause the locking mechanism 4 to reliably attach the protector 3 onto the post standing surface 105 together with the fusible link 2. Even if there is no space for the fuse unit 301 around the side surfaces of the battery housing 101, the fuse unit 301 can secure its installation space on the post standing surface 105 (upper surface in the vertical direction) of the battery housing 101 and arrange the fusible link 2 thereon. Consequently, the fuse unit 301 can appropriately provide the fusible link 2.

The fuse unit 301 further includes the locking force adjustment mechanisms 308 that can adjust the locking force of the locking claws 41 and 42 locking the protector 3 onto the post standing surface 105. After the protector 3 is attached onto the post standing surface 105, the fuse unit 301 causes the locking force adjustment mechanisms 308 to relatively increase the locking force of the locking claws 41 and 42. Consequently, the fuse unit 301 can lock the protector 3 onto the post standing surface 105 together with the fusible link 2 more reliably.

In the fuse unit 301, the locking claws 41 and 42 are formed separately from the protector 3 and supported by the protector 3 in a manner capable of moving closer to and away from the battery housing 101. The locking force adjustment mechanisms 308 each include the first cog 308*a* and the second cogs 308*b*. The first cog 308*a* is formed on one of the protector 3 side and the locking claws 41 and 42 side. The second cogs 308*b* are formed on the other of the protector 3 side and the locking claws 41 and 42 side in a manner aligned in the direction closer to or away from the battery housing 101. The first cog 308*a* engages with one of the second cogs 308*b*, thereby restricting the movement of the locking claws 41 and 42 toward the side away from the battery housing 101 and relatively increasing the locking force. The fuse unit 301 uses the mechanism that the first cog 308*a* engages with one of the second cogs 308*b* in the locking force adjustment mechanisms 308, thereby restricting the movement of the locking claws 41 and 42 toward the side away from the battery housing 101. Consequently, the fuse unit 301 relatively increases the force of the locking claws 41 and 42 engaging with the lid member 104 of the battery housing 101. The fuse unit 301 thus can relatively increase the locking force of the locking claws 41 and 42 locking the protector 3 onto the post standing surface 105 and maintain this state. As a result, the fuse unit 301 can relatively strengthen the force (that is, the locking force) of the locking claws 41 and 42 fastening the lid member 104 of the battery housing 101. Consequently, the fuse unit 301 can lock the protector 3 onto the post standing surface 105 more reliably and absorb the tolerance by the locking force adjustment mechanisms 308.

In the description above, the first cog 308*a* is formed on the protector 3 side, and the second cogs 308*b* are formed on the supported structures 341*b* and 342*b* on the locking claws 41 and 42 side, respectively, in the locking force adjustment mechanisms 308. Alternatively, the first cog 308*a* may be formed on the supported structures 341*b* and 342*b* on the locking claws 41 and 42 side, respectively, and the second cogs 308*b* may be formed on the protector 3 side. In the locking force adjustment mechanisms 308, the first cog 308*a* may be provided in plurality in a manner aligned in the direction closer to or away from the battery housing 101.

As illustrated in the modification in FIG. 20, the locking force adjustment mechanisms 308 may be used in the fuse unit 201 to provide a fuse unit 301A. Also in this case, the fuse unit 301A can lock the protector 3 onto the post standing surface 105 more reliably.

Fourth Embodiment

Figure 21:
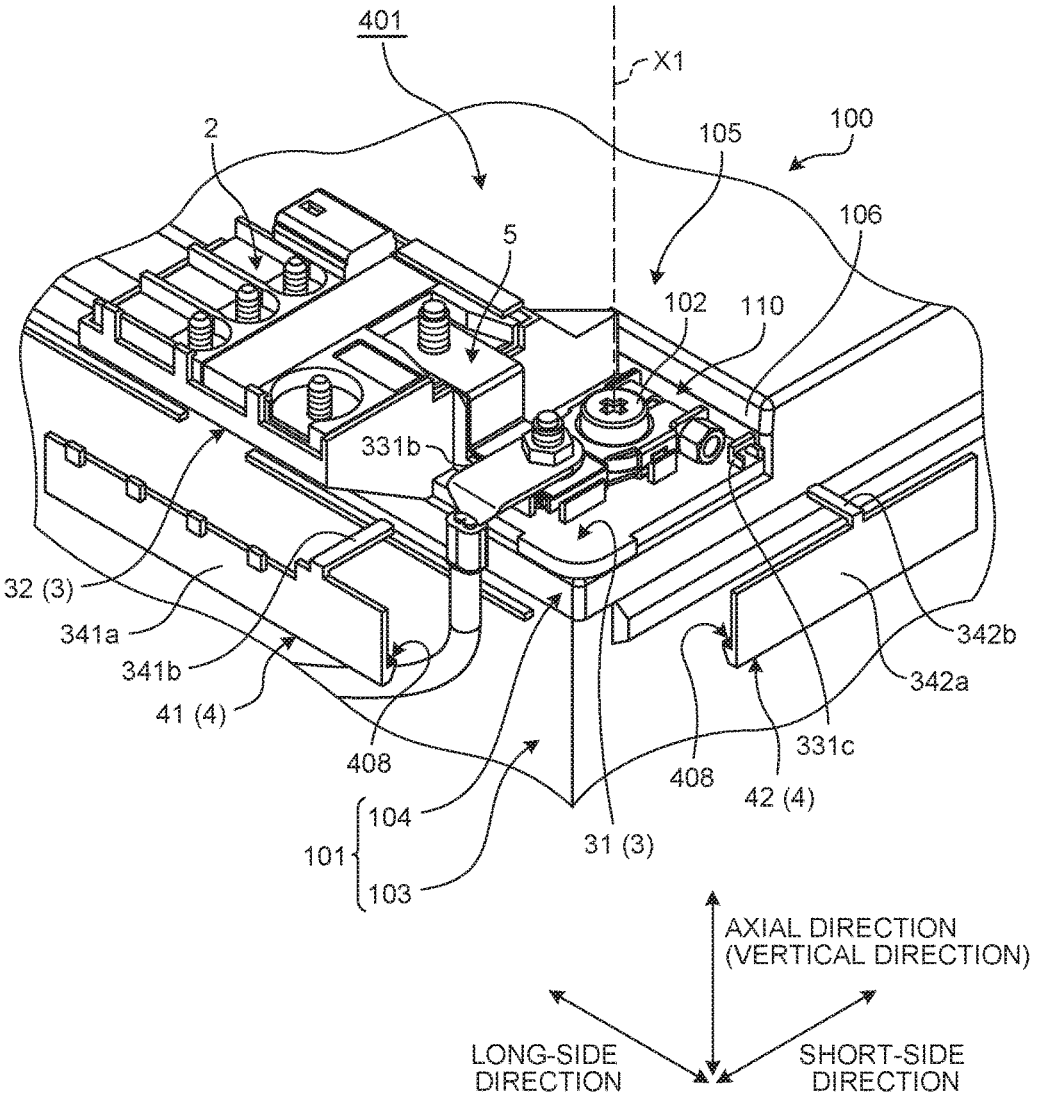
FIG. 21 is an exploded perspective view illustrating a part near a locking force adjustment mechanism of a fuse unit according to a fourth embodiment.
Figure 22:
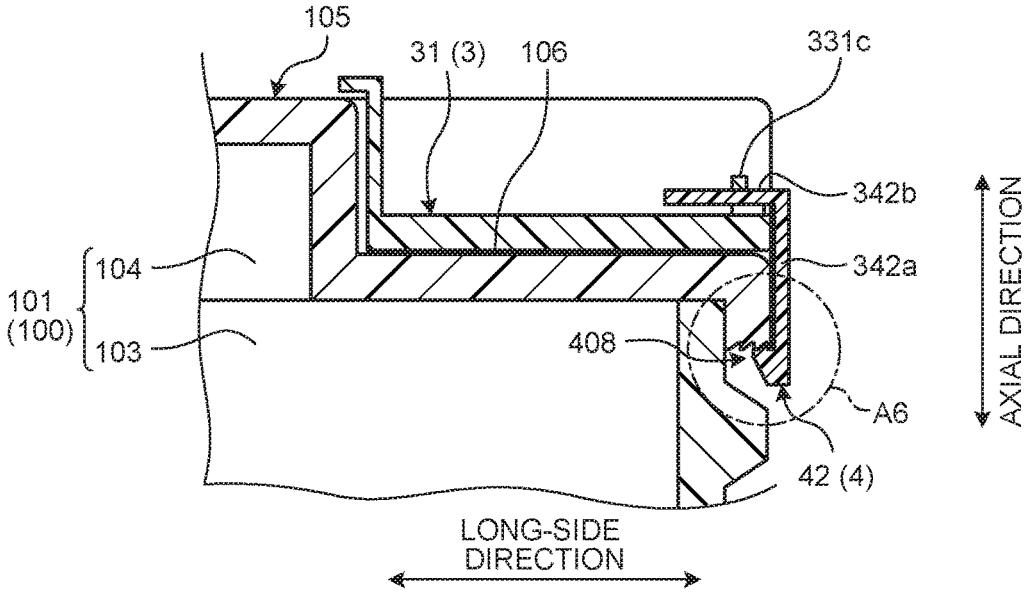
FIG. 22 is a partial sectional view along the long-side direction including the locking claw of the fuse unit according to the fourth embodiment.
Figure 23:
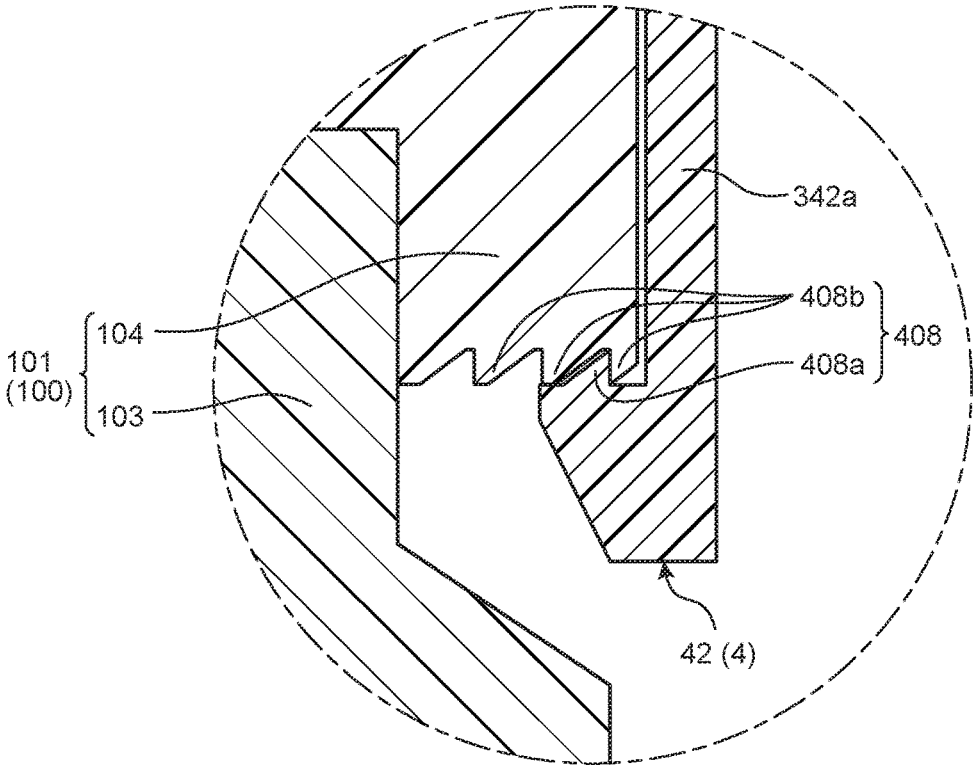
FIG. 23 is an enlarged partial sectional view of a part inside the surrounding line A6 in FIG. 22.
Figure 24:
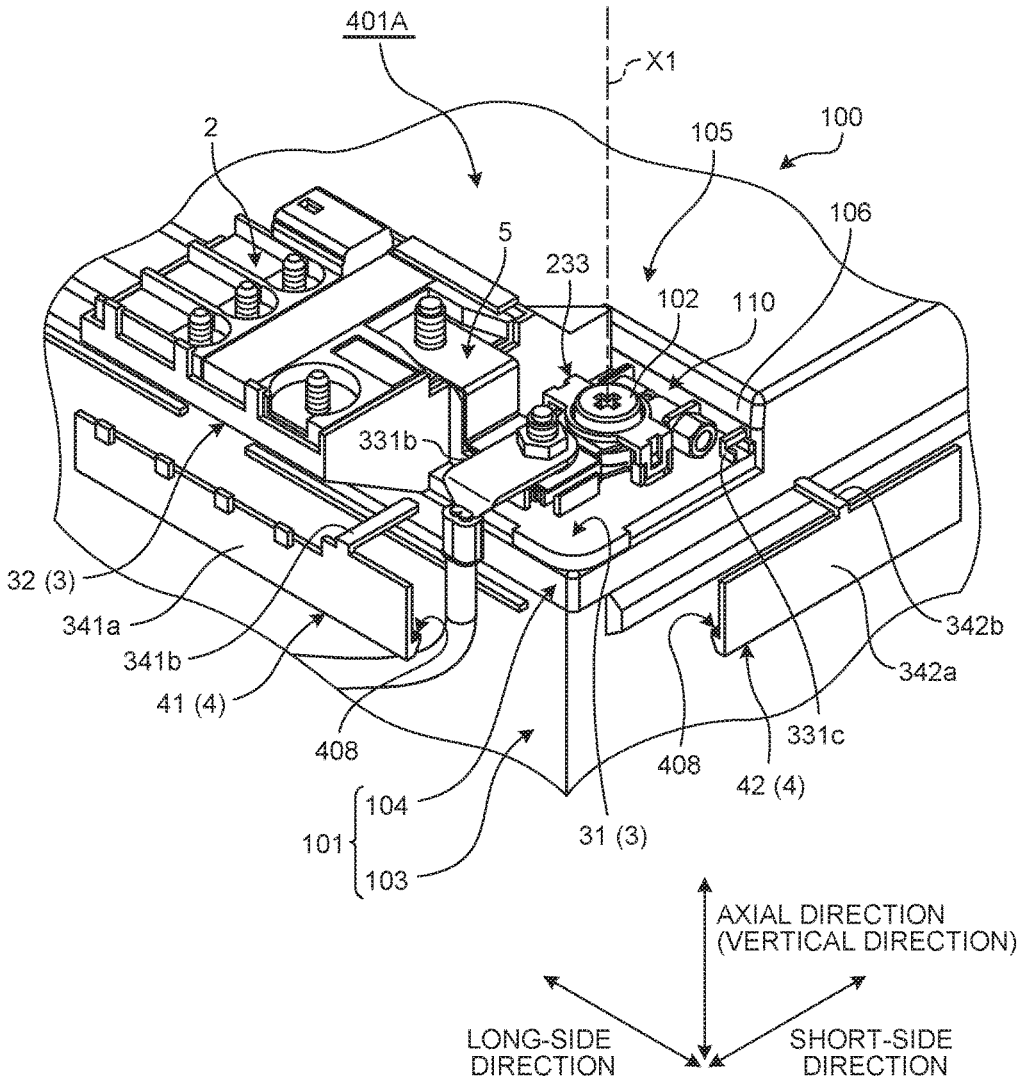
FIG. 24 is an exploded perspective view illustrating the part near the locking force adjustment mechanism of a fuse unit according to a modification.

FIG. 21 is an exploded perspective view illustrating a part near a locking force adjustment mechanism of a fuse unit according to a fourth embodiment. FIG. 22 is a partial sectional view along the long-side direction including the locking claw of the fuse unit according to the fourth embodiment. FIG. 23 is an enlarged partial sectional view of a part inside the surrounding line A6 in FIG. 22. FIG. 24 is an exploded perspective view illustrating the part near the locking force adjustment mechanism of a fuse unit according to a modification. The fuse unit according to the fourth embodiment is different from the third embodiment in the positions where the locking force adjustment mechanisms are provided. Overlapping explanation of other components, actions, and effects common to the embodiments above will be omitted as much as possible. The schematic configuration will be described with reference to other figures as appropriate.

As illustrated in FIGS. 21, 22, and 23, a fuse unit 401 according to the present embodiment includes, in addition to the fusible link 2, the protector 3 serving as the holding mechanism, the locking mechanism 4, and the coupling bus bar 5, locking force adjustment mechanisms 408. The locking force adjustment mechanisms 408 can adjust the locking force of the locking claws 41 and 42 in the locking mechanism 4 locking the protector 3 onto the post standing surface 105.

The locking force adjustment mechanisms 408 according to the present embodiment are provided to an engagement portion between the locking claw 41 and the lid member 104 of the battery housing 101 and an engagement portion between the locking claw 42 and the lid member 104 of the battery housing 101. Because the structures of the locking force adjustment mechanisms 408 are substantially the same, the following describes the locking force adjustment mechanism 408 on the locking claw 42 side, and explanation of the locking force adjustment mechanism 408 on the locking claw 41 side is omitted.

The locking force adjustment mechanisms 408 each have a first cog 408*a* and a plurality of second cogs 408*b*. The first cog 408*a* is formed on one of the battery housing 101 side and the locking claws 41 and 42 side. The second cogs 408*b* are formed on the other of the battery housing 101 side and the locking claws 41 and 42 side in a manner aligned in a direction in which the locking claws 41 and 42 move closer to or away from the battery housing 101.

In the locking force adjustment mechanism 408 on the locking claw 42 side, as illustrated in FIGS. 22 and 23 and other figures, the first cog 408*a* is formed on the upper surface in the vertical direction of the locking claw 42 (that is, the engagement surface that engages with the lower end surface in the vertical direction of the edge of the lid member 104 in the battery housing 101). The first cog 408*a* is formed as a protruding cog protruding from the upper surface in the vertical direction of the locking claw 42, and one first cog 408*a* is provided in the present embodiment. In the locking force adjustment mechanism 408, the second cogs 408*b* are formed on the lower end surface in the vertical direction of the edge of the lid member 104 in the battery housing 101 (that is, the engagement surface that engages with the upper surface in the vertical direction of the locking claw 42). The second cogs 408*b* are formed as protruding cogs protruding from the lower end surface in the vertical direction of the edge of the lid member 104. The second cogs 408*b* are aligned in the direction in which the locking claw 42 moves closer to or away from the battery housing 101, that is, in the long-side direction. The first cog 408*a* and the second cogs 408*b* are formed into the following sectional shape: when the locking claw 42 and the plate-like portion 342*a* are moved in the direction closer to the battery housing 101, and the supported structure 342*b* is moved and thrusted into the supporting portion 331*c* in the long-side direction, the second cogs 408*b* climb over the first cog 408*a*; and when the locking claw 42 and the plate-like portion 342*a* are moved in the direction away from the battery housing 101, and the supported structure 342*b* is tried to be pulled out from the supporting portion 331*c* in the long-side direction, one of the second cogs 408*b* comes into contact with the first cog 408*a*, thereby restricting the movement of the supported structure 342*b*. The locking force adjustment mechanism 408 on the locking claw 41 side has substantially the same structure as that of the locking force adjustment mechanism 408 on the locking claw 42 side except that the second cogs 408*b* are formed on the upper surface in the vertical direction of the locking claw 41 (that is, the engagement surface that engages with the lower end surface in the vertical direction of the edge of the lid member 104 in the battery housing 101) and that the second cogs 408*b* are aligned in the short-side direction.

The locking force adjustment mechanisms 408 having the structure described above cause the first cog 408*a* to engage with one of the second cogs 408*b*, thereby restricting the movement of the locking claws 41 and 42 toward the side away from the battery housing 101. By using the mechanism described above, the locking force adjustment mechanism 408 on the locking claw 41 side moves the locking claw 41 and the plate-like portion 341*a* in the direction closer to the battery housing 101 and thrusts the locking claw 41 as much as possible. The locking force adjustment mechanism 408 thus relatively increases the force of the locking claw 41 engaging with the lid member 104 of the battery housing 101. As a result, the locking force adjustment mechanism 408 can relatively increase the locking force of the locking claw 41 locking the protector 3 onto the post standing surface 105 and maintain this state. Similarly, the locking force adjustment mechanism 408 on the locking claw 42 side moves the locking claw 42 and the plate-like portion 342*a* in the direction closer to the battery housing 101 and thrusts the locking claw 42 as much as possible. The locking force adjustment mechanism 408 thus relatively increases the force of the locking claw 42 engaging with the lid member 104 of the battery housing 101. As a result, the locking force adjustment mechanism 408 can relatively increase the locking force of the locking claw 42 locking the protector 3 onto the post standing surface 105 and maintain this state.

In the fuse unit 401, the holding portion 32 formed next to the base portion 31 of the protector 3 holds the fusible link 2 above the post standing surface 105 of the battery housing 101. As a result, the fuse unit 401 receives the load of the fusible link 2 on the post standing surface 105. This structure can suppress the load acting on the battery terminal 110 from the fuse unit 401, thereby suppressing the load acting on the battery post 102. At this time, the fuse unit 401 can cause the locking mechanism 4 to reliably attach the protector 3 onto the post standing surface 105 together with the fusible link 2. Even if there is no space for the fuse unit 401 around the side surfaces of the battery housing 101, the fuse unit 401 can secure its installation space on the post standing surface 105 (upper surface in the vertical direction) of the battery housing 101 and arrange the fusible link 2 thereon. Consequently, the fuse unit 401 can appropriately provide the fusible link 2.

After the protector 3 is attached onto the post standing surface 105, the fuse unit 401 causes the locking force adjustment mechanisms 408 to relatively increase the locking force of the locking claws 41 and 42. Consequently, the fuse unit 401 can attach the protector 3 onto the post standing surface 105 together with the fusible link 2 more reliably.

In the fuse unit 401, the locking claws 41 and 42 are formed separately from the protector 3 and supported by the protector 3 in a manner capable of moving closer to and away from the battery housing 101. The locking force adjustment mechanisms 408 each include the first cog 408*a* and the second cogs 408*b*. The first cog 408*a* is formed on one of the battery housing 101 side and the locking claws 41 and 42 side. The second cogs 408*b* are formed on the other of the battery housing 101 side and the locking claws 41 and 42 side in a manner aligned in the direction closer to or away from the battery housing 101. The first cog 408*a* engages with one of the second cogs 408*b*, thereby restricting the movement of the locking claws 41 and 42 toward the side away from the battery housing 101 and relatively increasing the locking force. The fuse unit 401 uses the mechanism that the first cog 408*a* engages with one of the second cogs 408*b* in the locking force adjustment mechanisms 408, thereby restricting the movement of the locking claws 41 and 42 toward the side away from the battery housing 101. Consequently, the fuse unit 401 relatively increases the force of the locking claws 41 and 42 engaging with the lid member 104 of the battery housing 101. The fuse unit 401 thus can relatively increase the locking force of the locking claws 41 and 42 locking the protector 3 onto the post standing surface 105 and maintain this state. As a result, the fuse unit 401 can relatively strengthen the force (that is, the locking force) of the locking claws 41 and 42 fastening the lid member 104 of the battery housing 101. Consequently, the fuse unit 401 can lock the protector 3 onto the post standing surface 105 more reliably and absorb the tolerance by the locking force adjustment mechanisms 408.

In the description above, the first cog 408*a* is formed on the locking claws 41 and 42, and the second cogs 408*b* are formed on the battery housing 101 in the locking force adjustment mechanisms 408. Alternatively, the first cog 408*a* may be formed on the battery housing 101, and the second cogs 408*b* may be formed on the locking claws 41 and 42. In the locking force adjustment mechanisms 408, the first cog 408*a* may be provided in plurality in a manner aligned in the direction closer to or away from the battery housing 101.

As illustrated in the modification in FIG. 24, the locking force adjustment mechanisms 408 may be used in the fuse unit 201 to provide a fuse unit 401A. Also in this case, the fuse unit 401A can lock the protector 3 onto the post standing surface 105 more reliably.

Fifth Embodiment

Figure 25:
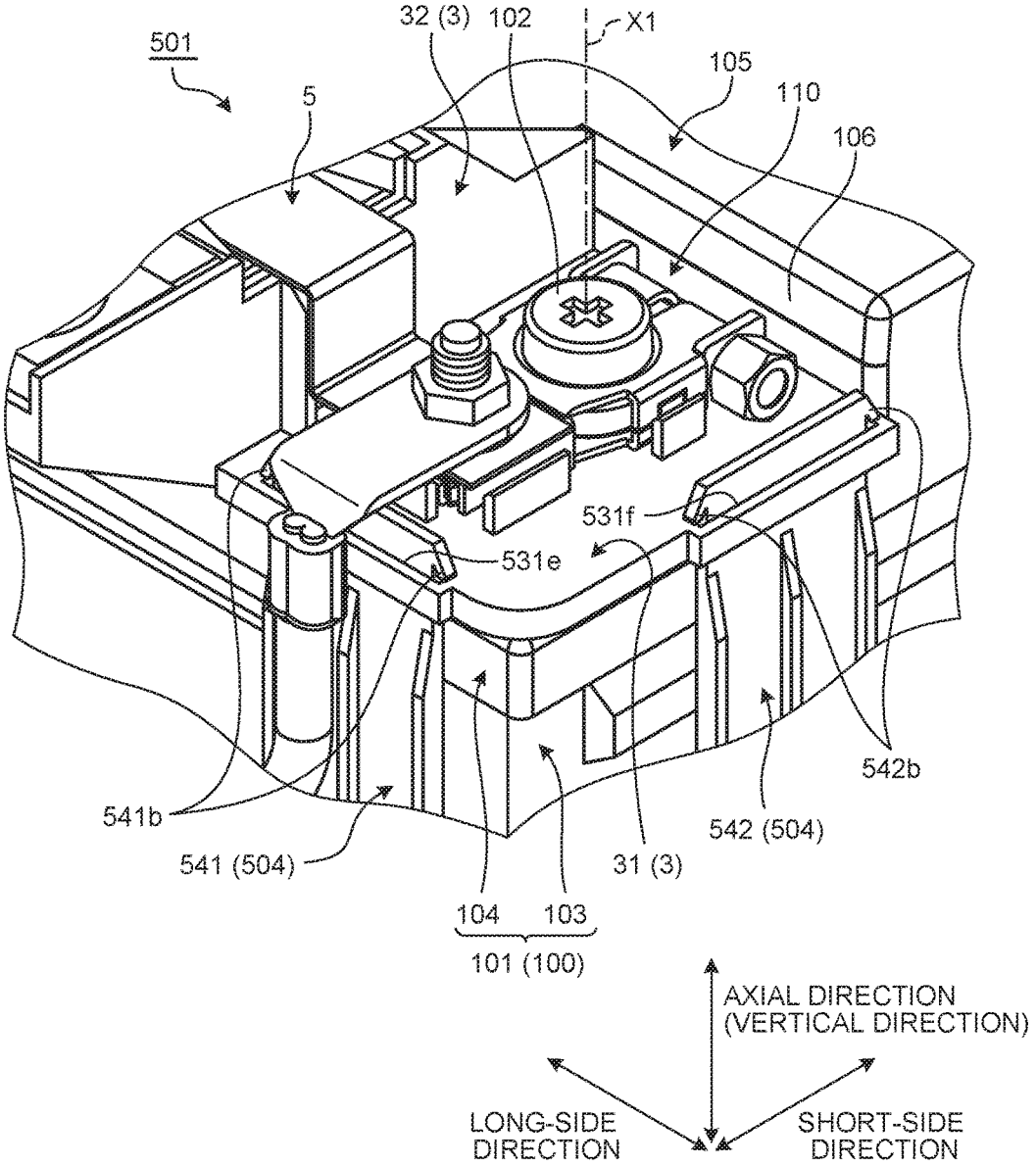
FIG. 25 is a partial perspective view illustrating a part near a locking mechanism of a fuse unit according to a fifth embodiment.
Figure 26:
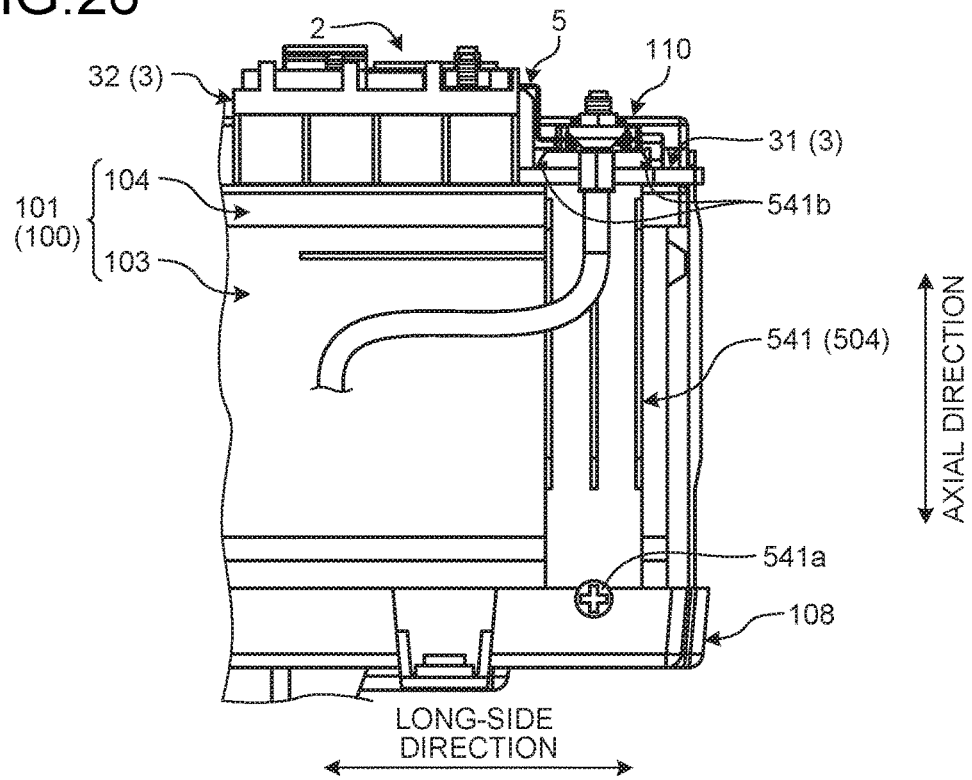
FIG. 26 is a partial side view of the part near the locking mechanism of the fuse unit according to the fifth embodiment viewed in the short-side direction.
Figure 27:
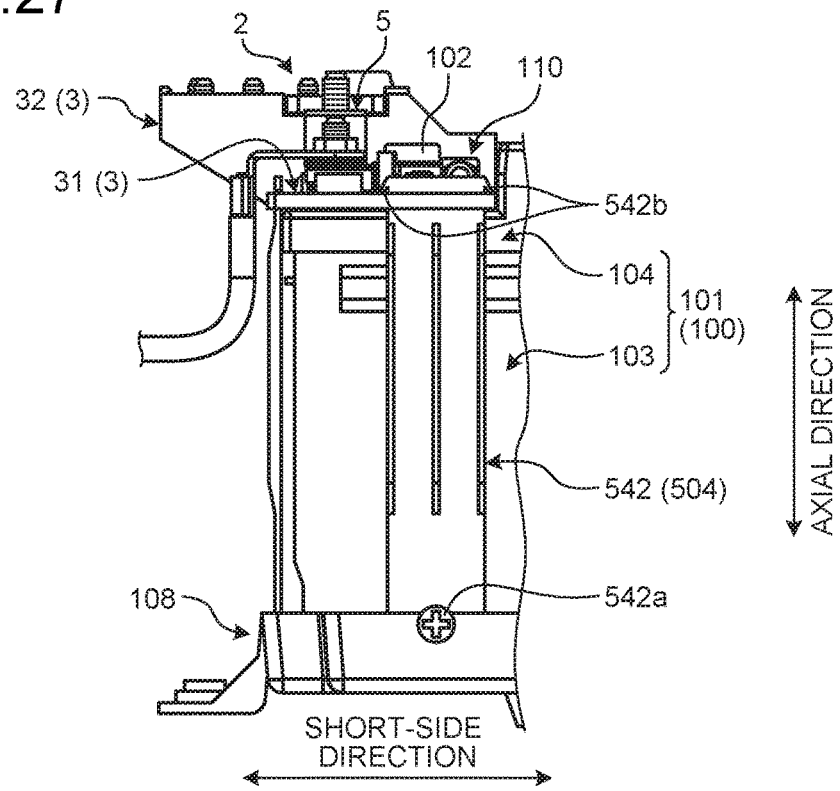
FIG. 27 is a partial side view of the part near the locking mechanism of the fuse unit according to the fifth embodiment viewed in the long-side direction.
Figure 28:
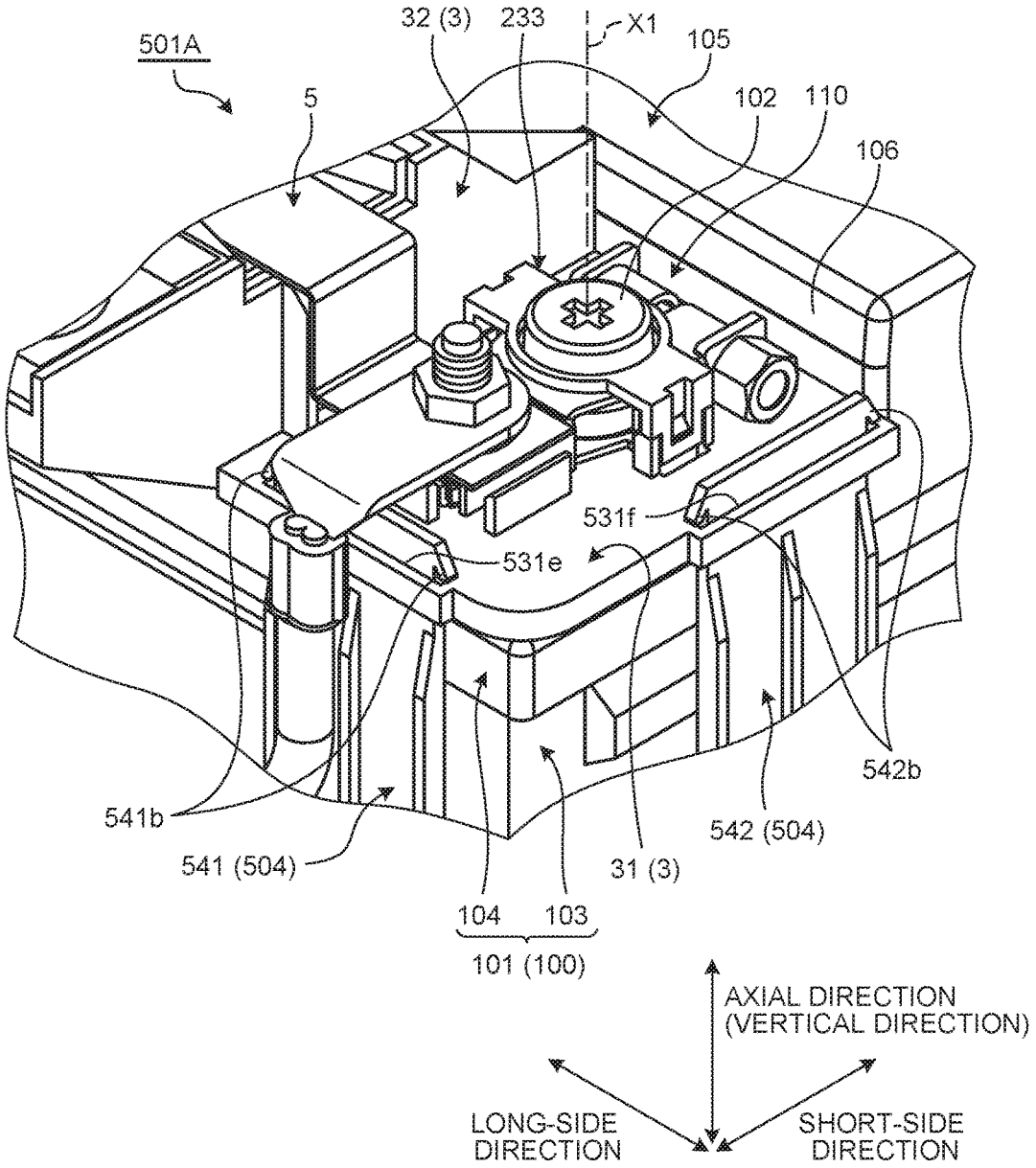
FIG. 28 is a partial perspective view illustrating the part near the locking mechanism of a fuse unit according to a modification.

FIG. 25 is a partial perspective view illustrating a part near a locking mechanism of a fuse unit according to a fifth embodiment. FIG. 26 is a partial side view of the part near the locking mechanism of the fuse unit according to the fifth embodiment viewed in the short-side direction. FIG. 27 is a partial side view of the part near the locking mechanism of the fuse unit according to the fifth embodiment viewed in the long-side direction. FIG. 28 is a partial perspective view illustrating the part near the locking mechanism of a fuse unit according to a modification. The fuse unit according to the fifth embodiment is different from the first embodiment in the structure of the locking mechanism. Overlapping explanation of other components, actions, and effects common to the embodiments above will be omitted as much as possible. The schematic configuration will be described with reference to other figures as appropriate.

As illustrated in FIGS. 25, 26, and 27, a fuse unit 501 according to the present embodiment includes the fusible link 2, the protector 3 serving as the holding mechanism, a locking mechanism 504, and the coupling bus bar 5.

The locking mechanism 504 locks the protector 3 onto the post standing surface 105. The locking mechanism 504 according to the present embodiment includes couplers 541 and 542. The couplers 541 and 542 couple the mounting tray 108 serving as a member to be coupled to the protector 3, thereby locking the protector 3 onto the post standing surface 105. As described above, the mounting tray 108 is a member provided on the lower side in the vertical direction of the battery 100 and used to mount the battery 100 at a predetermined position in a vehicle. In other words, the mounting tray 108 is a fixing member different from the battery housing 101 and fixed to a predetermined position in a vehicle.

The couplers 541 and 542 are belt-like members provided separately from the protector 3. The couplers 541 and 542 are made of an insulating resin material and formed into a plate shape. In the attached state, the coupler 541 couples the edge along the long-side direction of the base portion 31 of the protector 3 to the mounting tray 108. In the attached state, the coupler 542 couples the edge along the short-side direction of the base portion 31 of the protector 3 to the mounting tray 108.

The coupling form of the couplers 541 and 542 to the base portion 31 and the coupling form of the couplers 541 and 542 to the mounting tray 108 may be various coupling forms. In the present embodiment, the couplers 541 and 542 are coupled to the mounting tray 108 with their lower ends in the vertical direction fastened to the mounting tray 108 by bolts 541*a* and 542*a*, respectively. The upper ends in the vertical direction of the couplers 541 and 542 are inserted into engagement holes 531*e* and 531*f*, respectively, formed at the edge along the long-side direction and the edge along the short-side direction of the base portion 31. The couplers 541 and 542 cause engaging claws 541*b* and 542*b* formed at the upper ends in the vertical direction to engage with the edges of the engagement holes 531*e* and 531*f*, respectively, thereby coupling the upper ends in the vertical direction to the base portion 31. The couplers 541 and 542 extend in the vertical direction with the base portion 31 of the protector 3 coupled to the mounting tray 108. The locking mechanism 504 causes the couplers 541 and 542 to couple the base portion 31 of the protector 3 to the mounting tray 108 with the protector 3 attached onto the post standing surface 105 of the battery 100. As a result, the locking mechanism 504 can lock the protector 3 onto the post standing surface 105.

In the fuse unit 501, the holding portion 32 formed next to the base portion 31 of the protector 3 holds the fusible link 2 above the post standing surface 105 of the battery housing 101. As a result, the fuse unit 501 receives the load of the fusible link 2 on the post standing surface 105. This structure can suppress the load acting on the battery terminal 110 from the fuse unit 501, thereby suppressing the load acting on the battery post 102. At this time, the fuse unit 501 can cause the locking mechanism 504 to reliably attach the protector 3 onto the post standing surface 105 together with the fusible link 2. Even if there is no space for the fuse unit 501 around the side surfaces of the battery housing 101, the fuse unit 501 can secure its installation space on the post standing surface 105 (upper surface in the vertical direction) of the battery housing 101 and arrange the fusible link 2 thereon. Consequently, the fuse unit 501 can appropriately provide the fusible link 2.

The fuse unit 501 can cause the locking mechanism 504 to reliably attach the protector 3 onto the post standing surface 105 together with the fusible link 2.

In the fuse unit 501, the locking mechanism 504 includes the couplers 541 and 542 that couple the mounting tray 108 serving as a member to be coupled other than the battery housing 101 to the protector 3, thereby locking the protector 3 onto the post standing surface 105. The fuse unit 501 causes the couplers 541 and 542 to couple the protector 3 to the mounting tray 108, thereby locking the protector 3 onto the post standing surface 105 together with the fusible link 2. Consequently, the fuse unit 501 can increase the versatility and absorb the tolerance by the couplers 541 and 542.

While the member to be coupled other than the battery housing 101 is the mounting tray 108 in the description above, the present embodiment is not limited thereto. The member to be coupled simply needs to be able to support and reliably lock the protector 3 onto the post standing surface 105 with the couplers 541 and 542. The member to be coupled may be a structural member of a vehicle, for example.

The coupling form of the couplers 541 and 542 to the protector 3 and the mounting tray 108 is not limited to the form described above. The couplers 541 and 542, for example, may be coupled to the base portion 31 of the protector 3 with their upper ends in the vertical direction fastened to the base portion 31 by bolts or the like. The couplers 541 and 542, for example, may be coupled to the mounting tray 108 with their lower ends in the vertical direction inserted into a gap between the mounting tray 108 and the housing body 103 and pressed against the mounting tray 108 by an elastic member or the like.

As illustrated in the modification in FIG. 28, the locking mechanism 504 may be used in the fuse unit 201 to provide a fuse unit 501A. Also in this case, the fuse unit 501A causes the couplers 541 and 542 to couple the protector 3 to the mounting tray 108, thereby locking the protector 3 onto the post standing surface 105. Consequently, the fuse unit 501A can lock the protector 3 onto the post standing surface 105 together with the fusible link 2 more reliably.

Sixth Embodiment

Figure 29:
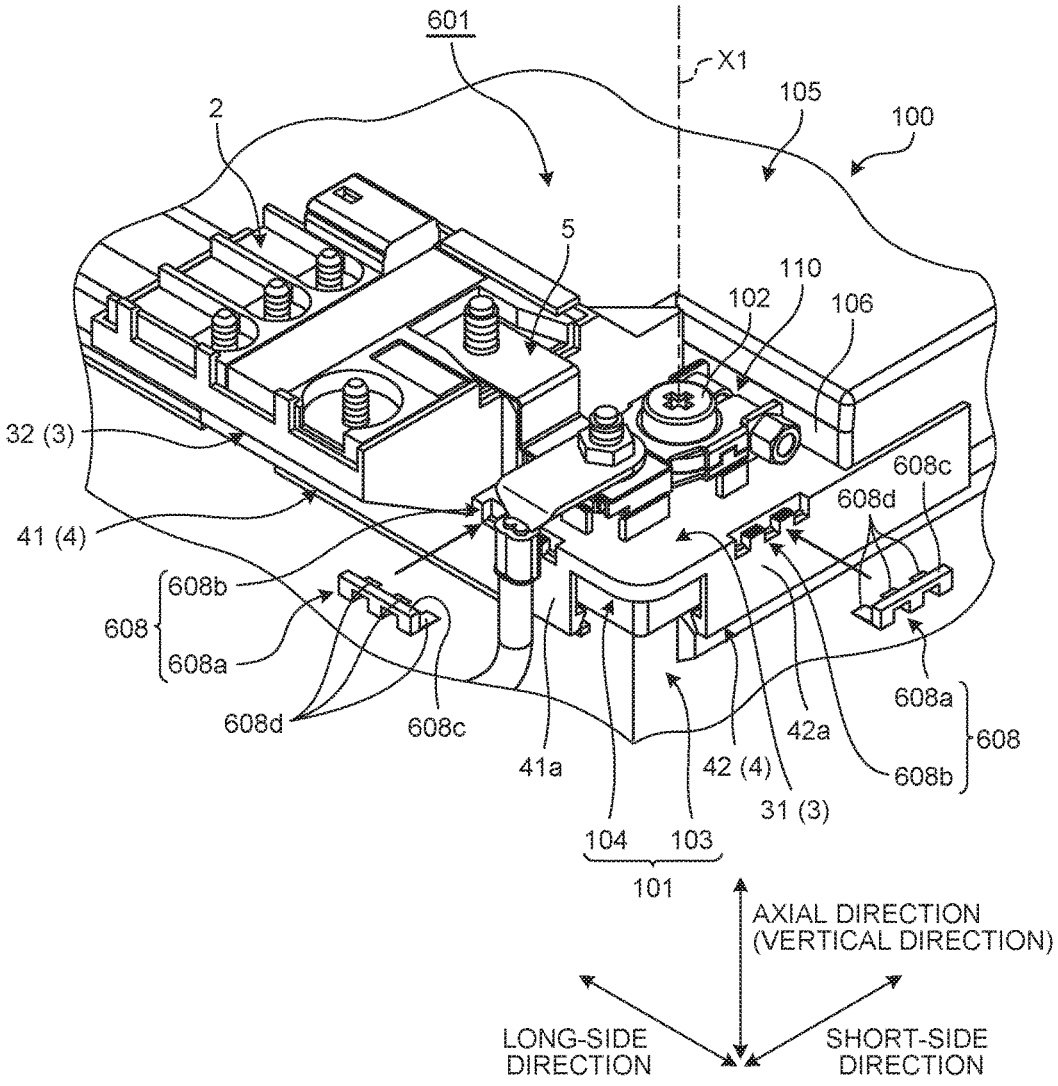
FIG. 29 is an exploded perspective view illustrating a part near a locking force adjustment mechanism of a fuse unit according to a sixth embodiment.
Figure 30:
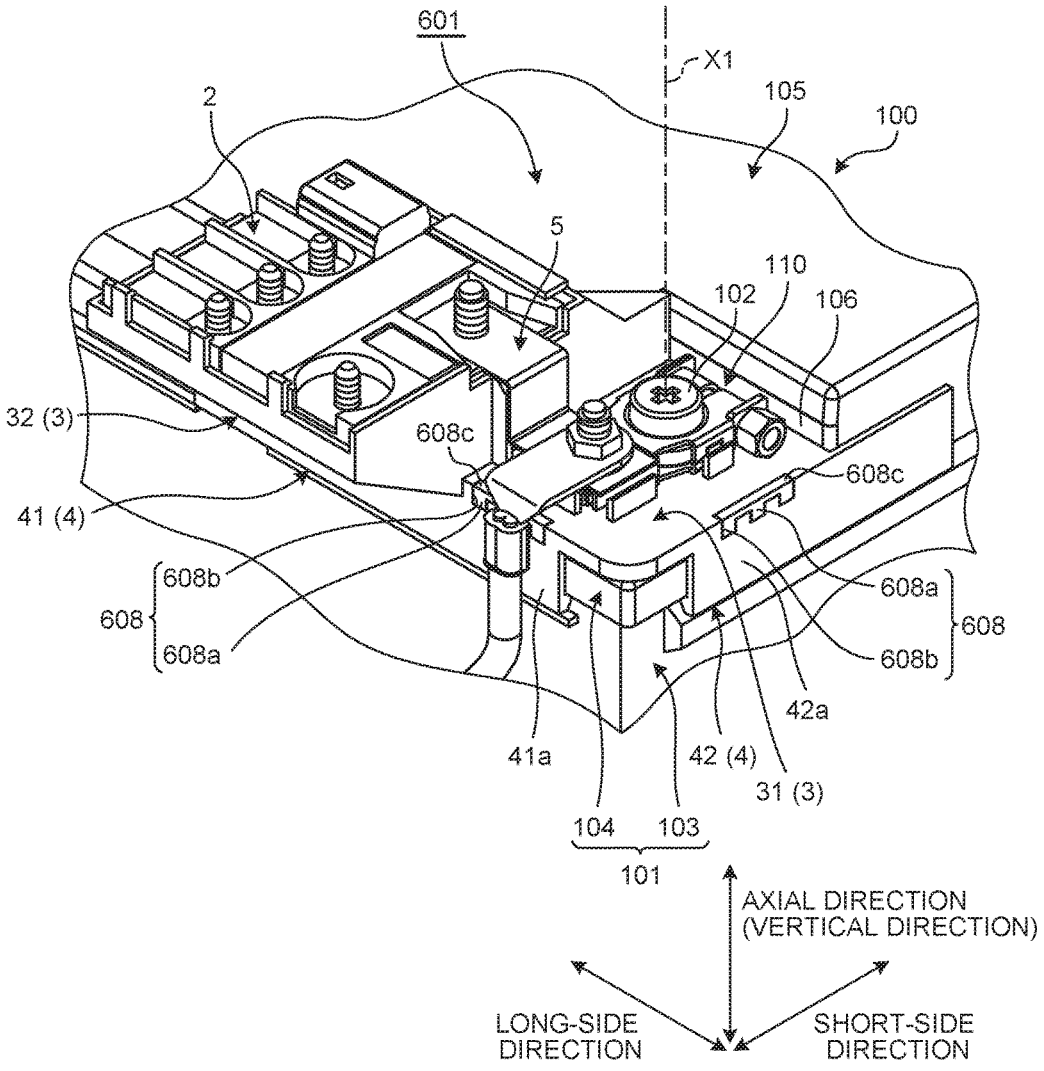
FIG. 30 is a partial perspective view illustrating the part near the locking force adjustment mechanism of the fuse unit according to the sixth embodiment.
Figure 31:
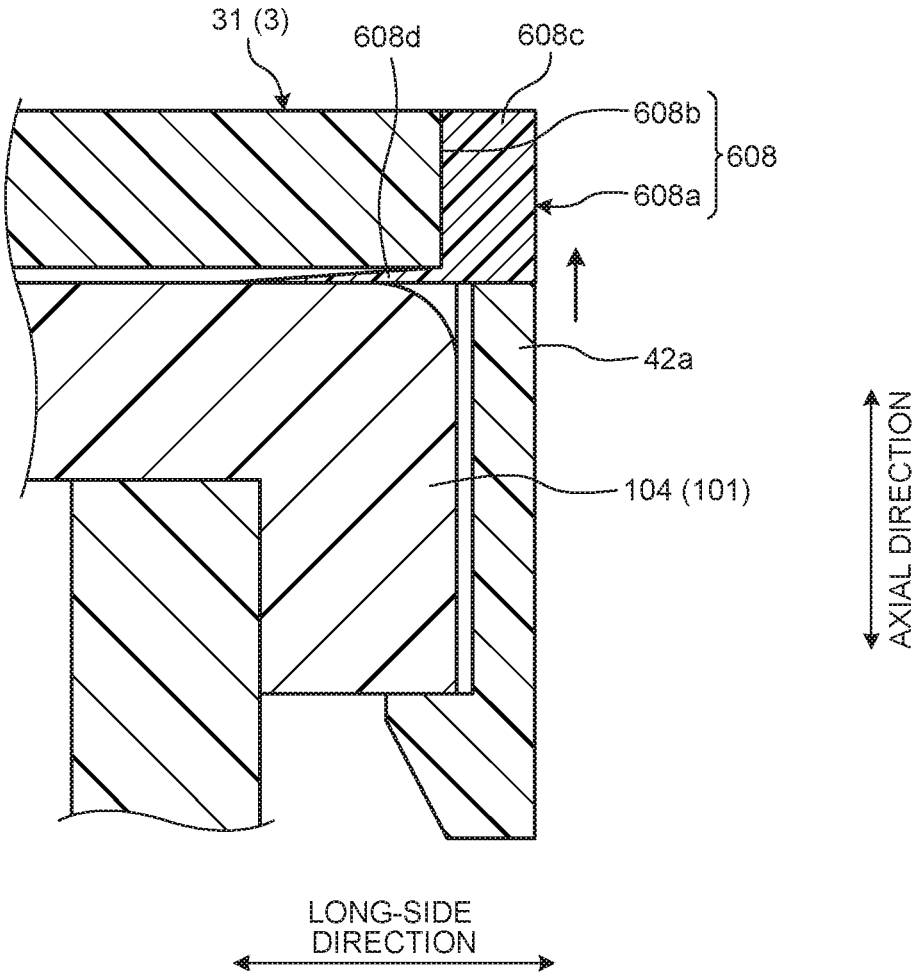
FIG. 31 is a partial sectional view including a wedge member of the fuse unit according to the sixth embodiment.

FIG. 29 is an exploded perspective view illustrating a part near a locking force adjustment mechanism of a fuse unit according to a sixth embodiment. FIG. 30 is a partial perspective view illustrating the part near the locking force adjustment mechanism of the fuse unit according to the sixth embodiment. FIG. 31 is a partial sectional view including a wedge member of the fuse unit according to the sixth embodiment. The fuse unit according to the sixth embodiment is different from the third embodiment in the structure of the locking force adjustment mechanisms. Overlapping explanation of other components, actions, and effects common to the embodiments above will be omitted as much as possible. The schematic configuration will be described with reference to other figures as appropriate.

As illustrated in FIGS. 29, 30, and 31, a fuse unit 601 according to the present embodiment includes, in addition to the fusible link 2, the protector 3 serving as the holding mechanism, the locking mechanism 4, and the coupling bus bar 5, locking force adjustment mechanisms 608. The locking force adjustment mechanisms 608 can adjust the locking force of the locking claws 41 and 42 in the locking mechanism 4 locking the protector 3 onto the post standing surface 105.

Similarly to the first embodiment, the locking claws 41 and 42 according to the present embodiment are formed integrally with the base portion 31 and the holding portion 32 of the protector 3 via the plate-like portions (arm portions) 41*a* and 42*a*, respectively, extending in the vertical direction in the attached state. The locking claws 41 and 42 engage with the lower end surfaces in the vertical direction of the edges of the lid member 104 in the battery housing 101. The locking mechanism 4 causes the locking claws 41 and 42 to engage with the lower end surfaces in the vertical direction of the lid member 104 at predetermined positions when the protector 3 is attached onto the post standing surface 105 of the battery 100. As a result, the locking mechanism 4 can fix and lock the protector 3 onto the post standing surface 105.

The locking force adjustment mechanisms 608 according to the present embodiment are provided to a part corresponding to the locking claw 41 and a part corresponding to the locking claw 42. The partial sectional view in FIG. 31 illustrates the locking force adjustment mechanism 608 on the locking claw 42 side. Because the locking force adjustment mechanism 608 on the locking claw 41 side has substantially the same structure as that on the locking claw 42 side, illustration thereof is omitted.

The locking force adjustment mechanisms 608 each include a wedge member 608*a* interposed between the protector 3 and the battery housing 101. The locking force adjustment mechanisms 608 each have an insertion hole 608*b* that enables the wedge member 608*a* to be inserted between the protector 3 and the battery housing 101.

The wedge members 608*a* each have a rectangular rod-shaped base portion 608*c* and a wedge portion 608*d* formed integrally with the base portion 608*c*. The wedge portion 608*d* protrudes from the base portion 608*c* serving as the proximal end and has a tapered shape toward the distal end. The wedge portion 608*d* extends from the base portion 608*c* in a manner divided into three. The insertion holes 608*b* are formed at parts where the plate-like portions 41*a* and 42*a* intersect with the base portion 31.

More specifically, the insertion hole 608*b* of the locking force adjustment mechanism 608 on the locking claw 41 side is formed at a connection part between the plate-like portion 41*a* and the edge along the long-side direction of the base portion 31. The insertion hole 608*b* of the locking force adjustment mechanism 608 on the locking claw 41 side is formed at a position where the wedge portion 608*d* of the wedge member 608*a* can be inserted into the insertion hole 608*b* in the short-side direction and where the distal end of the wedge portion 608*d* is inserted between the lid member 104 of the battery housing 101 and the base portion 31 (refer to FIG. 31 and other figures).

Similarly, the insertion hole 608*b* of the locking force adjustment mechanism 608 on the locking claw 42 side is formed at a connection part between the plate-like portion 42*a* and the edge along the short-side direction of the base portion 31. The insertion hole 608*b* of the locking force adjustment mechanism 608 on the locking claw 42 side is formed at a position where the wedge portion 608*d* of the wedge member 608*a* can be inserted into the insertion hole 608*b* in the long-side direction and where the distal end of the wedge portion 608*d* is inserted between the lid member 104 of the battery housing 101 and the base portion 31 (refer to FIG. 31 and other figures).

The insertion holes 608*b* are formed into the following shape, when the wedge members 608*a* are thrusted most, the entire wedge members 608*a* are fit in the respective insertion holes 608*b* (refer to FIGS. 30 and 31 and other figures).

In the locking force adjustment mechanisms 608 having the structure described above, as illustrated in FIGS. 29 and 30, the wedge members 608*a* are inserted into the respective insertion holes 608*b*, and the distal ends of the respective wedge members 608*a* are interposed between the base portion 31 of the protector 3 and the lid member 104 of the battery housing 101. The wedge members 608*a* thus can relatively move the protector 3 with respect to the lid member 104 in a manner lifting the protector 3 in the vertical direction. As a result, the locking force adjustment mechanisms 608 can reliably thrust, toward the upper side in the vertical direction, the locking claws 41 and 42 formed integrally with the base portion 31 and the holding portion 32 of the protector 3 against the lower end surfaces in the vertical direction of the edges of the lid member 104. Consequently, the locking force adjustment mechanisms 608 can relatively increase the force of the locking claws 41 and 42 engaging with the lid member 104. By using the mechanism described above, the locking force adjustment mechanisms 608 causes the wedge members 608*a* to be interposed between the protector 3 and the battery housing 101, thereby relatively increasing the locking force of the locking claws 41 and 42 locking the protector 3 onto the post standing surface 105.

In the fuse unit 601, the holding portion 32 formed next to the base portion 31 of the protector 3 holds the fusible link 2 above the post standing surface 105 of the battery housing 101. As a result, the fuse unit 601 receives the load of the fusible link 2 on the post standing surface 105. This structure can suppress the load acting on the battery terminal 110 from the fuse unit 601, thereby suppressing the load acting on the battery post 102. At this time, the fuse unit 601 can cause the locking mechanism 4 to reliably attach the protector 3 onto the post standing surface 105 together with the fusible link 2. Even if there is no space for the fuse unit 601 around the side surfaces of the battery housing 101, the fuse unit 601 can secure its installation space on the post standing surface 105 (upper surface in the vertical direction) of the battery housing 101 and arrange the fusible link 2 thereon. Consequently, the fuse unit 601 can appropriately provide the fusible link 2.

After the protector 3 is attached onto the post standing surface 105, the fuse unit 601 causes the locking force adjustment mechanisms 608 to relatively increase the locking force of the locking claws 41 and 42. Consequently, the fuse unit 601 can lock the protector 3 onto the post standing surface 105 together with the fusible link 2 more reliably.

In the fuse unit 601, the locking claws 41 and 42 are formed integrally with the protector 3. The locking force adjustment mechanisms 608 each include the wedge member 608*a* interposed between the protector 3 and the battery housing 101. The wedge members 608*a* are interposed between the protector 3 and the battery housing 101, thereby relatively increasing the locking force. The fuse unit 601 causes the wedge members 608*a* to be interposed between the protector 3 and the battery housing 101 in the locking force adjustment mechanisms 608, thereby relatively increasing the locking force of the locking claws 41 and 42. As a result, the fuse unit 601 can relatively strengthen the force (that is, the locking force) of the locking claws 41 and 42 fastening the lid member 104 of the battery housing 101. Consequently, the fuse unit 601 can lock the protector 3 onto the post standing surface 105 more reliably and absorb the tolerance by the locking force adjustment mechanisms 608.

The locking force adjustment mechanisms 608 may be used in the fuse unit 201. Also in this case, the fuse unit 201 can lock the protector 3 onto the post standing surface 105 more reliably.

Seventh Embodiment

Figure 32:
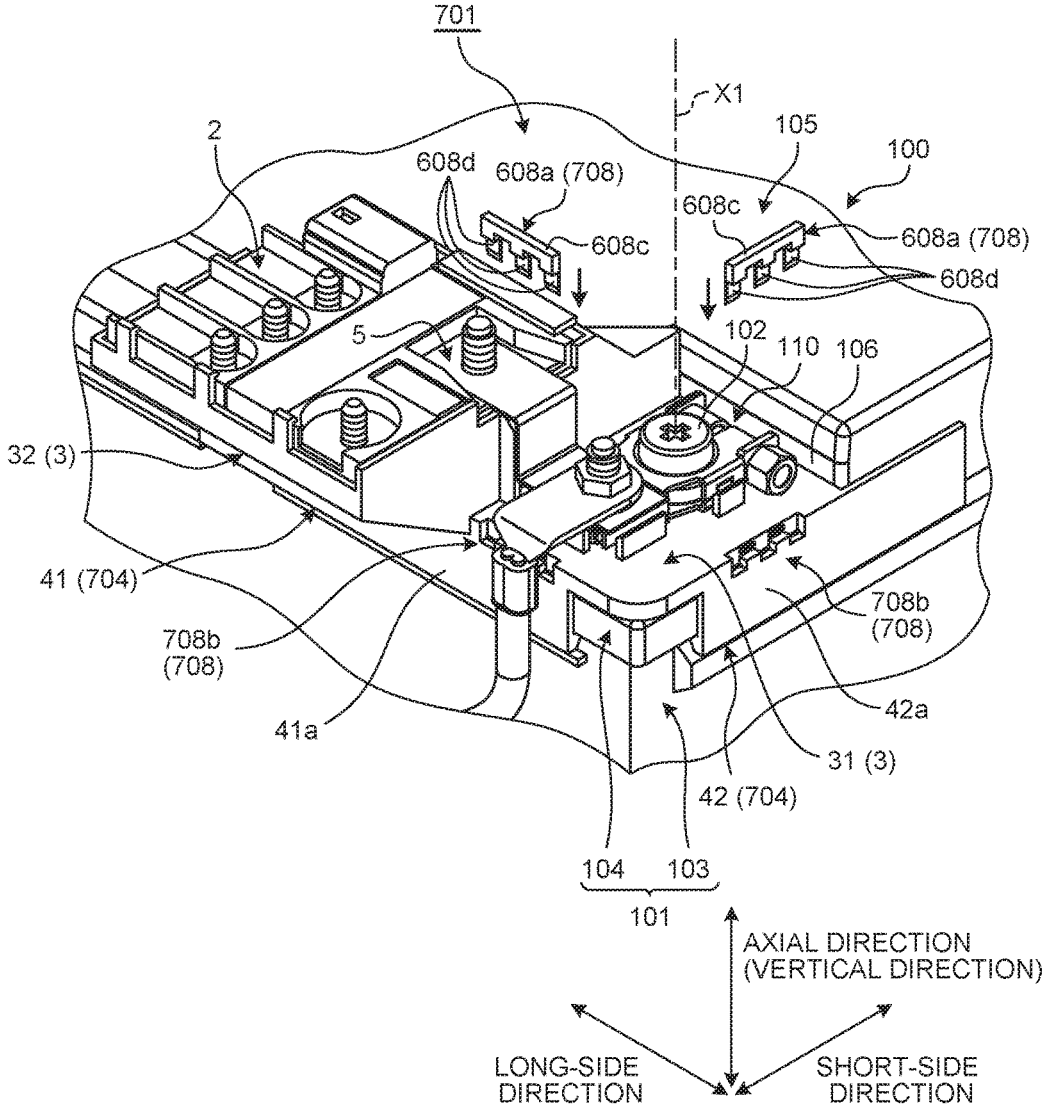
FIG. 32 is an exploded perspective view illustrating a part near a locking force adjustment mechanism of a fuse unit according to a seventh embodiment.
Figure 33:
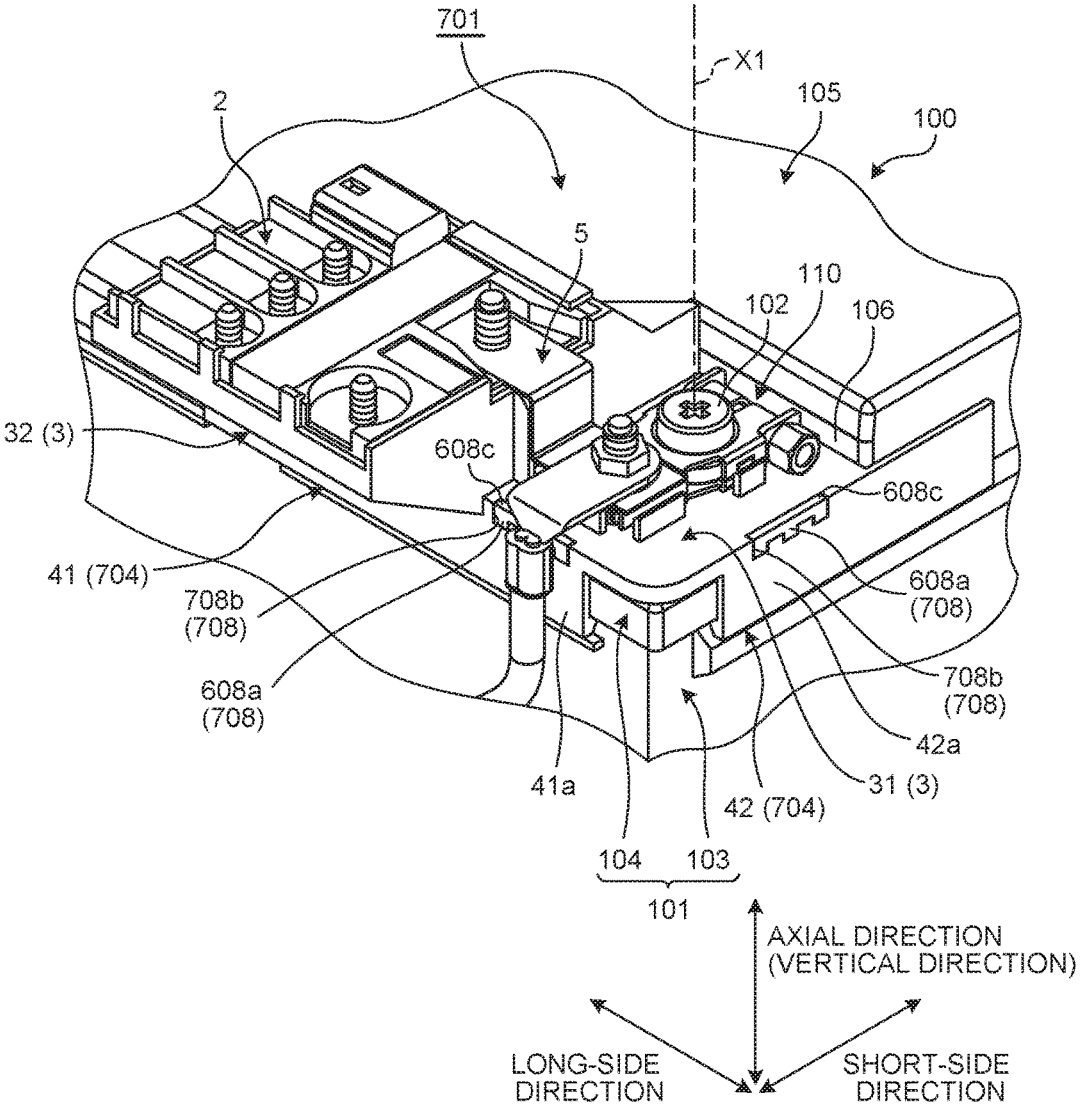
FIG. 33 is a partial perspective view illustrating the part near the locking force adjustment mechanism of the fuse unit according to the seventh embodiment.
Figure 34:
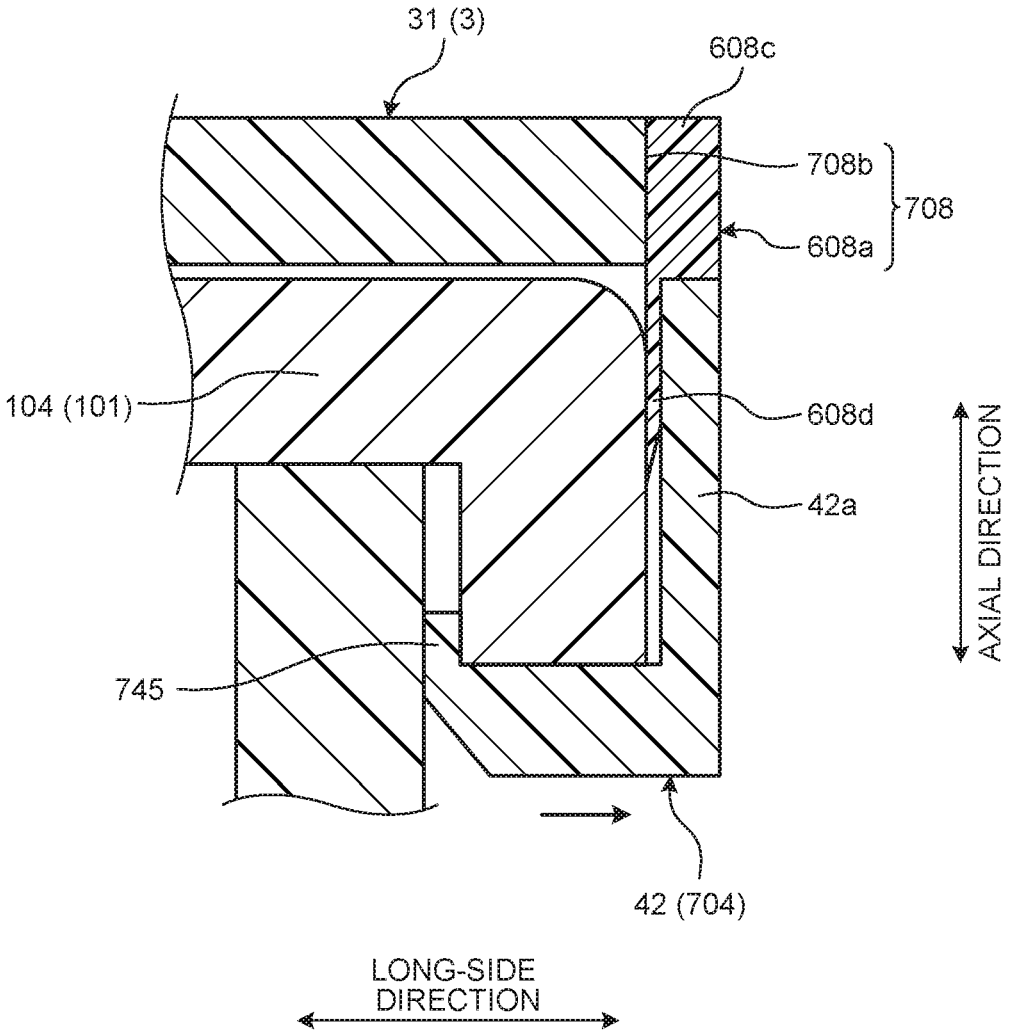
FIG. 34 is a partial sectional view including the wedge member of the fuse unit according to the seventh embodiment.

FIG. 32 is an exploded perspective view illustrating a part near a locking force adjustment mechanism of a fuse unit according to a seventh embodiment. FIG. 33 is a partial perspective view illustrating the part near the locking force adjustment mechanism of the fuse unit according to the seventh embodiment. FIG. 34 is a partial sectional view including the wedge member of the fuse unit according to the seventh embodiment. The fuse unit according to the seventh embodiment is different from the sixth embodiment in the insertion direction of the wedge member. Overlapping explanation of other components, actions, and effects common to the embodiments above will be omitted as much as possible. The schematic configuration will be described with reference to other figures as appropriate.

As illustrated in FIGS. 32, 33, and 34, a fuse unit 701 according to the present embodiment includes, in addition to the fusible link 2, the protector 3 serving as the holding mechanism, a locking mechanism 704, and the coupling bus bar 5, locking force adjustment mechanisms 708. The locking force adjustment mechanisms 708 can adjust the locking force of the locking claws 41 and 42 in the locking mechanism 704 locking the protector 3 onto the post standing surface 105.

Similarly to the first embodiment, the locking claws 41 and 42 of the locking mechanism 704 according to the present embodiment are formed integrally with the base portion 31 and the holding portion 32 of the protector 3 via the plate-like portions (arm portions) 41*a* and 42*a*, respectively, extending in the vertical direction in the attached state. The locking mechanism 704 according to the present embodiment further has a back surface protruding portion 745 at the distal end of the locking claws 41 and 42 (refer to FIG. 34). As illustrated in FIG. 34, for example, the back surface protruding portion 745 is formed as a protrusion protruding in the vertical direction (axial direction) at the distal end of the locking claw 42. The locking claw 41 also has a back surface protruding portion 745, which is not illustrated, similar to that of the locking claw 42. In the locking mechanism 704, the locking claws 41 and 42 engage with the lower end surfaces in the vertical direction of the edges of the lid member 104 as follows: the lower end in the vertical direction of the edge of the lid member 104 is sandwiched between the back surface protruding portion 745 of the locking claw 42 and the plate-like portion 42*a* in the long-side direction, and the lower end in the vertical direction of the edge of the lid member 104 is sandwiched between the back surface protruding portion 745 of the locking claw 41 and the plate-like portion 41*a* in the short-side direction. The locking mechanism 704 causes the locking claws 41 and 42 to engage with the lower end surfaces in the vertical direction of the lid member 104 at predetermined positions when the protector 3 is attached onto the post standing surface 105 of the battery 100. As a result, the locking mechanism 704 can fix and lock the protector 3 onto the post standing surface 105.

The locking force adjustment mechanisms 708 according to the present embodiment are provided to a part corresponding to the locking claw 41 and a part corresponding to the locking claw 42. The partial sectional view in FIG. 34 illustrates the locking force adjustment mechanism 708 on the locking claw 42 side. Because the locking force adjustment mechanism 708 on the locking claw 41 side has substantially the same structure as that on the locking claw 42 side, illustration thereof is omitted.

The locking force adjustment mechanisms 708 each include the wedge member 608*a* interposed between a member formed integrally with the protector 3 and the battery housing 101. The locking force adjustment mechanisms 708 each have an insertion hole 708*b* that enables the wedge member 608*a* to be inserted between the member formed integrally with the protector 3 and the battery housing 101. The wedge member 608*a* has the same structure as that of the wedge member 608*a* of the locking force adjustment mechanisms 608. The insertion holes 708*b* are formed at parts where the plate-like portions 41*a* and 42*a* intersect with the base portion 31.

More specifically, the insertion hole 708*b* of the locking force adjustment mechanism 708 on the locking claw 41 side is formed at a connection part between the plate-like portion 41*a* and the edge along the long-side direction of the base portion 31. The insertion hole 708*b* of the locking force adjustment mechanism 708 on the locking claw 41 side is formed at a position where the wedge portion 608*d* of the wedge member 608*a* can be inserted into the insertion hole 708*b* in the axial direction (vertical direction) and where the distal end of the wedge portion 608*d* is inserted between the lid member 104 of the battery housing 101 and the plate-like portion 41*a* serving as the member formed integrally with the base portion 31 (refer to FIG. 34 and other figures).

Similarly, the insertion hole 708*b* of the locking force adjustment mechanism 708 on the locking claw 42 side is formed at a connection part between the plate-like portion 42*a* and the edge along the short-side direction of the base portion 31. The insertion hole 708*b* of the locking force adjustment mechanism 708 on the locking claw 42 side is formed at a position where the wedge portion 608*d* of the wedge member 608*a* can be inserted into the insertion hole 708*b* in the axial direction (vertical direction) and where the distal end of the wedge portion 608*d* is inserted between the lid member 104 of the battery housing 101 and the plate-like portion 42*a* serving as the member formed integrally with the base portion 31 (refer to FIG. 34 and other figures).

The insertion holes 708*b* are formed into the following shape: when the wedge members 608*a* are thrusted most, the entire wedge members 608*a* are fit in the respective insertion holes 708*b* (refer to FIGS. 33 and 34 and other figures).

In the locking force adjustment mechanisms 708 having the structure described above, as illustrated in FIGS. 32 and 33, the wedge members 608*a* are inserted into the respective insertion holes 708*b*, and the distal ends of the respective wedge members 608*a* are interposed between the plate-like portions 41*a* and 42*a* serving as the member formed integrally with the base portion 31 of the protector 3 and the lid member 104 of the battery housing 101. The wedge members 608*a* thus can relatively move the protector 3 in the long-side direction or the short-side direction with respect to the lid member 104. As a result, the locking force adjustment mechanisms 708 can reliably thrust the back surface protruding portions 745 of the locking claws 41 and 42 formed integrally with the base portion 31 and the holding portion 32 of the protector 3 against the lower ends in the vertical direction of the edges of the lid member 104. Consequently, the locking force adjustment mechanisms 708 can relatively increase the force of the back surface protruding portions 745 of the locking claws 41 and 42 engaging with the lid member 104. By using the mechanism described above, the locking force adjustment mechanisms 708 causes the wedge members 608*a* to be interposed between the plate-like portions 41*a* and 42*a* formed integrally with the protector 3 and the battery housing 101, thereby relatively increasing the locking force of the locking claws 41 and 42 locking the protector 3 onto the post standing surface 105.

In the fuse unit 701 described above, the holding portion 32 formed next to the base portion 31 of the protector 3 holds the fusible link 2 above the post standing surface 105 of the battery housing 101. As a result, the fuse unit 701 receives the load of the fusible link 2 on the post standing surface 105. This structure can suppress the load acting on the battery terminal 110 from the fuse unit 701, thereby suppressing the load acting on the battery post 102. At this time, the fuse unit 701 can cause the locking mechanism 704 to reliably attach the protector 3 onto the post standing surface 105 together with the fusible link 2. Even if there is no space for the fuse unit 701 around the side surfaces of the battery housing 101, the fuse unit 701 can secure its installation space on the post standing surface 105 (upper surface in the vertical direction) of the battery housing 101 and arrange the fusible link 2 thereon. Consequently, the fuse unit 701 can appropriately provide the fusible link 2.

After the protector 3 is attached onto the post standing surface 105, the fuse unit 701 causes the locking force adjustment mechanisms 708 to relatively increase the locking force of the locking claws 41 and 42. Consequently, the fuse unit 701 can lock the protector 3 onto the post standing surface 105 together with the fusible link 2 more reliably.

In the fuse unit 701, the locking claws 41 and 42 are formed integrally with the protector 3. The locking force adjustment mechanisms 708 each include the wedge member 608*a* interposed between the plate-like portion 41*a* and 42*a* formed integrally with the protector 3 and the battery housing 101. The wedge members 608*a* are interposed between the plate-like portion 41*a* and 42*a* formed integrally with the protector 3 and the battery housing 101, thereby relatively increasing the locking force. The fuse unit 701 causes the wedge members 608*a* to be interposed between the plate-like portion 41*a* and 42*a* formed integrally with the protector 3 and the battery housing 101 in the locking force adjustment mechanisms 708, thereby relatively increasing the locking force of the locking claws 41 and 42. As a result, the fuse unit 701 can relatively strengthen the force (that is, the locking force) of the locking claws 41 and 42 fastening the lid member 104 of the battery housing 101. Consequently, the fuse unit 701 can lock the protector 3 onto the post standing surface 105 more reliably and absorb the tolerance by the locking force adjustment mechanisms 708.

The locking force adjustment mechanism 708 may be used in the fuse unit 201. Also in this case, the fuse unit 201 can lock the protector 3 onto the post standing surface 105 more reliably.

Eighth Embodiment

Figure 35:
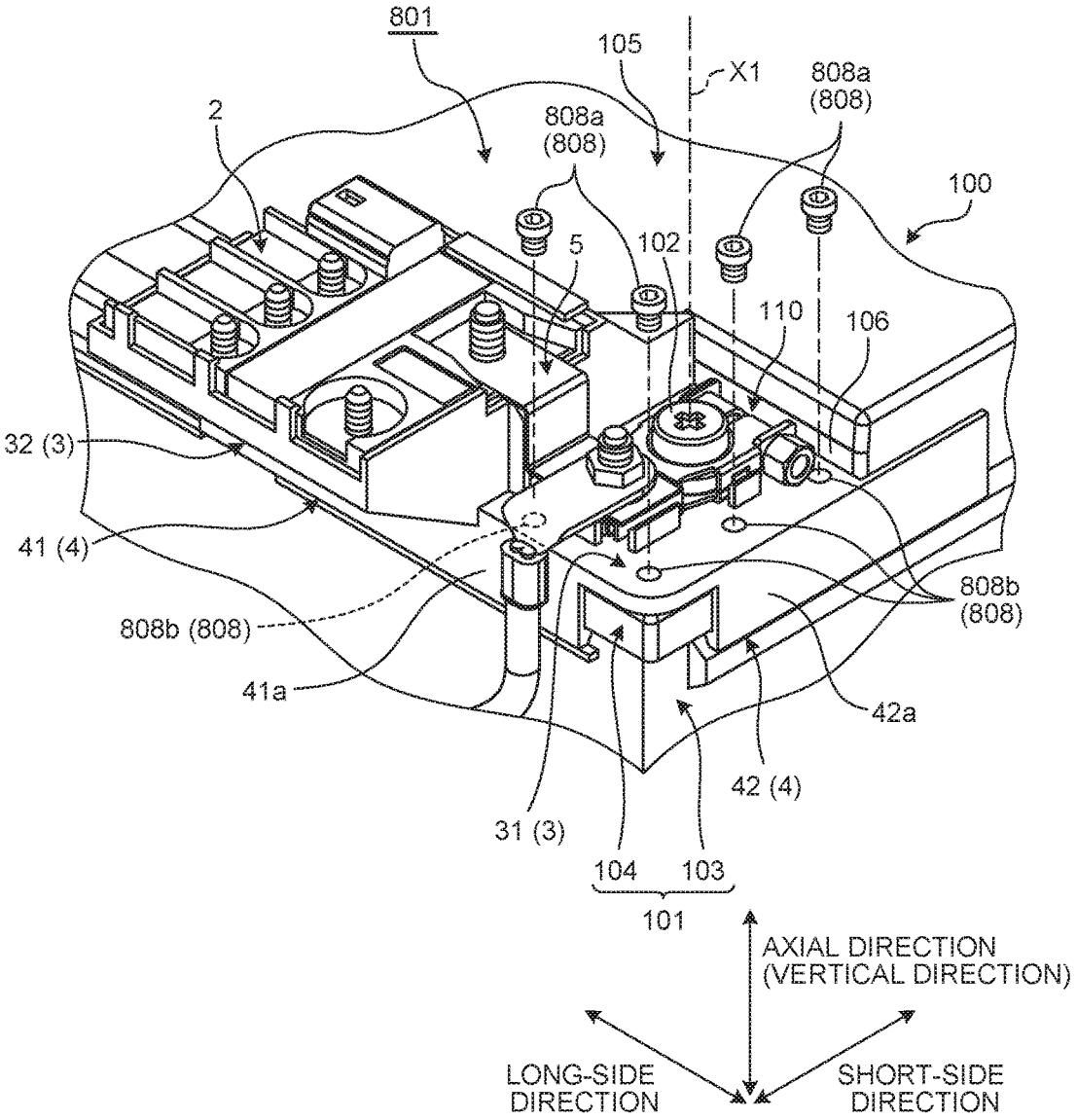
FIG. 35 is an exploded perspective view illustrating a part near a locking force adjustment mechanism of a fuse unit according to an eighth embodiment.
Figure 36:
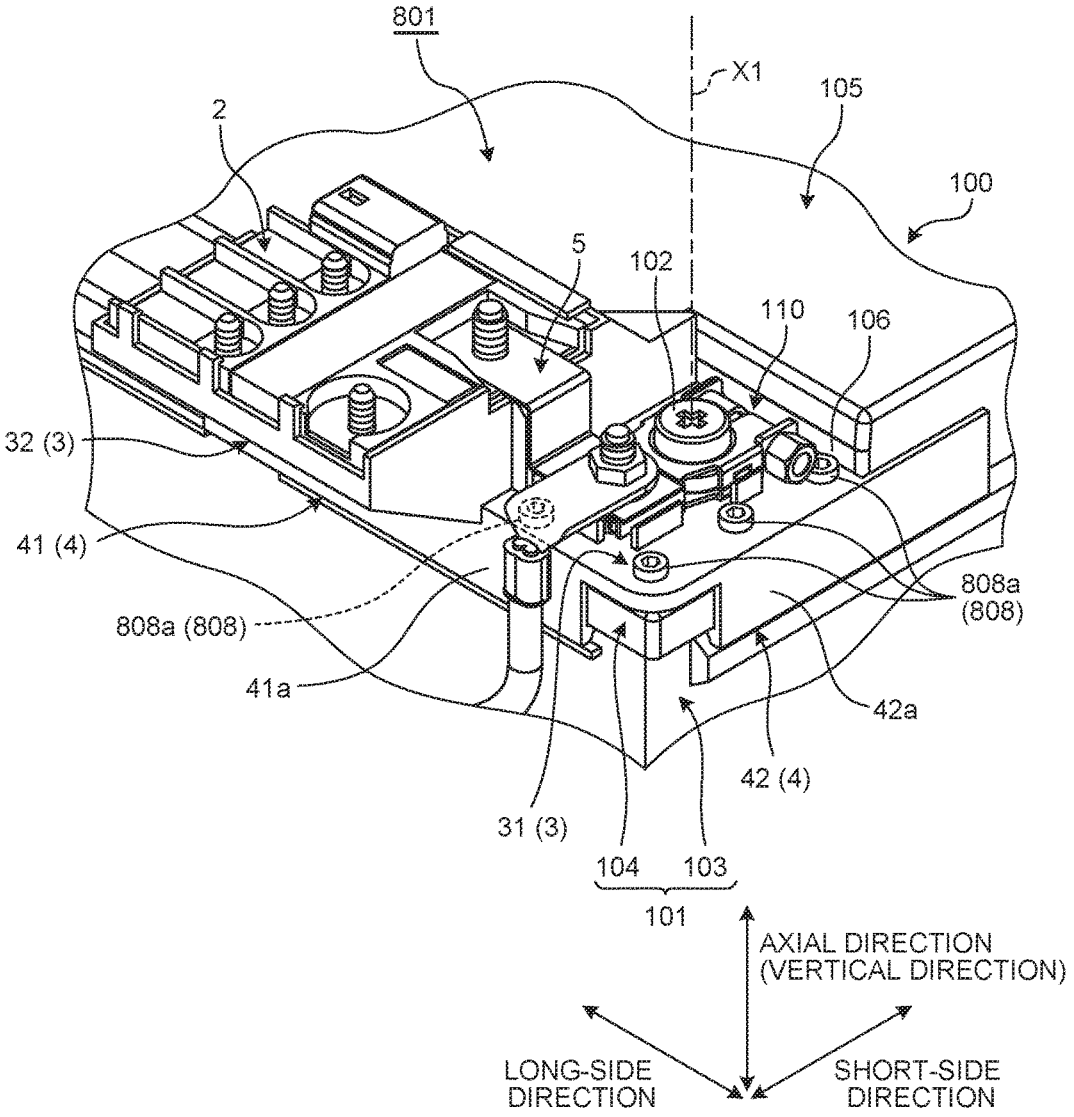
FIG. 36 is a partial perspective view illustrating the part near the locking force adjustment mechanism of the fuse unit according to the eighth embodiment.
Figure 37:
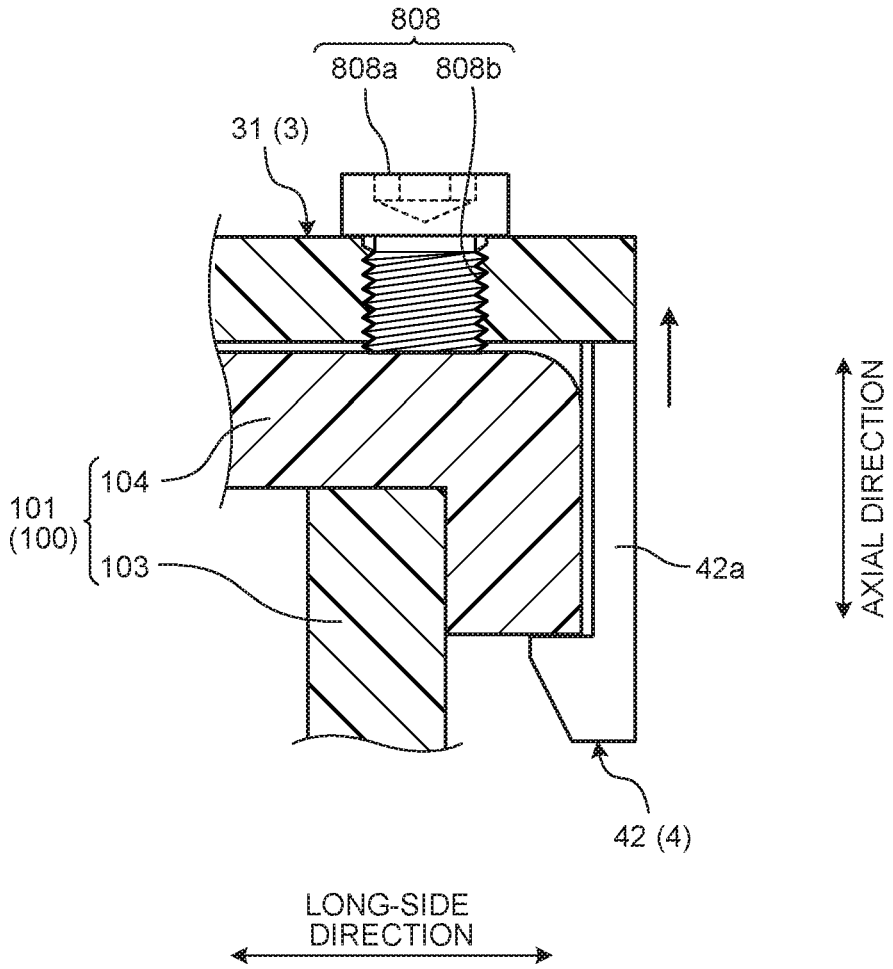
FIG. 37 is a partial sectional view including a screw member of the fuse unit according to the eighth embodiment.

FIG. 35 is an exploded perspective view illustrating a part near a locking force adjustment mechanism of a fuse unit according to an eighth embodiment. FIG. 36 is a partial perspective view illustrating the part near the locking force adjustment mechanism of the fuse unit according to the eighth embodiment. FIG. 37 is a partial sectional view including a screw member of the fuse unit according to the eighth embodiment. The fuse unit according to the eighth embodiment is different from the third embodiment in the structure of the locking force adjustment mechanisms. Overlapping explanation of other components, actions, and effects common to the embodiments above will be omitted as much as possible. The schematic configuration will be described with reference to other figures as appropriate.

As illustrated in FIGS. 35, 36, and 37, a fuse unit 801 according to the present embodiment includes, in addition to the fusible link 2, the protector 3 serving as the holding mechanism, the locking mechanism 4, and the coupling bus bar 5, locking force adjustment mechanisms 808. The locking force adjustment mechanisms 808 can adjust the locking force of the locking claws 41 and 42 in the locking mechanism 4 locking the protector 3 onto the post standing surface 105.

Similarly to the first embodiment, the locking claws 41 and 42 according to the present embodiment are formed integrally with the base portion 31 and the holding portion 32 of the protector 3 via the plate-like portions (arm portions) 41*a* and 42*a*, respectively, extending in the vertical direction in the attached state. The locking claws 41 and 42 engage with the lower end surfaces in the vertical direction of the edges of the lid member 104 in the battery housing 101. In the locking mechanism 4, the locking claws 41 and 42 engage with the lower end surfaces in the vertical direction of the lid member 104 at predetermined positions when the protector 3 is attached onto the post standing surface 105 of the battery 100. As a result, the locking mechanism 4 can fix and lock the protector 3 onto the post standing surface 105.

The locking force adjustment mechanisms 808 according to the present embodiment each include a screw member 808*a* screwed into the protector 3. Along with the screwing motion, the distal end of the screw member 808*a* comes into contact with the battery housing 101, and the screw member 808*a* presses the battery housing 101 such that the protector 3 moves away from the battery housing 101. The locking force adjustment mechanisms 808 each have a screw hole 808*b* formed on the protector 3 and into which the screw member 808*a* can be screwed.

In the attached state, four screw holes 808*b* are formed in total: one screw hole 808*b* formed at the external corner where the edge along the long-side direction of the base portion 31 intersects with the edge along the short-side direction, one screw hole 808*b* formed apart from the screw hole 808*b* at the corner in the long-side direction, and two screw holes 808*b* formed apart from the screw hole 808*b* at the corner in the short-side direction at evenly spaced intervals. The screw holes 808*b* are bored through the base portion 31 and each have a screw groove with which the screw member 808*a* can engage on the inner peripheral surface. The screw member 808*a* is a bolt, for example, and four screw members 808*a* are provided in total for the respective four screw holes 808*b*. In the locking force adjustment mechanisms 808 according to the present embodiment, one screw member 808*a* and one screw hole 808*b* serve as a pair, and four pairs of the screw member 808*a* and the screw hole 808*b* are provided in total.

In the locking force adjustment mechanisms 808 having the structure described above, the screw members 808*a* are screwed into the respective screw holes 808*b* formed on the protector 3. Along with the screwing motion, the distal ends of the screw members 808*a* come into contact with the upper surface in the vertical direction of the lid member 104 of the battery housing 101, and the screw members 808*a* press the lid member 104 such that the protector 3 moves away from the lid member 104. The screw members 808*a* thus can relatively move the protector 3 with respect to the lid member 104 in a manner lifting the protector 3 in the vertical direction. As a result, the locking force adjustment mechanisms 808 can reliably thrust, toward the upper side in the vertical direction, the locking claws 41 and 42 formed integrally with the base portion 31 and the holding portion 32 of the protector 3 against the lower end surfaces in the vertical direction of the edges of the lid member 104. Consequently, the locking force adjustment mechanisms 808 can relatively increase the force of the locking claws 41 and 42 engaging with the lid member 104. By using the mechanism described above, the locking force adjustment mechanisms 808 causes the screw members 808*a* to press the battery housing 101 such that the protector 3 moves away from the battery housing 101, thereby relatively increasing the locking force of the locking claws 41 and 42 locking the protector 3 onto the post standing surface 105.

In the fuse unit 801 described above, the holding portion 32 formed next to the base portion 31 of the protector 3 holds the fusible link 2 above the post standing surface 105 of the battery housing 101. As a result, the fuse unit 801 receives the load of the fusible link 2 on the post standing surface 105. This structure can suppress the load acting on the battery terminal 110 from the fuse unit 801, thereby suppressing the load acting on the battery post 102. At this time, the fuse unit 801 can cause the locking mechanism 4 to reliably attach the protector 3 onto the post standing surface 105 together with the fusible link 2. Even if there is no space for the fuse unit 801 around the side surfaces of the battery housing 101, the fuse unit 801 can secure its installation space on the post standing surface 105 (upper surface in the vertical direction) of the battery housing 101 and arrange the fusible link 2 thereon. Consequently, the fuse unit 801 can appropriately provide the fusible link 2.

After the protector 3 is attached onto the post standing surface 105, the fuse unit 801 causes the locking force adjustment mechanisms 808 to relatively increase the locking force of the locking claws 41 and 42. Consequently, the fuse unit 801 can lock the protector 3 onto the post standing surface 105 together with the fusible link 2 more reliably.

In the fuse unit 801, the locking claws 41 and 42 are formed integrally with the protector 3. The locking force adjustment mechanisms 808 each include the screw member 808*a* screwed into the protector 3. Along with the screwing motion, the distal end of the screw member 808*a* comes into contact with the battery housing 101, and the screw member 808*a* presses the battery housing 101 such that the protector 3 moves away from the battery housing 101. The screw member 808*a* presses the battery housing 101 such that the protector 3 moves away from the battery housing 101, thereby relatively increasing the locking force. The fuse unit 801 causes the screw members 808*a* screwed into the protector 3 to press the battery housing 101 in the locking force adjustment mechanisms 808, thereby relatively increasing the locking force of the locking claws 41 and 42. As a result, the fuse unit 801 can relatively strengthen the force (that is, the locking force) of the locking claws 41 and 42 fastening the lid member 104 of the battery housing 101. Consequently, the fuse unit 801 can lock the protector 3 onto the post standing surface 105 more reliably and absorb the tolerance by the locking force adjustment mechanisms 808.

The locking force adjustment mechanism 808 may be used in the fuse unit 201. Also in this case, the fuse unit 201 can lock the protector 3 onto the post standing surface 105 more reliably.

Ninth Embodiment

Figure 38:
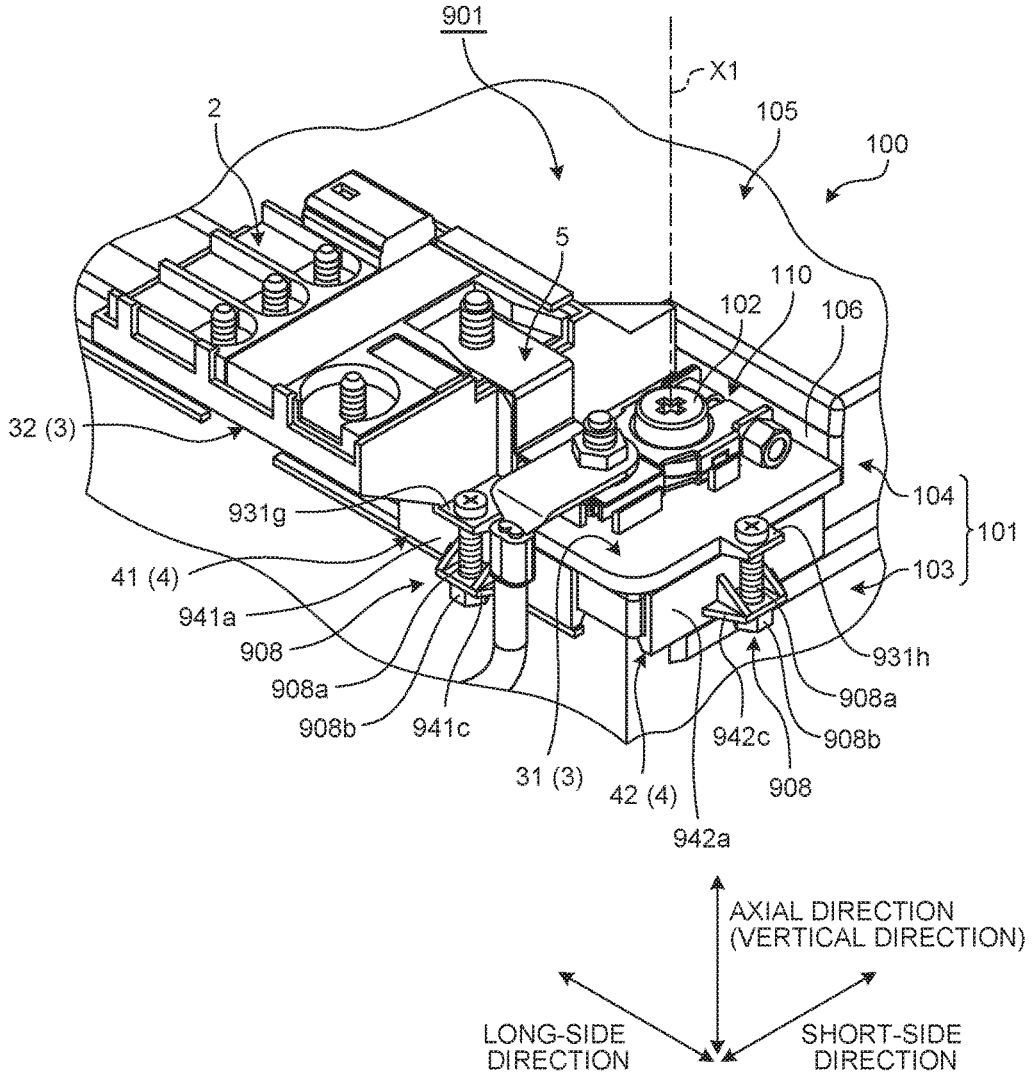
FIG. 38 is a partial perspective view illustrating a part near a locking force adjustment mechanism of a fuse unit according to a ninth embodiment.
Figure 39:
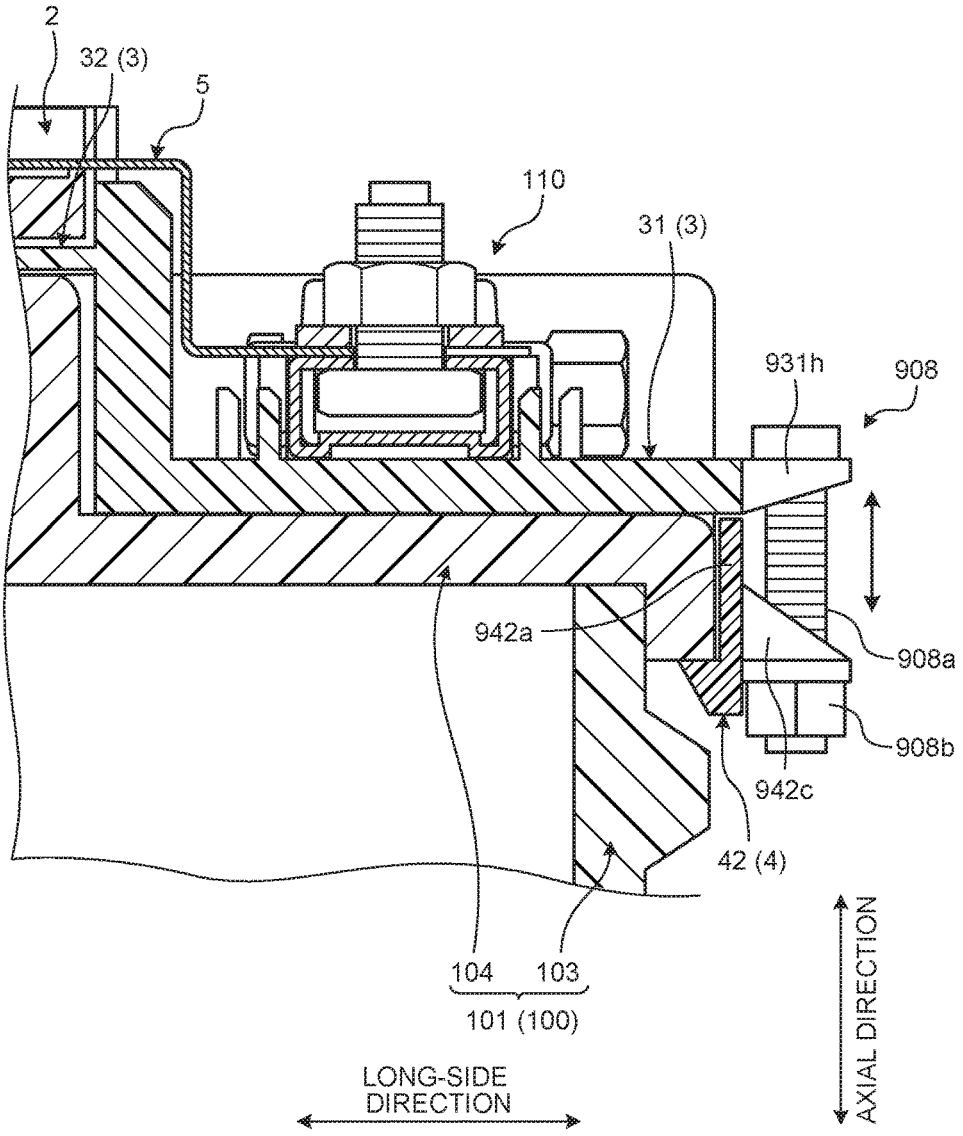
FIG. 39 is a partial sectional view including the locking claw of the fuse unit according to the ninth embodiment.

FIG. 38 is a partial perspective view illustrating a part near a locking force adjustment mechanism of a fuse unit according to a ninth embodiment. FIG. 39 is a partial sectional view including the locking claw of the fuse unit according to the ninth embodiment. The fuse unit according to the ninth embodiment is different from the third embodiment in the structure of the locking force adjustment mechanisms. Overlapping explanation of other components, actions, and effects common to the embodiments above will be omitted as much as possible. The schematic configuration will be described with reference to other figures as appropriate.

As illustrated in FIGS. 38 and 39, a fuse unit 901 according to the present embodiment includes, in addition to the fusible link 2, the protector 3 serving as the holding mechanism, the locking mechanism 4, and the coupling bus bar 5, locking force adjustment mechanisms 908. The locking force adjustment mechanisms 908 can adjust the locking force of the locking claws 41 and 42 in the locking mechanism 4 locking the protector 3 onto the post standing surface 105.

The locking claws 41 and 42 according to the present embodiment are formed separately from the protector 3. More specifically, the locking claws 41 and 42 according to the present embodiment are formed integrally with plate-like portions (arm portions) 941*a* and 942*a*, respectively, at the distal ends of the plate-like portions 941*a* and 942*a*. The plate-like portions 941*a* and 942*a* are formed separately from the base portion 31 and the holding portion 32 of the protector 3. The locking claws 41 and 42 have a hook shape or a curved shape formed by bending the distal ends (ends on the lower side in the vertical direction when the protector 3 is attached onto the post standing surface 105 of the battery 100) of the plate-like portions 941*a* and 942*a*, respectively (refer to FIG. 39 and other figures). The plate-like portions 941*a* and 942*a* have brackets 941*c* and 942*c*, respectively, formed integrally therewith on the main surface. The plate-like portions 941*a* and 942*a* are coupled to the base portion 31 of the protector 3 via the brackets 941*c* and 942*c*, respectively, and a coupling member 908*a*, which will be described later.

The locking force adjustment mechanisms 908 according to the present embodiment are provided to the locking claw 41 side and the locking claw 42 side. The enlarged partial sectional view in FIG. 39 illustrates the locking force adjustment mechanism 908 on the locking claw 42 side. Because the locking force adjustment mechanism 908 on the locking claw 41 side has substantially the same structure as that on the locking claw 42 side, illustration thereof is omitted.

The locking force adjustment mechanisms 908 each include the coupling member 908*a* that couples the protector 3 to the locking claws 41 and 42 and can change the gap between the protector 3 and the locking claws 41 and 42 along with rotation about the axis. The coupling member 908*a* is a bolt, for example. The coupling members 908*a* are supported by receiving portions 931*g* and 931*h* formed on the base portion 31. The receiving portion 931*g* supports the coupling member 908*a* of the locking force adjustment mechanism 908 on the locking claw 41 side. The receiving portion 931*g* is formed at the edge along the long-side direction of the base portion 31 correspondingly to the locking claw 41. The receiving portion 931*h* supports the coupling member 908*a* of the locking force adjustment mechanism 908 on the locking claw 42 side. The receiving portion 931*h* is formed at the edge along the short-side direction of the base portion 31 correspondingly to the locking claw 42. The receiving portions 931*g* and 931*h* support the respective coupling members 908*a* in a manner rotatable about the rotation axis extending in the vertical direction (axial direction). When the coupling members 908*a* are supported by the receiving portions 931*g* and 931*h*, the bolt heads are positioned on the receiving portions 931*g* and 931*h*, and the shafts having a screw groove extend toward the lower side in the vertical direction. The brackets 941*c* and 942*c* are provided with nuts 908*b*, and the distal ends (ends on the lower side in the vertical direction when the protector 3 is attached onto the post standing surface 105 of the battery 100) of the coupling members 908*a* engage with the respective nuts 908*b*. As a result, the coupling members 908*a* can couple the locking claws 41 and 42 to the base portion 31 of the protector 3 via the brackets 941*c* and 942*c* and the plate-like portions 941*a* and 942*a*, respectively.

In the attached state and in a state where the locking claw 41 and the plate-like portion 941*a* are coupled to the base portion 31 by the coupling member 908*a*, the locking claw 41 and the plate-like portion 941*a* are arranged at a position facing the side surface along the long-side direction of the lid member 104 of the battery housing 101, that is, a position facing the side surface along the long-side direction near the recess 106 formed on the post standing surface 105 of the lid member 104 in the present embodiment. In this state, the locking claw 41 and the plate-like portion 941*a* extend in the long-side direction, and the coupling member 908*a* extends in the vertical direction. In the attached state and in a state where the locking claw 42 and the plate-like portion 942*a* are coupled to the base portion 31 by the coupling member 908*a*, the locking claw 42 and the plate-like portion 942*a* are arranged at a position facing the side surface along the short-side direction of the lid member 104 of the battery housing 101, that is, a position facing the side surface along the short-side direction near the recess 106 formed on the post standing surface 105 of the lid member 104 in the present embodiment. In this state, the locking claw 42 and the plate-like portion 942*a* extend in the short-side direction, and the coupling member 908*a* extends in the vertical direction.

In the locking force adjustment mechanisms 908 having the structure described above, the coupling members 908*a* couple the protector 3 to the locking claws 41 and 42 and are rotated about the axis, thereby changing the gap between the protector 3 and the locking claws 41 and 42. In the locking force adjustment mechanisms 908, for example, the coupling members 908*a* are rotated in a predetermined direction, thereby making the gap between the protector 3 and the locking claws 41 and 42 relatively small. In other words, the coupling members 908*a* can lift the locking claws 41 and 42 toward the upper side in the vertical direction, thereby relatively moving the locking claws 41 and 42 closer to the protector 3. As a result, the locking force adjustment mechanisms 908 can reliably thrust, toward the upper side in the vertical direction, the locking claws 41 and 42 against the lower end surfaces in the vertical direction of the edges of the lid member 104. Consequently, the locking force adjustment mechanisms 908 can relatively increase the force of the locking claws 41 and 42 engaging with the lid member 104. The locking force adjustment mechanisms 908 thus can relatively increase the locking force of the locking claws 41 and 42 locking the protector 3 onto the post standing surface 105.

In the fuse unit 901 described above, the holding portion 32 formed next to the base portion 31 of the protector 3 holds the fusible link 2 above the post standing surface 105 of the battery housing 101. As a result, the fuse unit 901 receives the load of the fusible link 2 on the post standing surface 105. This structure can suppress the load acting on the battery terminal 110 from the fuse unit 901, thereby suppressing the load acting on the battery post 102. At this time, the fuse unit 901 can cause the locking mechanism 4 to reliably attach the protector 3 onto the post standing surface 105 together with the fusible link 2. Even if there is no space for the fuse unit 901 around the side surfaces of the battery housing 101, the fuse unit 901 can secure its installation space on the post standing surface 105 (upper surface in the vertical direction) of the battery housing 101 and arrange the fusible link 2 thereon. Consequently, the fuse unit 901 can appropriately provide the fusible link 2.

After the protector 3 is attached onto the post standing surface 105, the fuse unit 901 causes the locking force adjustment mechanisms 908 to relatively increase the locking force of the locking claws 41 and 42. Consequently, the fuse unit 901 can lock the protector 3 onto the post standing surface 105 together with the fusible link 2 more reliably.

In the fuse unit 901, the locking claws 41 and 42 are formed separately from the protector 3. The locking force adjustment mechanisms 908 each include the coupling member 908*a* that couples the protector 3 to the locking claws 41 and 42 and can change the gap between the protector 3 and the locking claws 41 and 42 along with rotation about the axis. The coupling members 908*a* make the gap between the protector 3 and the locking claws 41 and 42 relatively small, thereby relatively increasing the locking force. The fuse unit 901 causes the coupling members 908*a* in the locking force adjustment mechanisms 908 to make the gap between the protector 3 and the locking claws 41 and 42 relatively small, thereby relatively increasing the locking force of the locking claws 41 and 42. As a result, the fuse unit 901 can relatively strengthen the force (that is, the locking force) of the locking claws 41 and 42 fastening the lid member 104 of the battery housing 101. Consequently, the fuse unit 901 can lock the protector 3 onto the post standing surface 105 more reliably and absorb the tolerance by the locking force adjustment mechanisms 908.

The locking force adjustment mechanism 908 may be used in the fuse unit 201. Also in this case, the fuse unit 201 can lock the protector 3 onto the post standing surface 105 more reliably.

Tenth Embodiment

Figure 40:
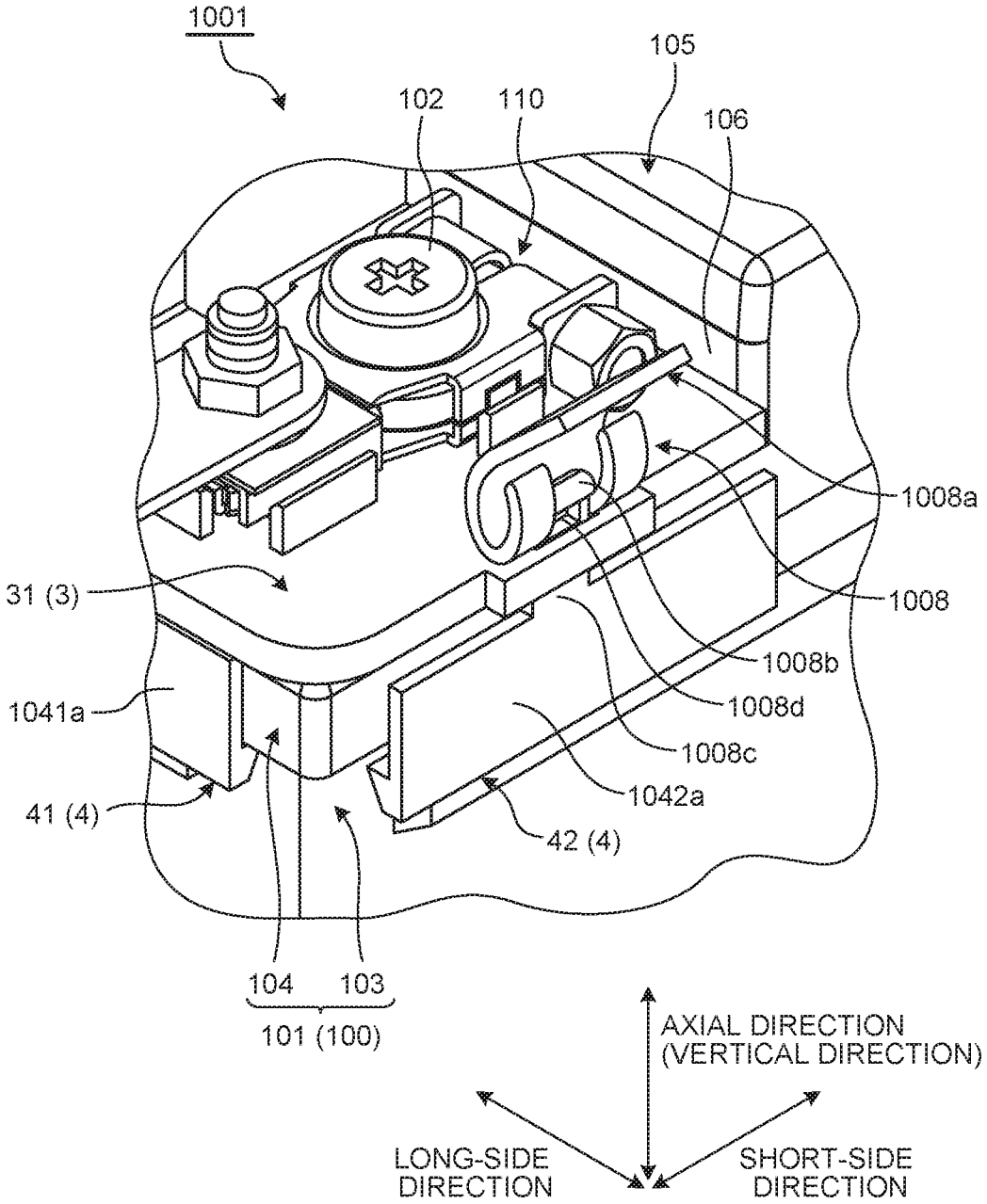
FIG. 40 is a partial perspective view illustrating a part near a locking force adjustment mechanism of a fuse unit according to a tenth embodiment.
Figure 41:
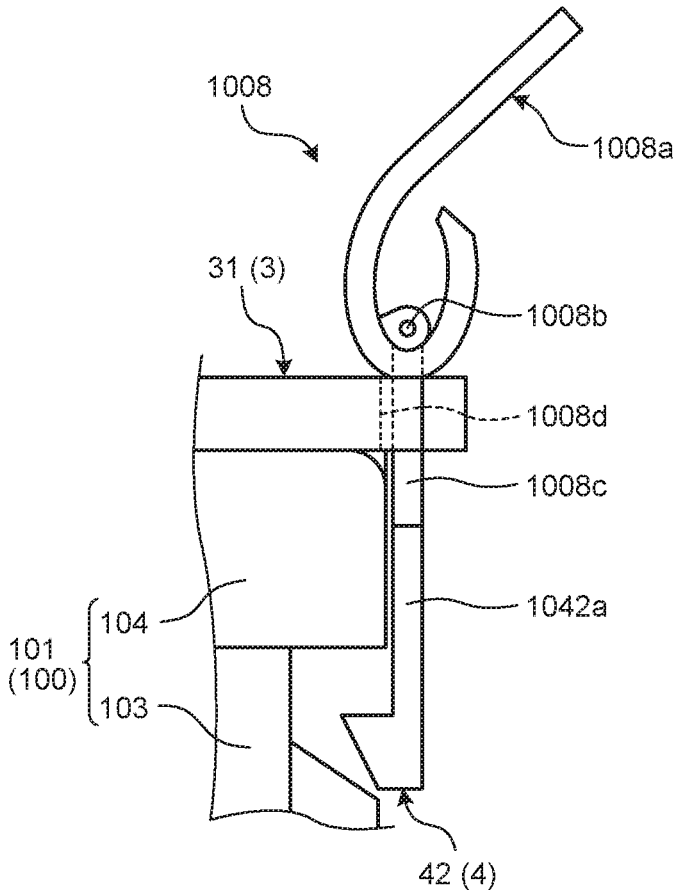
FIG. 41 is a partial side view illustrating the part near the locking force adjustment mechanism of the fuse unit according to the tenth embodiment.
Figure 42:
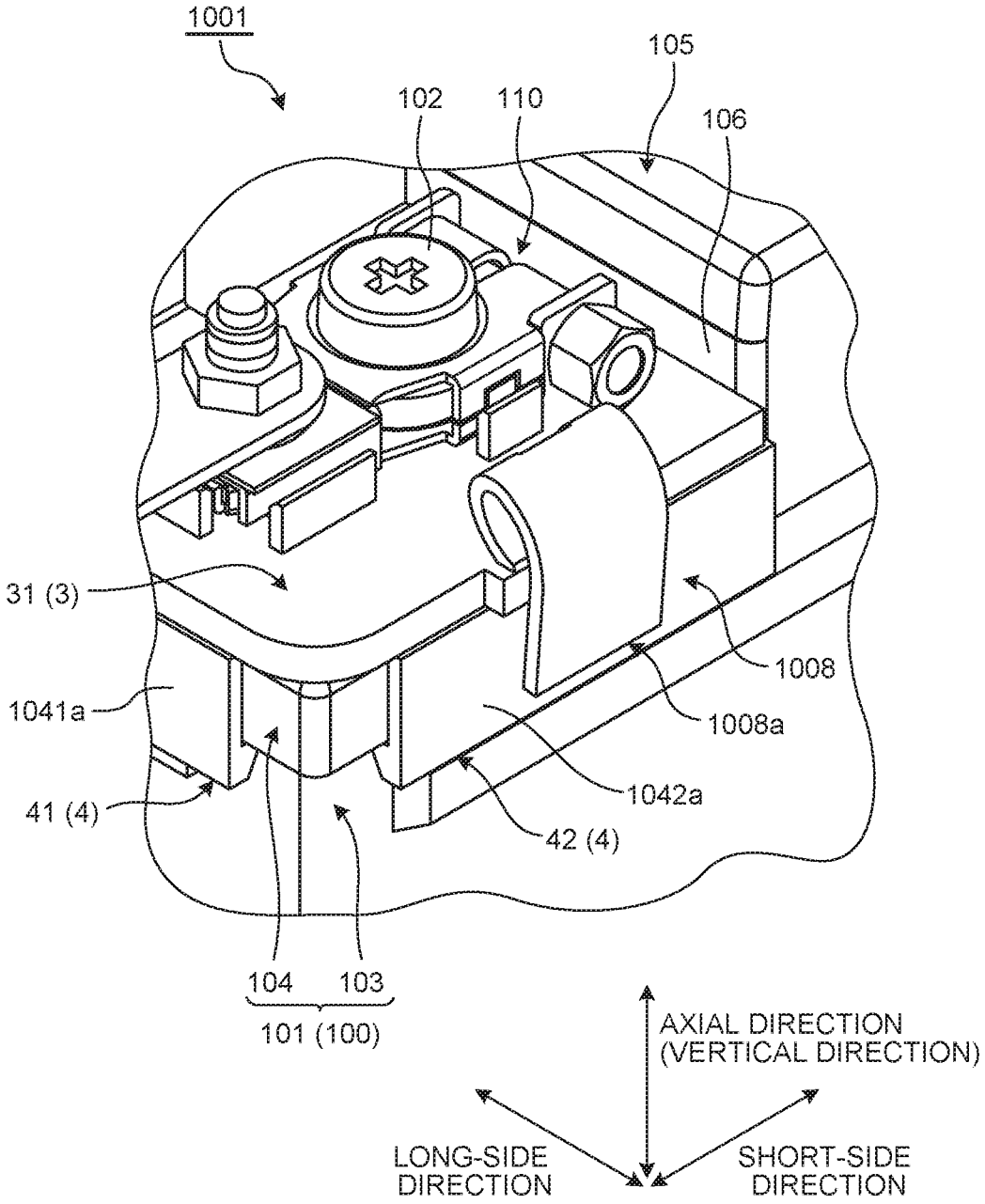
FIG. 42 is another partial perspective view illustrating the part near the locking force adjustment mechanism of the fuse unit according to the tenth embodiment.
Figure 43:
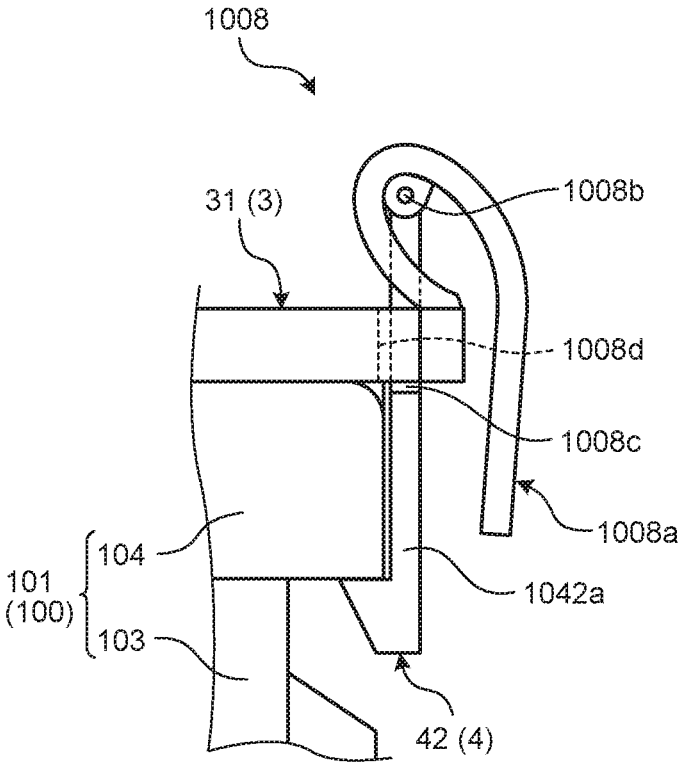
FIG. 43 is another partial side view illustrating the part near the locking force adjustment mechanism of the fuse unit according to the tenth embodiment.

FIGS. 40 and 42 are partial perspective views illustrating a part near a locking force adjustment mechanism of a fuse unit according to a tenth embodiment. FIGS. 41 and 43 are partial side views illustrating the part near the locking force adjustment mechanism of the fuse unit according to the tenth embodiment. The fuse unit according to the tenth embodiment is different from the third embodiment in the structure of the locking force adjustment mechanisms. Overlapping explanation of other components, actions, and effects common to the embodiments above will be omitted as much as possible. The schematic configuration will be described with reference to other figures as appropriate.

As illustrated in FIGS. 40 to 43, a fuse unit 1001 according to the present embodiment includes, in addition to the fusible link 2 (refer to FIG. 1 and other figures), the protector 3 serving as the holding mechanism, the locking mechanism 4, and the coupling bus bar 5 (refer to FIG. 1 and other figures), locking force adjustment mechanisms 1008. The locking force adjustment mechanisms 1008 can adjust the locking force of the locking claws 41 and 42 in the locking mechanism 4 locking the protector 3 onto the post standing surface 105.

The locking claws 41 and 42 according to the present embodiment are formed separately from the protector 3. More specifically, the locking claws 41 and 42 according to the present embodiment are formed integrally with plate-like portions (arm portions) 1041*a* and 1042*a*, respectively, at the distal ends of the plate-like portions 1041*a* and 1042*a*. The plate-like portions 1041*a* and 1042*a* are formed separately from the base portion 31 and the holding portion 32 of the protector 3. The locking claws 41 and 42 have a hook shape or a curved shape formed by bending the distal ends (ends on the lower side in the vertical direction when the protector 3 is attached onto the post standing surface 105 of the battery 100) of the plate-like portions 1041*a* and 1042*a*, respectively (refer to FIGS. 41 and 43 and other figures).

The locking force adjustment mechanisms 1008 according to the present embodiment are provided to the locking claw 41 side and the locking claw 42 side. FIGS. 40, 41, 42, and 43 illustrate the locking force adjustment mechanism 1008 on the locking claw 42 side. Because the locking force adjustment mechanism 1008 on the locking claw 41 side has substantially the same structure as that on the locking claw 42 side, illustration thereof is omitted.

The locking force adjustment mechanisms 1008 each include a flat lever 1008*a* coupled to a shaft 1008*b* provided to the locking claws 41 and 42 side in a manner rotatable about the shaft 1008*b*. The outer surface of the flat lever 1008*a* is in contact with the protector 3, and the flat lever 1008*a* changes the distance from the contact position with the protector 3 to the shaft 1008*b* along with rotation about the shaft 1008*b*. The shafts 1008*b* are provided on the upper ends (ends on the upper side in the vertical direction when the protector 3 is attached onto the post standing surface 105 of the battery 100) of the plate-like portions 1041*a* and 1042*a* formed integrally with the locking claws 41 and 42, respectively. More specifically, the plate-like portions 1041*a* and 1042*a* each have a protruding end 1008*c* protruding toward the upper side in the vertical direction from the end surface on the upper side in the vertical direction. The shafts 1008*b* are provided on the upper ends in the vertical direction of the respective protruding ends 1008*c*. The protruding ends 1008*c* are inserted into respective through holes 1008*d* formed on the base portion 31 of the protector 3. The through hole 1008*d* of the locking force adjustment mechanism 1008 on the locking claw 42 side is formed at the edge along the short-side direction of the base portion 31 correspondingly to the locking claw 42. The through hole 1008*d* of the locking force adjustment mechanism 1008 on the locking claw 41 side, which is not illustrated, is formed at the edge along the long-side direction of the base portion 31 correspondingly to the locking claw 41. The through holes 1008*d* are bored through the base portion 31 in the vertical direction. The protruding ends 1008*c* are inserted into the respective through holes 1008*d*. In this state, the shafts 1008*b* are positioned on the upper side in the vertical direction of the respective through holes 1008*d*, and the portions on the locking claws 41 and 42 side extend toward the lower side in the vertical direction. The flat levers 1008*a* are coupled to the respective shafts 1008*b* in a manner rotatable about the shafts 1008*b*. The locking force adjustment mechanism 1008 on the locking claw 42 side has components, such as the shaft 1008*b*, arranged in a positional relation where the rotation axis of the flat lever 1008*a* extends in the short-side direction. Similarly, the locking force adjustment mechanism 1008 on the locking claw 41 side, which is not illustrated, has components, such as the shaft 1008*b*, arranged in a positional relation where the rotation axis of the flat lever 1008*a* extends in the long-side direction. The flat levers 1008*a* may be made of resin or metal.

In the attached state and in a state where the plate-like portion 1042*a* is attached to the flat lever 1008*a* via the shaft 1008*b*, the locking claw 42 and the plate-like portion 1042*a* are arranged at a position facing the side surface along the short-side direction of the lid member 104 of the battery housing 101, that is, a position facing the side surface along the short-side direction near the recess 106 formed on the post standing surface 105 of the lid member 104 in the present embodiment. In this state, the locking claw 42 and the plate-like portion 1042*a* extend in the short-side direction. In the attached state and in a state where the plate-like portion 1041*a* is attached to the flat lever 1008*a* via the shaft 1008*b*, the locking claw 41 and the plate-like portion 1041*a*, which are not illustrated, are arranged at a position facing the side surface along the long-side direction of the lid member 104 of the battery housing 101, that is, a position facing the side surface along the long-side direction near the recess 106 formed on the post standing surface 105 of the lid member 104 in the present embodiment. In this state, the locking claw 41 and the plate-like portion 1041*a* extend in the long-side direction.

The flat levers 1008*a* are formed by curving a plate-like member (partially having a slit in the present embodiment). The flat levers 1008*a* are coupled to the respective shafts 1008*b*, and the outer surface of the curved part is in contact with the upper surface in the vertical direction of the base portion 31 of the protector 3. The curvature of the curved part is set such that the distance from the contact position with the base portion 31 to the shaft 1008*b* changes when the flat levers 1008*a* rotate about the respective shafts 1008*b*. The flat levers 1008*a* according to the present embodiment are designed as follows: when being rotated toward one side, the distance from the contact position to the shaft 1008*b* gradually increases, and when being rotated toward the other side, the distance from the contact position to the shaft 1008*b* gradually decreases.

The locking force adjustment mechanisms 1008 having the structure described above make the distance from the contact position with the base portion 31 to the shafts 1008*b* relatively long along with rotation of the flat levers 1008*a* about the shafts 1008*b*, thereby making the locking claws 41 and 42 closer to the base portion 31 of the protector 3. As a result, the locking force adjustment mechanisms 1008 can relatively increase the locking force of the locking claws 41 and 42 locking the protector 3 onto the post standing surface 105. Specifically, in the locking force adjustment mechanisms 1008, the distance from the contact position with the base portion 31 to the shaft 1008*b* is relatively small in the state illustrated in FIGS. 40 and 41, for example. From this state, the flat lever 1008*a* is rotated (rotated to be pulled down) to make the distance from the contact position with the base portion 31 to the shaft 1008*b* relatively long as illustrated in FIGS. 42 and 43. As a result, the locking force adjustment mechanisms 1008 can lift the respective shafts 1008*b* toward the upper side in the vertical direction with respect to the base portion 31. The locking force adjustment mechanisms 1008 thus can lift the locking claws 41 and 42 formed integrally with the plate-like portions 1041*a* and 1042*a*, respectively, provided with the shafts 1008*b* toward the upper side in the vertical direction, thereby relatively moving the locking claws 41 and 42 closer to the protector 3. As a result, the locking force adjustment mechanisms 1008 can reliably thrust, toward the upper side in the vertical direction, the locking claws 41 and 42 against the lower end surfaces in the vertical direction of the edges of the lid member 104. Consequently, the locking force adjustment mechanisms 1008 can relatively increase the force of the locking claws 41 and 42 engaging with the lid member 104. The locking force adjustment mechanisms 1008 thus can relatively increase the locking force of the locking claws 41 and 42.

In the fuse unit 1001 described above, the holding portion 32 formed next to the base portion 31 of the protector 3 holds the fusible link 2 above the post standing surface 105 of the battery housing 101. As a result, the fuse unit 1001 receives the load of the fusible link 2 on the post standing surface 105. This structure can suppress the load acting on the battery terminal 110 from the fuse unit 1001, thereby suppressing the load acting on the battery post 102. At this time, the fuse unit 1001 can cause the locking mechanism 4 to reliably attach the protector 3 onto the post standing surface 105 together with the fusible link 2. Even if there is no space for the fuse unit 1001 around the side surfaces of the battery housing 101, the fuse unit 1001 can secure its installation space on the post standing surface 105 (upper surface in the vertical direction) of the battery housing 101 and arrange the fusible link 2 thereon. Consequently, the fuse unit 1001 can appropriately provide the fusible link 2.

After the protector 3 is attached onto the post standing surface 105, the fuse unit 1001 causes the locking force adjustment mechanisms 1008 to relatively increase the locking force of the locking claws 41 and 42. Consequently, the fuse unit 1001 can lock the protector 3 onto the post standing surface 105 together with the fusible link 2 more reliably.

In the fuse unit 1001 described above, the locking claws 41 and 42 are formed separately from the protector 3. The locking force adjustment mechanisms 1008 each include the flat lever 1008*a* coupled to the shaft 1008*b* provided to the locking claws 41 and 42 side in a manner rotatable about the shaft 1008*b*. The outer surface of the flat lever 1008*a* is in contact with the protector 3, and the flat lever 1008*a* changes the distance from the contact position with the protector 3 to the shaft 1008*b* along with rotation about the shaft 1008*b*. The locking force adjustment mechanisms 1008 make the distance from the contact position to the shaft 1008*b* relatively long along with rotation of the flat lever 1008*a* about the shaft 1008*b*, thereby making the locking claws 41 and 42 closer to the protector 3 and relatively increasing the locking force. In the fuse unit 1001, the locking force adjustment mechanisms 1008 make the distance from the contact position to the shaft 1008*b* relatively long along with rotation of the flat lever 1008*a* about the shaft 1008*b*, thereby making the locking claws 41 and 42 closer to the protector 3. The locking force adjustment mechanisms 1008 thus can relatively increase the locking force of the locking claws 41 and 42. As a result, the fuse unit 1001 can relatively strengthen the force (that is, the locking force) of the locking claws 41 and 42 fastening the lid member 104 of the battery housing 101. Consequently, the fuse unit 1001 can lock the protector 3 onto the post standing surface 105 more reliably and absorb the tolerance by the locking force adjustment mechanisms 1008.

The locking force adjustment mechanism 1008 may be used in the fuse unit 201. Also in this case, the fuse unit 201 can lock the protector 3 onto the post standing surface 105 more reliably.

Eleventh Embodiment

Figure 44:
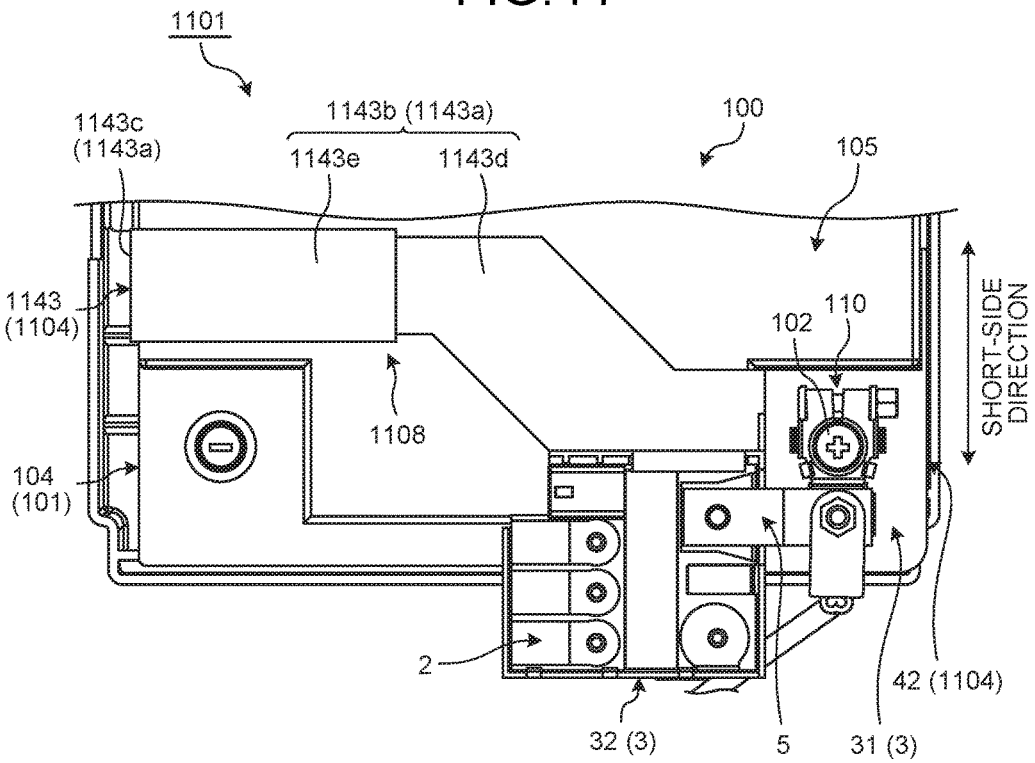
FIG. 44 is a partial plan view including a locking force adjustment mechanism of a fuse unit according to an eleventh embodiment.
Figure 45:
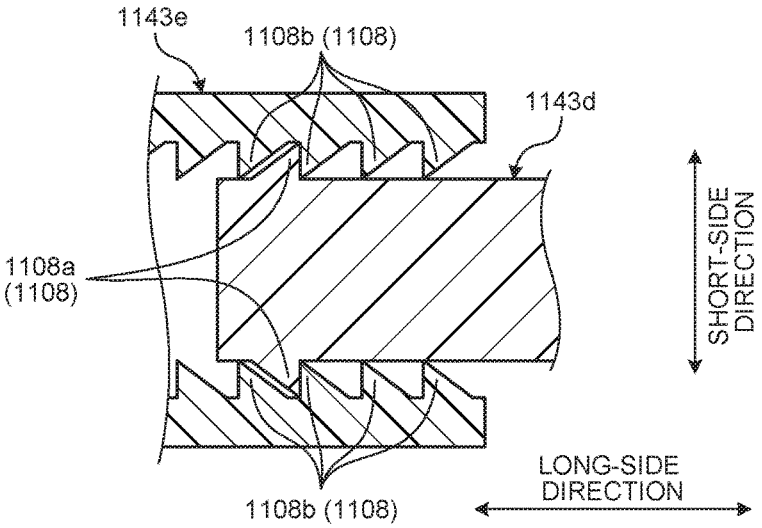
FIG. 45 is a partial sectional view including the locking force adjustment mechanism of the fuse unit according to the eleventh embodiment.

FIG. 44 is a partial plan view including a locking force adjustment mechanism of a fuse unit according to an eleventh embodiment. FIG. 45 is a partial sectional view including the locking force adjustment mechanism of the fuse unit according to the eleventh embodiment. The fuse unit according to the eleventh embodiment is different from the first embodiment in the positions where the locking claws of the locking mechanism are provided and in that it further includes the locking force adjustment mechanisms. Overlapping explanation of other components, actions, and effects common to the embodiments above will be omitted as much as possible. The schematic configuration will be described with reference to other figures as appropriate.

As illustrated in FIGS. 44 and 45, a fuse unit 1101 according to the present embodiment includes, in addition to the fusible link 2, the protector 3 serving as the holding mechanism, a locking mechanism 1104, and the coupling bus bar 5, a locking force adjustment mechanism 1108. The locking force adjustment mechanism 1108 can adjust the locking force of the locking claw 42 and a locking claw 1143 in the locking mechanism 1104 locking the protector 3 onto the post standing surface 105.

The locking mechanism 1104 locks the protector 3 onto the post standing surface 105. The locking mechanism 1104 according to the present embodiment includes the locking claws 42 and 1143 that engage with the battery housing 101, thereby locking the protector 3 onto the post standing surface 105. The locking claws 42 and 1143 engage with two surfaces opposite to each other in the battery housing 101, that is, two surfaces extending in the short-side direction in the present embodiment. As described above, the locking claw 42 is formed integrally with the base portion 31 of the protector 3 via the plate-like portion 42*a* extending in the vertical direction in the attached state.

By contrast, the locking claw 1143 according to the present embodiment is connected to the base portion 31 and the holding portion 32 of the protector 3 via a support 1143*a*. The support 1143*a* has a main body 1143*b* and a curved portion 1143*c*. The main body 1143*b* extends in the long-side direction from the base portion 31 and the holding portion 32 in the attached state. The curved portion 1143*c* extends toward the lower side in the vertical direction from the end opposite to the end on the protector 3 side (the base portion 31 and the holding portion 32) of the main body 1143*b*.

The main body 1143*b* is divided into a first divided body 1143*d* and a second divided body 1143*e*. One of the first divided body 1143*d* and the second divided body 1143*e* is formed into a plate shape, and the other thereof is formed into a tubular shape. In the present embodiment, the first divided body 1143*d* is formed into a plate shape, and the second divided body 1143*e* is formed into a tubular shape. A first end of the first divided body 1143*d* is integrally connected to the base portion 31 and the holding portion 32 of the protector 3. A first end of the second divided body 1143*e* is integrally connected to the curved portion 1143*c*. In the first divided body 1143*d* and the second divided body 1143*e*, a second end of the first divided body 1143*d* is inserted into a second end of the second divided body 1143*e*. As a result, the second ends are connected to each other via the locking force adjustment mechanism 1108, which will be described later.

The locking claw 1143 according to the present embodiment is formed integrally with the curved portion 1143*c* at the distal end (end on the lower side in the vertical direction when the protector 3 is attached onto the post standing surface 105 of the battery 100) of the curved portion 1143*c* of the support 1143*a*. The locking claw 1143 has a hook shape or a curved shape formed by bending the distal end of the curved portion 1143*c*. The locking claws 42 and 1143 engage with the lower end surfaces in the vertical direction of the edges along the short-side direction of the lid member 104 in the battery housing 101.

In other words, the locking claw 42 serves as a first locking claw formed integrally with the protector 3. By contrast, the locking claw 1143 serves as a second locking claw formed separately from the protector 3 and engages with the surface opposite to the surface with which the locking claw 42 engage in the battery housing 101. In other words, the locking claw 42 and the locking claw 1143 are in a positional relation opposite to each other in the long-side direction. The locking mechanism 1104 causes the locking claws 42 and 1143 to engage with the lower end surfaces in the vertical direction of the lid member 104 at predetermined positions when the protector 3 is attached onto the post standing surface 105 of the battery 100. As a result, the locking mechanism 1104 can fix and lock the protector 3 onto the post standing surface 105.

The locking force adjustment mechanism 1108 according to the present embodiment has a first cog 1108*a* and a plurality of second cogs 1108*b*. The first cog 1108*a* is formed on one of the locking claw 42 side and the locking claw 1143 side. The second cogs 1108*b* are formed on the other of the locking claw 42 side and the locking claw 1143 side in a manner aligned in a direction in which the locking claw 42 and the locking claw 1143 are opposite to each other.

In the locking force adjustment mechanism 1108, as illustrated in FIG. 45 and other figures, the first cog 1108*a* is provided on the first divided body 1143*d* of the support 1143*a* formed integrally with the locking claw 42. The second cogs 1108*b* are provided on the second divided body 1143*e* of the support 1143*a* formed integrally with the locking claw 1143.

The first cogs 1108*a* are provided on respective surfaces opposite to each other in the first divided body 1143*d*, that is, a pair of end surfaces extending in the long-side direction and opposite to each other in the short-side direction in the present embodiment. The first cog 1108*a* is formed as a protruding cog protruding from the first divided body 1143*d*. Sets of second cogs 1108*b* are provided on respective surfaces facing the surface on which the first cog 1108*a* is formed in the first divided body 1143*d* out of the inner surfaces of the second divided body 1143*e*. In other words, the sets of the second cogs 1108*b* are provided on a pair of inner surfaces extending in the long-side direction and facing each other in the short-side direction. The second cogs 1108*b* are formed as protruding cogs protruding from the second divided body 1143*e*. The second cogs 1108*b* are formed in each set in a manner aligned in the direction in which the locking claw 42 and the locking claw 1143 are opposite to each other, that is, in the long-side direction.

The first cog 1108*a* and the second cogs 1108*b* are formed into the following sectional shape: when the locking claw 42 and the locking claw 1143 are moved in the directions closer to each other and moved in the directions sandwiching the battery housing 101 therebetween, the second cogs 1108*b* climb over the first cog 1108*a*; and when the locking claw 42 and the locking claw 1143 are moved in the directions away from each other and tried to be moved in the directions away from the battery housing 101, one of the second cogs 1108*b* comes into contact with the first cog 1108*a*, thereby restricting relative movement between the locking claw 42 and the locking claw 1143.

In the locking force adjustment mechanism 1108 having the structure described above, the first cog 1108*a* engages with one of the second cogs 1108*b*, thereby restricting the movement of the locking claw 42 and the locking claw 1143 toward the sides away from each other. By using the mechanism described above, the locking force adjustment mechanism 1108 makes the locking claw 42 and the locking claw 1143 closer to each other as much as possible, thereby relatively increasing the force of the locking claw 42 and the locking claw 1143 sandwiching the lid member 104 of the battery housing 101. As a result, the locking force adjustment mechanism 1108 can relatively increase the locking force of the locking claw 42 and the locking claw 1143 locking the protector 3 onto the post standing surface 105 and maintain this state.

In the fuse unit 1101 described above, the holding portion 32 formed next to the base portion 31 of the protector 3 holds the fusible link 2 above the post standing surface 105 of the battery housing 101. As a result, the fuse unit 1101 receives the load of the fusible link 2 on the post standing surface 105. This structure can suppress the load acting on the battery terminal 110 from the fuse unit 1101, thereby suppressing the load acting on the battery post 102. At this time, the fuse unit 1101 can cause the locking mechanism 1104 to reliably attach the protector 3 onto the post standing surface 105 together with the fusible link 2. Even if there is no space for the fuse unit 1101 around the side surfaces of the battery housing 101, the fuse unit 1101 can secure its installation space on the post standing surface 105 (upper surface in the vertical direction) of the battery housing 101 and arrange the fusible link 2 thereon. Consequently, the fuse unit 1101 can appropriately provide the fusible link 2.

After the protector 3 is attached onto the post standing surface 105, the fuse unit 1101 causes the locking force adjustment mechanism 1108 to relatively increase the locking force of the locking claws 42 and 1143. Consequently, the fuse unit 1101 can lock the protector 3 onto the post standing surface 105 together with the fusible link 2 more reliably.

The fuse unit 1101 includes the locking claw 42 and the locking claw 1143. The locking claw 42 serves as a first locking claw formed integrally with the protector 3. The locking claw 1143 serves as a second locking claw that is formed separately from the protector 3 and that engages with the surface opposite to the surface with which the locking claw 42 engages in the battery housing 101. The locking force adjustment mechanism 1108 has the first cog 1108*a* and the second cogs 1108*b*. The first cog 1108*a* is formed on one of the locking claw 42 side and the locking claw 1143 side. The second cogs 1108*b* are formed on the other of the locking claw 42 side and the locking claw 1143 side in a manner aligned in the direction in which the locking claw 42 and the locking claw 1143 are opposite to each other. The first cog 1108*a* engages with one of the second cogs 1108*b*, thereby restricting the movement of the locking claw 42 and the locking claw 1143 toward the sides away from each other and relatively increasing the locking force. The fuse unit 1101 uses the mechanism that the first cog 1108*a* engages with one of the second cogs 1108*b* in the locking force adjustment mechanism 1108, thereby restricting the movement of the locking claw 42 and the locking claw 1143 toward the sides away from each other. Consequently, the fuse unit 1101 relatively increases the force of the locking claws 42 and 1143 engaging with the lid member 104 of the battery housing 101. The fuse unit 1101 thus can relatively increase the locking force of the locking claws 42 and 1143 locking the protector 3 onto the post standing surface 105 and maintain this state. As a result, the fuse unit 1101 can relatively strengthen the force (that is, the locking force) of the locking claws 42 and 1143 fastening the lid member 104 of the battery housing 101. Consequently, the fuse unit 1101 can lock the protector 3 onto the post standing surface 105 more reliably and absorb the tolerance by the locking force adjustment mechanism 1108.

Twelfth Embodiment

Figure 46:
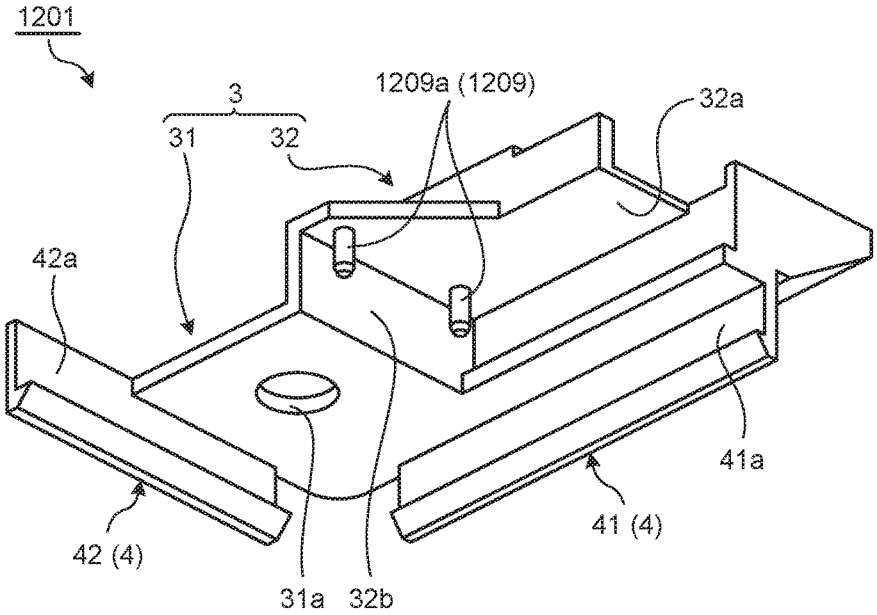
FIG. 46 is a perspective view of a protector of a fuse unit according to a twelfth embodiment.
Figure 47:
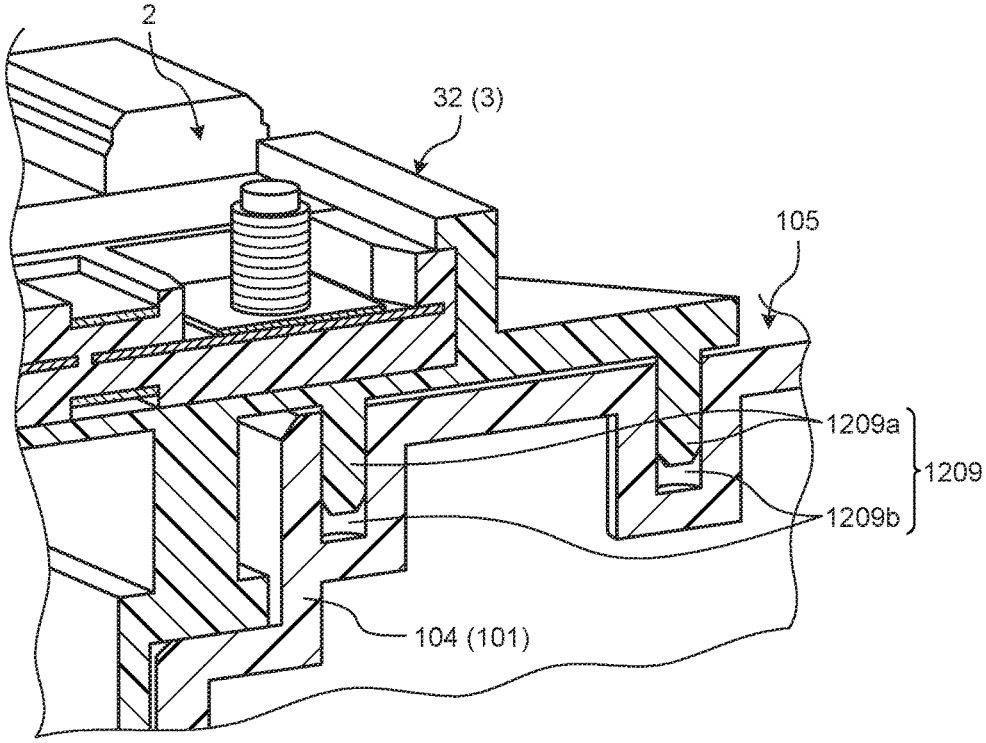
FIG. 47 is a partial sectional perspective view including a protector positioning mechanism of the fuse unit according to the twelfth embodiment.

FIG. 46 is a perspective view of the protector of a fuse unit according to a twelfth embodiment. FIG. 47 is a partial sectional perspective view including a protector positioning mechanism of the fuse unit according to the twelfth embodiment. The fuse unit according to the twelfth embodiment is different from the first embodiment in that it further includes a holding mechanism positioning mechanism. Overlapping explanation of other components, actions, and effects common to the embodiments above will be omitted as much as possible. The schematic configuration will be described with reference to other figures as appropriate.

As illustrated in FIGS. 46 and 47, a fuse unit 1201 according to the present embodiment includes, in addition to the fusible link 2 (refer to FIG. 1 and other figures), the protector 3 serving as the holding mechanism, the locking mechanism 4 (refer to FIG. 1 and other figures), and the coupling bus bar 5 (refer to FIG. 1 and other figures), a protector positioning mechanism 1209 serving as the holding mechanism positioning mechanism.

The protector positioning mechanism 1209 positions the protector 3 at a predetermined position on the post standing surface 105. The protector positioning mechanism 1209 has a recess 1209*b* and a protrusion 1209*a*. The recess 1209*b* is formed on one of the post standing surface 105 and the protector 3. The protrusion 1209*a* is provided on the other of the post standing surface 105 and the protector 3 and fit into the recess 1209*b*. In the present embodiment, two protrusions 1209*a* are provided on the back surface (surface opposite to the accommodation space 32*c*) of the bottom surface 32*a* of the holding portion 32 on the protector 3. Two recesses 1209*b* are formed on the post standing surface 105 on the side in the long-side direction of the recess 106 (refer to FIG. 2, for example). The protrusions 1209*a* and the recesses 1209*b* are formed into a cylindrical shape and extend in the axial direction (vertical direction).

In the protector positioning mechanism 1209, the protrusions 1209*a* are fit into the respective recesses 1209*b*, thereby positioning the protector 3 at the predetermined position on the post standing surface 105. As a result, the protector positioning mechanism 1209 can prevent misalignment of the protector 3 in the horizontal direction (the long-side direction and the short-side direction) intersecting with the vertical direction (axial direction). The protector positioning mechanism 1209 thus positions the battery terminal 110 at a position where the battery terminal 110 can be fastened to the battery post 102 on the base portion 31. The predetermined position on the post standing surface 105 is a position where at least part of the holding portion 32 is positioned on the post standing surface 105 and places and holds the fusible link 2 above the post standing surface 105 when the protector 3 is attached to the battery 100 in a positional relation where the battery post 102 is inserted into the post insertion hole 31*a* of the base portion 31 and where the base portion 31 is positioned in the recess 106.

In the fuse unit 1201, the holding portion 32 formed next to the base portion 31 of the protector 3 holds the fusible link 2 above the post standing surface 105 of the battery housing 101. As a result, the fuse unit 1201 receives the load of the fusible link 2 on the post standing surface 105. This structure can suppress the load acting on the battery terminal 110 from the fuse unit 1201, thereby suppressing the load acting on the battery post 102. At this time, the fuse unit 1201 can cause the locking mechanism 4 to reliably attach the protector 3 onto the post standing surface 105 together with the fusible link 2. Even if there is no space for the fuse unit 1201 around the side surfaces of the battery housing 101, the fuse unit 1201 can secure its installation space on the post standing surface 105 (upper surface in the vertical direction) of the battery housing 101 and arrange the fusible link 2 thereon. Consequently, the fuse unit 1201 can appropriately provide the fusible link 2.

The fuse unit 1201 includes the protector positioning mechanism 1209 that positions the protector 3 on the post standing surface 105. The protector positioning mechanism 1209 has the recess 1209*b* and the protrusion 1209*a*. The recess 1209*b* is formed on one of the post standing surface 105 and the protector 3. The protrusion 1209*a* is provided on the other of the post standing surface 105 and the protector 3 and fit into the recess 1209*b*. In the fuse unit 1201, the protrusion 1209*a* of the protector positioning mechanism 1209 is fit into the recess 1209*b*, thereby positioning the protector 3 at an appropriate position on the post standing surface 105 and preventing misalignment of the protector 3.

While the protrusion 1209*a* is provided on the protector 3, and the recess 1209*b* is formed on the post standing surface 105 in the description above, the protrusion 1209*a* may be provided on the post standing surface 105, and the recess 1209*b* may be formed on the protector 3. While two protrusions 1209*a* and two recesses 1209*b* are provided in the description above, the number of protrusions 1209*a* and recesses 1209*b* may be one or three or more.

The protector positioning mechanism 1209 may be used in the fuse unit 201. Also in this case, the fuse unit 201 can position the protector 3 at an appropriate position on the post standing surface 105 and prevent misalignment of the protector 3.

The fuse units according to the embodiments of the present invention are not limited to the embodiments above, and various changes may be made within the scope described in claims. The fuse unit according to the present embodiment may be provided by combining the components according to the embodiments and the modifications above as appropriate.

While the fuse elements 21 and the stud bolts 22 in the fusible link 2 are buried and integrally formed in the housing 23 by insert molding or other processing in the description above, the present embodiment is not limited thereto.

While the holding portion 32 of the protector 3 is formed integrally with the base portion 31 next to the base portion 31 in the long-side direction in the description above, the present embodiment is not limited thereto. The holding portion 32 may be formed integrally with the base portion 31 next to the base portion 31 in the short-side direction While the fuse units described above are used in the battery 100 having the recess 106 on the post standing surface 105, the present embodiment is not limited thereto. The fuse units may be used in a battery without the recess 106 and having a planar post standing surface 105. In this case, the base portion 31, the holding portion 32, the coupling bus bar 5, and other components in the fuse units are formed in a substantially planar shape.

In the fuse unit according to the present embodiments, the holding portion formed next to the base portion of the holding mechanism holds the fusible link above the post standing surface of the battery housing. As a result, the fuse unit receives the load of the fusible link on the post standing surface. This structure can suppress the load acting on the battery terminal from the fuse unit, thereby suppressing the load acting on the battery post. At this time, the fuse unit can cause the locking mechanism to reliably attach the protector onto the post standing surface together with the fusible link.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fuse unit comprising:

a fusible link connected to a battery terminal and including a fusible element that melts when an overcurrent flows through the fusible link;

a holding mechanism that includes a base portion disposed between a post standing surface of a battery housing and the battery terminal in a state where the battery terminal is fastened to a battery post provided in a recess on the post standing surface, and a holding portion that is integrally formed with the base portion, that is located between the fusible link and the post standing surface, and that holds the fusible link above the post standing surface; and a locking mechanism that locks the holding mechanism onto the post standing surface, wherein the holding portion has a side wall on a base portion side extending toward a lower side in a vertical direction in a manner corresponding to a difference in level formed by the recess on the post standing surface and is connected to the base portion at a lower end of the side wall.

2. The fuse unit according to claim 1, wherein a locking claw is formed separately from the holding mechanism and supported by the holding mechanism in a manner capable of moving closer to and away from the battery housing, and a locking force adjustment mechanism has a first cog formed on one of a holding mechanism side and a locking claw side and a plurality of second cogs formed on the other of the holding mechanism side and the locking claw side in a manner aligned in a direction closer to or away from the battery housing, and the locking force adjustment mechanism causes the first cog to engage with one of the second cogs to restrict movement of the locking claw toward a side away from the battery housing and relatively increase the locking force.

* * * * *